US007575299B2

(12) United States Patent
Otokita

(10) Patent No.: US 7,575,299 B2
(45) Date of Patent: Aug. 18, 2009

(54) PRINTING APPARATUS AND PRINTING METHOD

(75) Inventor: Kenji Otokita, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/540,611

(22) Filed: Oct. 2, 2006

(65) Prior Publication Data

US 2007/0076052 A1 Apr. 5, 2007

(30) Foreign Application Priority Data

Sep. 30, 2005 (JP) ..... 2005-289351
Nov. 18, 2005 (JP) ..... 2005-334547

(51) Int. Cl.
*B41J 2/155* (2006.01)

(52) U.S. Cl. ..... 347/42; 347/15; 347/40; 347/41; 347/43; 445/24

(58) Field of Classification Search ..... 347/15, 347/40, 43
See application file for complete search history.

(56) References Cited

U.S. PATENT DOCUMENTS 6,158,841 A * 12/2000 Kakutani ..... 347/40
6,244,688 B1 * 6/2001 Hickman ..... 347/43
6,491,373 B1 * 12/2002 Fujita et al. ..... 347/41
2002/0105557 A1 * 8/2002 Teshigawara et al. ..... 347/15
2003/0071873 A1 * 4/2003 Kakutani ..... 347/43
2006/0038850 A1 * 2/2006 Teshigawara et al. ..... 347/43
2006/0197802 A1 * 9/2006 Konno ..... 347/43

FOREIGN PATENT DOCUMENTS

JP 2001-96771 A 4/2001

* cited by examiner

*Primary Examiner*—Matthew Luu
*Assistant Examiner*—John P Zimmermann
(74) *Attorney, Agent, or Firm*—Sughrue Mion, PLLC

(57) ABSTRACT

A printing apparatus of the present invention is provided with a carry unit for carrying a medium in a carrying direction, and a print head that has a plurality of nozzle rows each made up of a plurality of nozzles for ejecting ink lined up in the carrying direction, and that moves in an intersecting direction intersecting the carrying direction. The print head includes a first nozzle row and a second nozzle row for a first color, and a first nozzle row and a second nozzle row for a second color, a plurality of nozzles of the first nozzle row for the first color and a plurality of nozzles of the first nozzle row for the second color are disposed in the same positions in terms of the carrying direction, a plurality of nozzles of the second nozzle row for the first color and a plurality of nozzles of the second nozzle row for the second color are disposed in the same positions in terms of the carrying direction, a plurality of the nozzles of the second nozzle rows for the first color and the second color are respectively disposed shifted in the carrying direction with respect to a plurality of the nozzles of the corresponding first nozzle rows for the first color and the second color, and the nozzle rows are disposed in the intersecting direction in the order of the first nozzle row for the first color, the second nozzle row for the second color, the second nozzle row for the first color, and the first nozzle row for the second color.

6 Claims, 29 Drawing Sheets

PRINTING APPARATUS AND PRINTING METHOD

CROSS-REFERENCE TO RELATED APPLICATIONS

The present application claims priority upon Japanese Patent Application No. 2005-289351 filed on Sep. 30, 2005, and Japanese Patent Application No. 2005-334547 filed on Nov. 18, 2005, which are herein incorporated by reference.

BACKGROUND

1. Technical Field

The present invention relates to printing apparatuses and printing methods.

2. Related Art

In inkjet printers or the like, a print image is printed on paper by alternately repeating a dot forming process in which dots are formed on paper by ejecting ink droplets from a plurality of moving nozzles, and a carrying process in which paper is carried in a carrying direction, thereby arranging a plurality of dot rows (raster lines) in the carrying direction on paper. In the head of an inkjet printer, nozzle rows for respective colors are provided for ejecting ink droplets of each color (JP-A-2001-96771).

When a dot is formed by superimposing two or more colors of ink droplets, the color appearance of the dot varies depending on the landing order of the ink droplets. The reason for this is as follows. The ink droplet that first lands on paper spreads over a broad area on the paper to be soaked by the paper. The ink droplet that subsequently lands on the paper overlaps the first ink droplet and spreads over a smaller area than the initial ink droplet. The color of the ink droplet that first lands on paper is developed in a more conspicuous manner than the ink droplet that subsequently lands on paper.

When bidirectional printing is performed, since the landing order of two or more colors of ink droplets that form a dot varies between a dot formed in the forward pass printing and a dot formed in the return pass printing, the color appearance of these dots varies. When raster lines formed in the forward pass printing or raster lines formed in the return pass printing are formed consecutively lined up, such variance in the color appearance of dots becomes conspicuous, and may generate band-shaped unevenness in color.

SUMMARY

An advantage of some aspects of the present invention is that it is possible to suppress occurrence of unevenness in color and reduce effects of tilting of the head by devising the arrangement order of the nozzle rows for respective colors.

An aspect of the present invention is a printing apparatus including: a carry unit for carrying a medium in a carrying direction, and a print head that has a plurality of nozzle rows each made up of a plurality of nozzles for ejecting ink lined up in the carrying direction, and that moves in an intersecting direction intersecting the carrying direction, wherein the print head includes a first nozzle row and a second nozzle row for a first color, and a first nozzle row and a second nozzle row for a second color, a plurality of nozzles of the first nozzle row for the first color and a plurality of nozzles of the first nozzle row for the second color are disposed in the same positions in terms of the carrying direction, a plurality of nozzles of the second nozzle row for the first color and a plurality of nozzles of the second nozzle row for the second color are disposed in the same positions in terms of the carrying direction, a plurality of the nozzles of the second nozzle rows for the first color and the second color are respectively disposed shifted in the carrying direction with respect to a plurality of the nozzles of the corresponding first nozzle rows for the first color and the second color, and the nozzle rows are disposed in the intersecting direction in the order of the first nozzle row for the first color, the second nozzle row for the second color, the second nozzle row for the first color, and the first nozzle row for the second color.

Another advantage of some aspects of the present invention is that it is possible to provide a printing apparatus that is capable of mitigating occurrence of band-shaped unevenness in color even when bidirectional printing is performed.

Another aspect of the present invention is a printing apparatus, including:

a print head that has a yellow ink nozzle row for ejecting yellow ink, a magenta ink nozzle row for ejecting magenta ink, and a cyan ink nozzle row for ejecting cyan ink, each of the nozzle rows for the respective colors including a plurality of nozzles lined up in a predetermined direction at predetermined nozzle spacings; and a moving mechanism for relatively moving the positions of the print head and a medium in the predetermined direction, wherein a plurality of the nozzles of the yellow ink nozzle row are shifted in the predetermined direction with respect to the nozzles of the magenta ink nozzle row and the nozzles of the cyan ink nozzle row.

Other features of the present invention will become clear by reading the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings.

DESCRIPTION OF EXEMPLARY EMBODIMENTS

Figure 1:
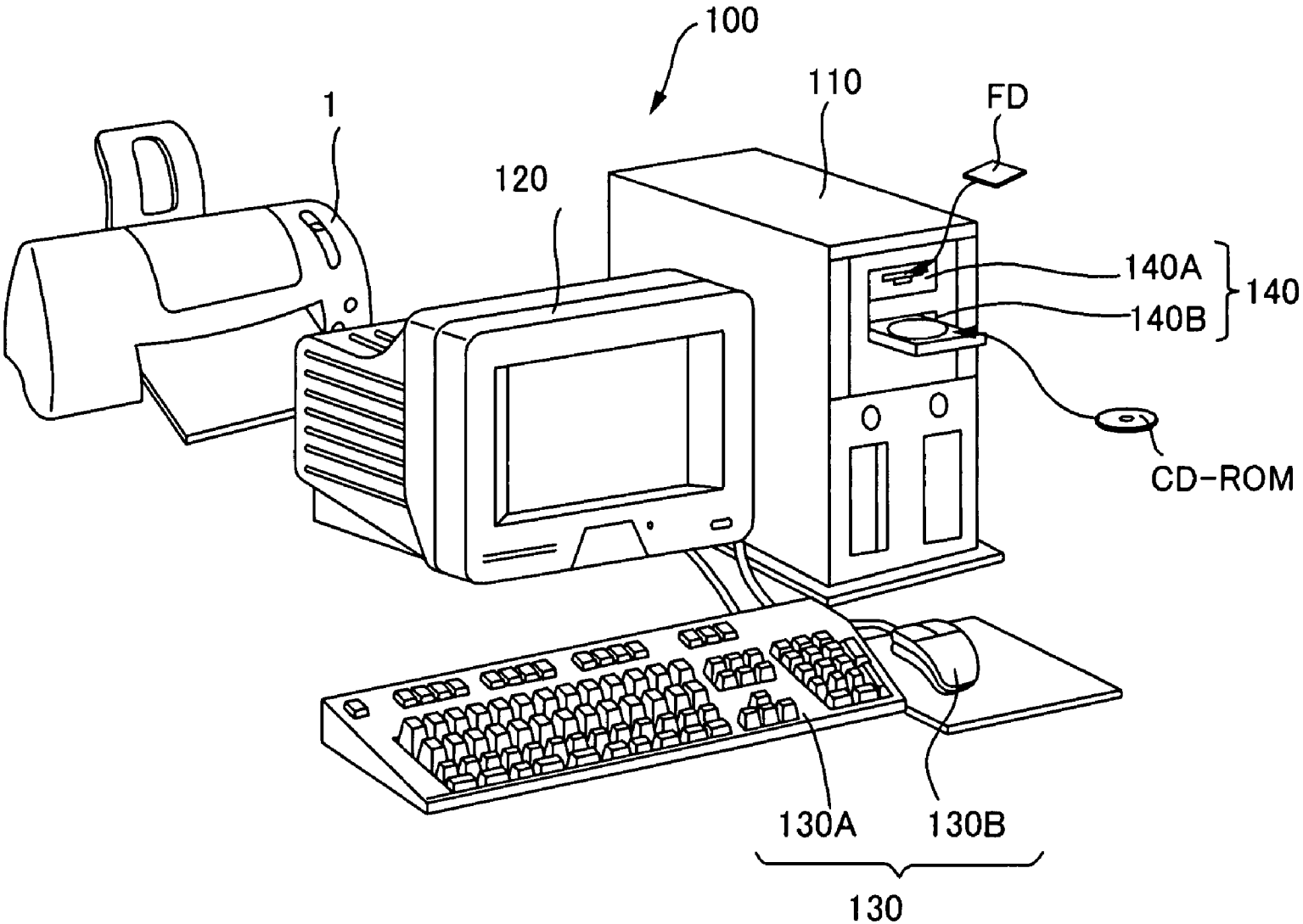
FIG. 1 is an explanatory diagram of the overall configuration of a printing system.

At least the following matters will be made clear by the explanation in the present specification and the description of the accompanying drawings.

A printing apparatus including:

a carry unit for carrying a medium in a carrying direction, and a print head that has a plurality of nozzle rows each made up of a plurality of nozzles for ejecting ink lined up in the carrying direction, and that moves in an intersecting direction intersecting the carrying direction, wherein the print head includes a first nozzle row and a second nozzle row for a first color, and a first nozzle row and a second nozzle row for a second color, a plurality of nozzles of the first nozzle row for the first color and a plurality of nozzles of the first nozzle row for the second color are disposed in the same positions in terms of the carrying direction, a plurality of nozzles of the second nozzle row for the first color and a plurality of nozzles of the second nozzle row for the second color are disposed in the same positions in terms of the carrying direction, a plurality of the nozzles of the second nozzle rows for the first color and the second color are respectively disposed shifted in the carrying direction with respect to a plurality of the nozzles of the corresponding first nozzle rows for the first color and the second color, and the nozzle rows are disposed in the intersecting direction in the order of the first nozzle row for the first color, the second nozzle row for the second color, the second nozzle row for the first color, and the first nozzle row for the second color.

With such a printing apparatus, by forming raster lines formed with ink droplets ejected in different landing orders every other line, unevenness in color can be suppressed and effects of tilting of the head can be reduced.

A printing apparatus, wherein the nozzle row for one of the first color and the second color is a yellow ink nozzle row, and the nozzle row for the other color is a magenta ink nozzle row or a cyan ink nozzle row.

With such a printing apparatus, by forming dots with two colors of nozzle rows, and forming raster lines formed with ink droplets ejected in different landing orders every other line, unevenness in color can be suppressed.

A printing apparatus, wherein a dot is formed on the medium by superimposing an ink droplet of the first color and an ink droplet of the second color.

With such a printing apparatus, by forming dots with two colors of ink droplets, and forming raster lines formed with ink droplets ejected in different landing orders every other line, unevenness in color can be suppressed.

A printing apparatus, wherein bidirectional printing is performed by moving the print head bi-directionally in the intersecting direction.

With such a printing apparatus, by forming raster lines formed with ink droplets ejected in different landing orders every other line at high speed, unevenness in color can be suppressed and effects of tilting of the head can be reduced.

A printing apparatus, including a control section that causes to form a plurality of dot rows lined up on the medium, by causing to alternately repeat a dot forming process for forming a dot row on the medium by causing to eject ink droplets from a plurality of the nozzles of the print head that is moving, and a carrying process for carrying the medium, wherein the control section causes to form on the medium dot rows consecutively lined up in the carrying direction by performing the dot forming process once.

With such a printing apparatus, by forming raster lines made up of dots formed with ink droplets ejected in different landing orders every other line, with printing speed increased, unevenness in color can be suppressed.

A printing apparatus, wherein the print head includes a first nozzle row and a second nozzle row for a third color, a plurality of the nozzles of the first nozzle row for the first color and a plurality of nozzles of the first nozzle row for the third color are disposed in the same positions in terms of the carrying direction, a plurality of the nozzles of the second nozzle row for the first color and a plurality of nozzles of the second nozzle row for the third color are disposed in the same positions in terms of the carrying direction, and the nozzle rows are disposed in the intersecting direction in the order of the first nozzle row for the first color, the second nozzle row for the second color, the first nozzle row for the third color, the second nozzle row for the first color, the first nozzle row for the second color, and the second nozzle row for the third color.

With such a printing apparatus, by forming raster lines made up of dots formed with ink droplets ejected in different landing orders every other line, unevenness in color can be suppressed and effects of tilting of the head can be reduced.

A printing apparatus, wherein a plurality of the nozzles are lined up at predetermined intervals, and a plurality of the nozzles of the second nozzle rows for the respective colors are disposed shifted with respect to a plurality of the nozzles of the first nozzle rows for the respective colors in the carrying direction by a distance equivalent to half the predetermined interval.

With such a printing apparatus, raster lines made up of dots formed with ink droplets ejected in different landing orders can be formed every other line. As a result, unevenness in color can be suppressed.

A printing apparatus including:

a carry unit for carrying a medium in a carrying direction; and a print head that has a plurality of nozzle rows each made up of a plurality of nozzles for ejecting ink lined up in the carrying direction, and that moves in an intersecting direction intersecting the carrying direction, wherein the print head includes a first nozzle row and a second nozzle row for a first color, and a first nozzle row and a second nozzle row for a second color, a plurality of nozzles of the first nozzle row for the first color and a plurality of nozzles of the first nozzle row for the second color are disposed in the same positions in terms of the carrying direction, a plurality of nozzles of the second nozzle row for the first color and a plurality of nozzles of the second nozzle row for the second color are disposed in the same positions in terms of the carrying direction, a plurality of the nozzles of the second nozzle rows for the first color and the second color are respectively disposed shifted in the carrying direction with respect to a plurality of the nozzles of the corresponding first nozzle rows for the first color and the second color, and the nozzle rows are disposed in the intersecting direction in the order of the first nozzle row for the first color, the second nozzle row for the second color, the second nozzle row for the first color, and the first nozzle row for the second color, wherein the nozzle row for one of the first color and the second color is a yellow ink nozzle row, and the nozzle row for the other color is a magenta ink nozzle row or a cyan ink nozzle row, wherein a dot is formed on the medium by superimposing an ink droplet of the first color and an ink droplet of the second color, wherein bidirectional printing is performed by moving the print head bi-directionally in the intersecting direction, wherein a control section is provided that causes to form a plurality of dot rows lined up on the medium, by causing to alternately repeat a dot forming process for forming a dot row on the medium by causing to eject ink droplets from a plurality of the nozzles of the print head that is moving, and a carrying process for carrying the medium, and the control section causes to form on the medium dot rows consecutively lined up in the carrying direction by performing the dot forming process once, wherein the print head includes a first nozzle row and a second nozzle row for a third color, a plurality of the nozzles of the first nozzle row for the first color and a plurality of nozzles of the first nozzle row for the third color are disposed in the same positions in terms of the carrying direction, a plurality of the nozzles of the second nozzle row for the first color and a plurality of nozzles of the second nozzle row for the third color are disposed in the same positions in terms of the carrying direction, and the nozzle rows are disposed in the intersecting direction in the order of the first nozzle row for the first color, the second nozzle row for the second color, the first nozzle row for the third color, the second nozzle row for the first color, the first nozzle row for the second color, and the second nozzle row for the third color, and wherein a plurality of the nozzles are lined up at predetermined intervals, and a plurality of the nozzles of the second nozzle rows for the respective colors are disposed shifted with respect to a plurality of the nozzles of the first nozzle rows for the respective colors in the carrying direction by a distance equivalent to half the predetermined interval.

With such a printing apparatus, by forming raster lines made up of dots formed with ink droplets ejected in different landing orders every other line, unevenness in color can be suppressed and effects of tilting of the head can be reduced.

A printing apparatus, including:

a print head that has a yellow ink nozzle row for ejecting yellow ink, a magenta ink nozzle row for ejecting magenta ink, and a cyan ink nozzle row for ejecting cyan ink, each of the nozzle rows for the respective colors including a plurality of nozzles lined up in a predetermined direction at predetermined nozzle spacings; and a moving mechanism for relatively moving the positions of the print head and a medium in the predetermined direction, wherein a plurality of the nozzles of the yellow ink nozzle row are shifted in the predetermined direction with respect to the nozzles of the magenta ink nozzle row and the nozzles of the cyan ink nozzle row.

With such a printing apparatus, even when bidirectional printing is performed, printing can be performed in which occurrence of the unevenness in color caused by different landing orders of ink droplets of the respective colors is mitigated.

It is preferable that an amount by which a plurality of the nozzles of the yellow ink nozzle row are shifted with respect to a plurality of the nozzles of the magenta ink nozzle row and a plurality of the nozzles of the cyan ink nozzle row is an amount equivalent to half the predetermined nozzle spacing. It is also preferable that a plurality of the nozzles of the magenta ink nozzle row and a plurality of the nozzles of the cyan ink nozzle row are disposed in the same positions in terms of the predetermined direction. It is further preferable that the print head further includes a black ink nozzle row for ejecting black ink, and a plurality of the nozzles of the black ink nozzle row and a plurality of the nozzles of the yellow ink nozzle row are disposed in the same positions in terms of the predetermined direction. It is preferable that the print head is configured such that the black ink nozzle row and the cyan ink nozzle row are configured as one unit, the magenta ink nozzle row and the yellow ink nozzle row are configured as one unit, a plurality of the nozzles of the cyan ink nozzle row and a plurality of the nozzles of the magenta ink nozzle row are disposed in the same positions in terms of the predetermined direction, and a plurality of the nozzles of the black ink nozzle row and a plurality of the nozzles of the yellow ink nozzle row are disposed in the same positions in terms of the predetermined direction. Also, the print head may be configured such that the magenta ink nozzle row and the black ink nozzle row are configured as one unit, the cyan ink nozzle row and the yellow ink nozzle row are configured as one unit, a plurality of the nozzles of the cyan ink nozzle row and a plurality of the nozzles of the magenta ink nozzle row are disposed in the same positions in terms of the predetermined direction, and a plurality of the nozzles of the black ink nozzle row and a plurality of the nozzles of the yellow ink nozzle row are disposed in the same positions in terms of the predetermined direction. It is preferable that the moving mechanism is a carrying mechanism for carrying the medium in the predetermined direction, and a head moving mechanism for moving the print head in a direction intersecting the predetermined direction is further provided. Also, it is preferable that the yellow ink nozzle row, the magenta ink nozzle row and the cyan ink nozzle row have a common length, and after the head moving mechanism has moved the print head in a direction intersecting the predetermined direction, the carrying mechanism carries the medium by the common length. It is further preferable that the carrying mechanism moves the print head that ejects ink in a forward pass direction of the intersecting direction, the carrying mechanism carries the medium by the common length, and the carrying mechanism moves the print head in a return pass direction of the intersecting direction while letting the print head eject ink. Also, it is preferable that when the print head forms dots on the medium, dots of the yellow ink are formed shifted in the predetermined direction with respect to dots of the magenta ink and dots of the cyan ink. As a result, a printing apparatus can be provided with which even when bidirectional printing is performed, occurrence of the unevenness in color caused by different landing orders of ink droplets of various colors is mitigated.

Also, a printing method is provided, including:

while forming dots on a medium by ejecting ink droplets respectively from a yellow ink nozzle row for ejecting yellow ink, a magenta ink nozzle row for ejecting magenta ink, and a cyan ink nozzle row for ejecting cyan ink, relatively moving the positions of the medium and the nozzle rows for the respective colors in a direction intersecting the nozzle rows for the respective colors, and relatively moving the positions of the medium and the nozzle rows for the respective colors in a direction of the nozzle rows for the respective colors, wherein dots of the yellow ink are formed on the medium shifted in the nozzle row direction with respect to dots of the magenta ink and dots of the cyan ink.

With such a printing method, even when bidirectional printing is performed, occurrence of the unevenness in color caused by different landing orders of ink droplets of various colors can be mitigated.

(1) First Embodiment

(1) Configuration of the Printing System

An embodiment of a printing system (computer system) is described next with reference to the drawings. However, the description of the following embodiment also encompasses implementations relating to a computer program and a recording medium storing the computer program, for example.

FIG. 1 is an explanatory diagram showing the external structure of the printing system. A printing system 100 is provided with a printer 1, a computer 110, a display device 120, an input device 130, and a recording and reproducing device 140. The printer 1 is a printing apparatus for printing images on a medium such as paper, cloth, or film. The computer 110 is electrically connected to the printer 1, and outputs print data corresponding to an image to be printed to the printer 1 in order to print the image with the printer 1. The display device 120 has a display, and displays a user interface of an application program or a printer driver, etc. The input device 130 is, for example, a keyboard 130A and a mouse 130B, and are used to operate an application program or adjust the settings of the printer driver, for example, in accordance with the user interface that is displayed on the display device 120. A flexible disk drive device 140A and a CD-ROM drive device 140B for example are employed as the recording and reproducing device 140.

A printer driver is installed on the computer 110. The printer driver is a program for achieving the function of displaying the user interface on the display device 120, as well as achieving the function of converting image data that has been output from the application program into print data. The printer driver is stored on a recording medium (computer-readable recording medium) such as a flexible disk FD or a CD-ROM. The printer driver also can be downloaded onto the computer 110 via the Internet. It should be noted that this program is made of codes for achieving various functions.

It should be noted that "printing apparatus" in a narrow sense means the printer 1, but in a broader sense it means the system constituted by the printer 1 and the computer 110.

(1) Printer Driver

Regarding the Printer Driver

Figure 2:
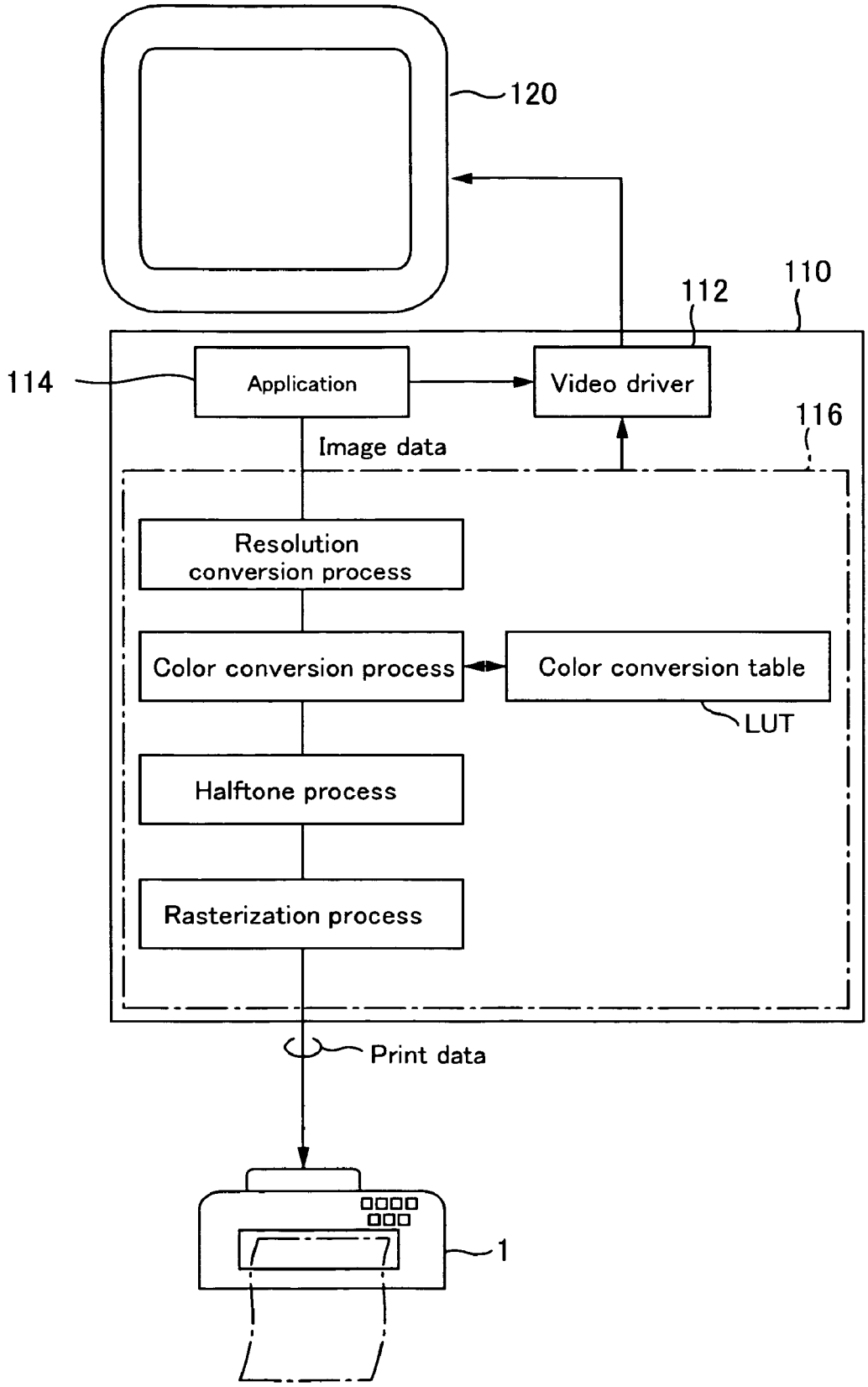
FIG. 2 is an explanatory diagram of basic processes carried out by a printer driver.

FIG. 2 is a schematic explanatory diagram of basic processes carried out by the printer driver. Structural elements that have already been described are assigned identical reference numerals and thus their further description is omitted.

On the computer 110, computer programs such as a video driver 112, an application program 114, and a printer driver 116 operate under an operating system installed on the computer. The video driver 112, for example, has a function of displaying the user interface or the like on the display device 120 in accordance with display commands from the application program 114 and the printer driver 116. The application program 114, for example, has a function of performing image editing or the like and creates data related to an image (image data). A user can give an instruction to print an image edited by the application program 114 via the user interface of the application program 114. Upon receiving the print instruction, the application program 114 outputs the image data to the printer driver 116.

The printer driver 116 receives the image data from the application program 114, converts the image data to print data, and outputs the print data to the printer. Here, "print data" refers to data in a format that can be interpreted by the printer 1 and that includes various types of command data and pixel data. Here, "command data" refers to data for instructing the printer to carry out a specific operation. Furthermore, "pixel data" refers to data related to pixels that constitute an image to be printed (print image), for example, data related to dots to be formed in positions on the paper corresponding to certain pixels (data for dot color and size, for example).

In order to convert the image data that is output from the application program 114 to print data, the printer driver 116 carries out processes such as resolution conversion process, color conversion process, halftone process, and rasterization process. The following is a description of the various processes carried out by the printer driver 116.

Resolution conversion process is a process in which image data (text data, image data, etc.) output from the application program 114 is converted to image data with a resolution for printing on paper. For example, when the resolution for printing an image on paper is specified as 720×720 dpi, then the image data received from the application program 114 is converted to image data with a resolution of 720×720 dpi. It should be noted that, after the resolution conversion process, the image data is multi-gradation RGB data (for example, 256 gradations) that is expressed in RGB color space. Hereinafter, RGB data obtained by subjecting image data to the resolution conversion process is referred to as the "RGB image data."

Color conversion process is a process in which the RGB data is converted to CMYK data that is expressed in CMYK color space. It should be noted that CMYK data is data that corresponds to the ink colors of the printer. The color conversion process is carried out by the printer driver 116 referencing a table (a color conversion look-up table LUT) in which gradation values of RGB image data are associated with gradation values of CMYK image data. By this color conversion process, RGB data for the pixels is converted to CMYK data that corresponds to ink colors. It should be noted that, after the color conversion process, data is CMYK data with 256 gradations expressed in CMYK color space. Hereinafter, CMYK data obtained by subjecting RGB image data to the color conversion process is referred to as the "CMYK image data."

Halftone process is a process in which data of a high number of gradations is converted to data of a number of gradations that can be formed by the printer. For example, by the halftone process, data expressing 256 gradations is converted to 1-bit data expressing two gradations or 2-bit data expressing four gradations. In the halftone process, pixel data is created such that the printer can form dots in a dispersed manner using methods such as dithering, gamma correction, and error diffusion. In carrying out the halftone process, the printer driver 116 references a dither table when performing dithering, references a gamma table when performing gamma correction, and references an error memory for storing diffused error when performing error diffusion. Halftone processed data has a resolution (for example, 360×360 dpi) equivalent to the above-mentioned RGB data. Halftone processed image data is constituted by, for example, 1-bit or 2-bit pixel data for each pixel.

Rasterization process is a process in which image data in a matrix form is rearranged in an order suitable for transfer to the printer. Rasterized data is output to the printer as pixel data contained in print data.

Regarding the Settings of the Printer Driver

Figure 3:
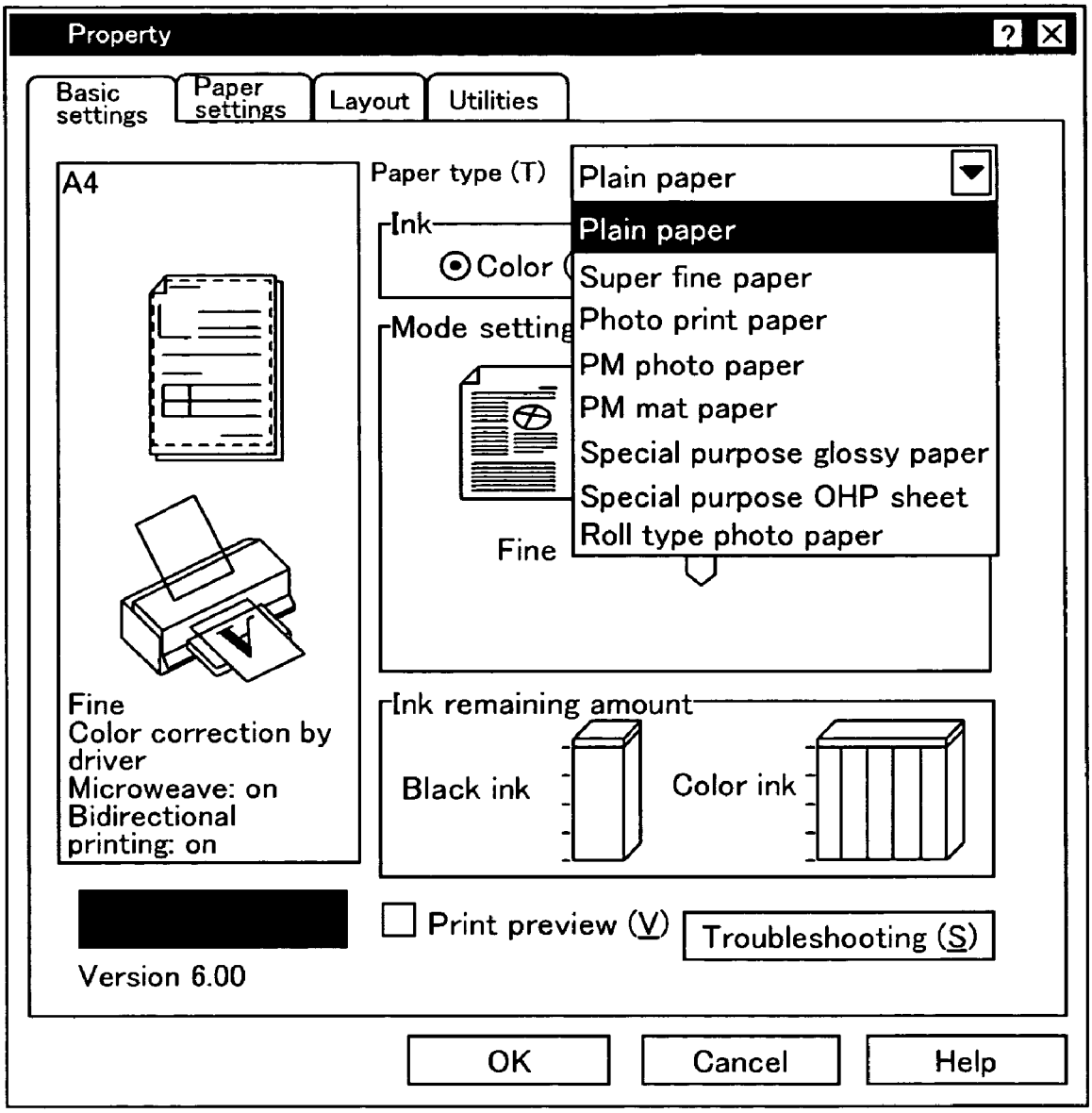
FIG. 3 is an explanatory diagram of a user interface of the printer driver.

FIG. 3 is an explanatory diagram of a user interface of the printer driver. The user interface of the printer driver is displayed on a display device via the video driver 112. The user can use the input device 130 to change the various settings of the printer driver.

The user can select the print mode from this screen. For example, the user can select as the print mode a quick print mode or a fine print mode. The printer driver then converts image data to print data such that the data is in a format corresponding to the selected print mode.

Furthermore, from this screen, the user can select the print resolution (the dot spacing when printing). For example, the user can select from this screen 720 dpi or 360 dpi as the print resolution. The printer driver then carries out the resolution conversion process in accordance with the selected resolution and converts image data to print data.

Furthermore, from this screen, the user can select the print paper to be used for printing. For example, the user can select plain paper or glossy paper as the print paper. Since the way ink is absorbed and the way ink dries vary if the type of paper (paper type) varies, the amount of ink suitable for printing also varies. For this reason, the printer driver converts image data to print data in accordance with the selected paper type.

In this way, the printer driver converts image data to print data in accordance with conditions that are set via the user interface. It should be noted that, in addition to performing various settings of the printer driver, the user can also be notified, through this screen, of such information as the amount of ink remaining in the cartridges.

(1) Configuration of the Printer

Regarding the Configuration of the Inkjet Printer

Figure 4:
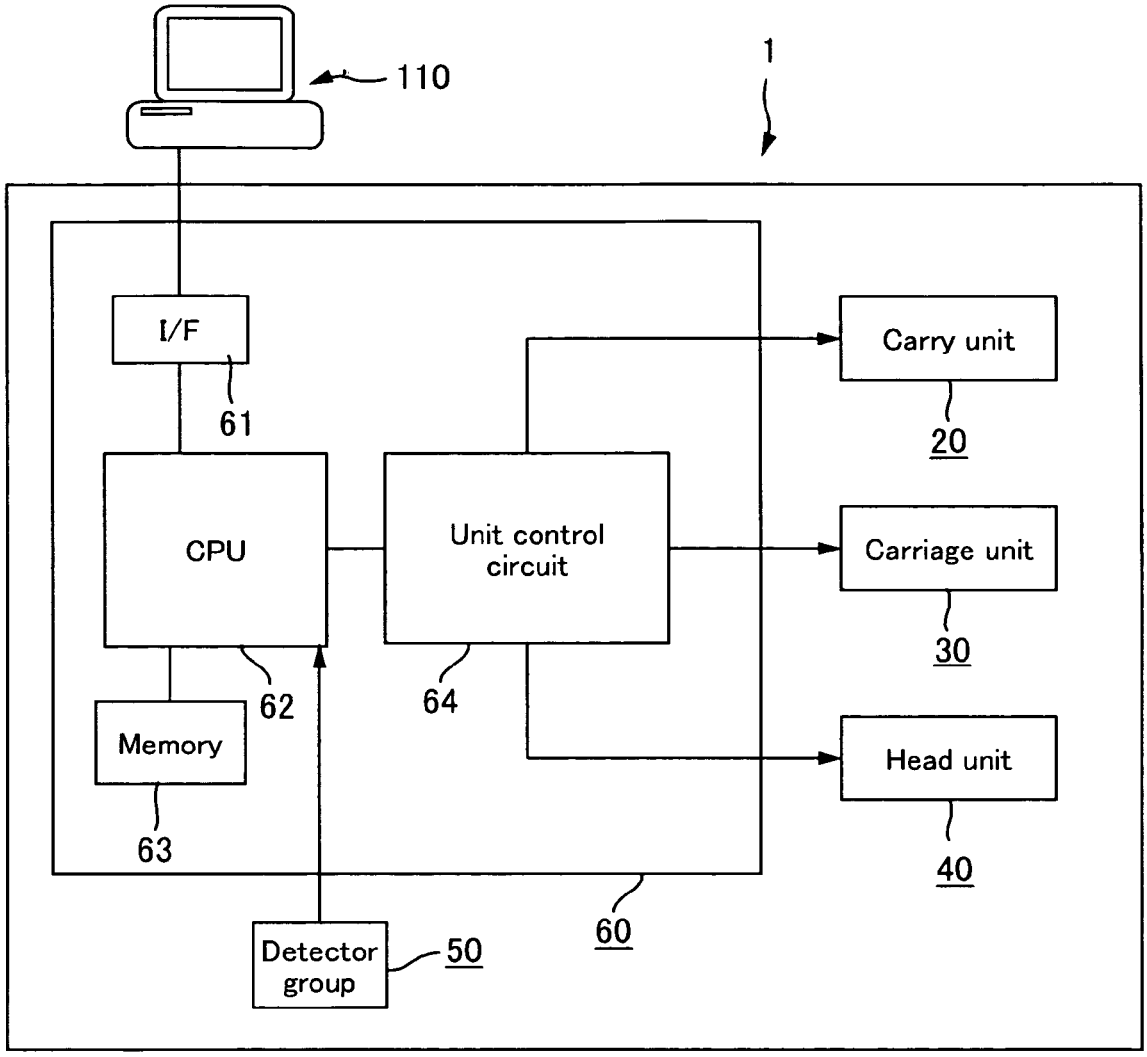
FIG. 4 is a block diagram of the overall configuration of a printer.
Figure 5:
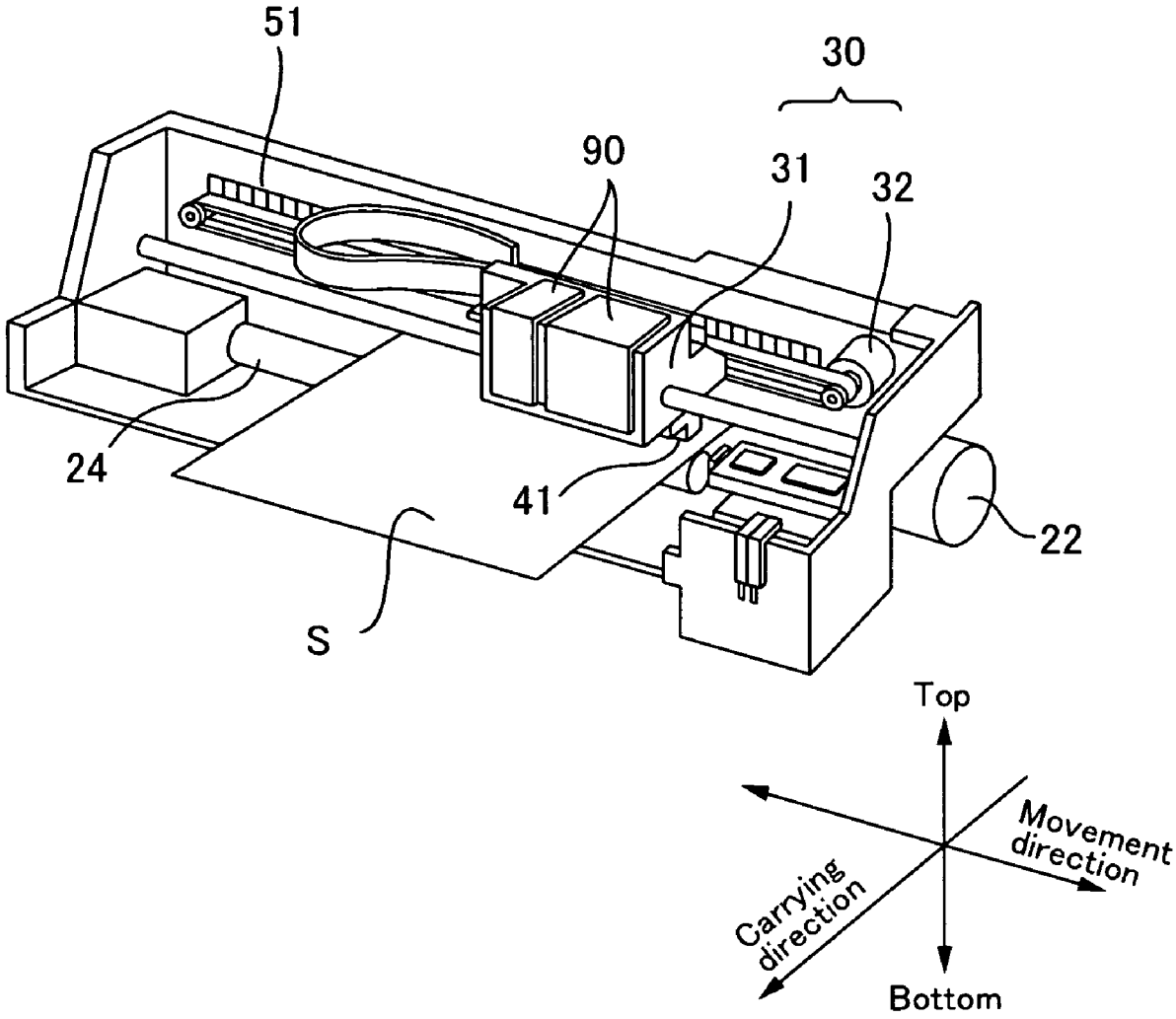
FIG. 5 is a schematic view of the overall configuration of the printer.
Figure 6:
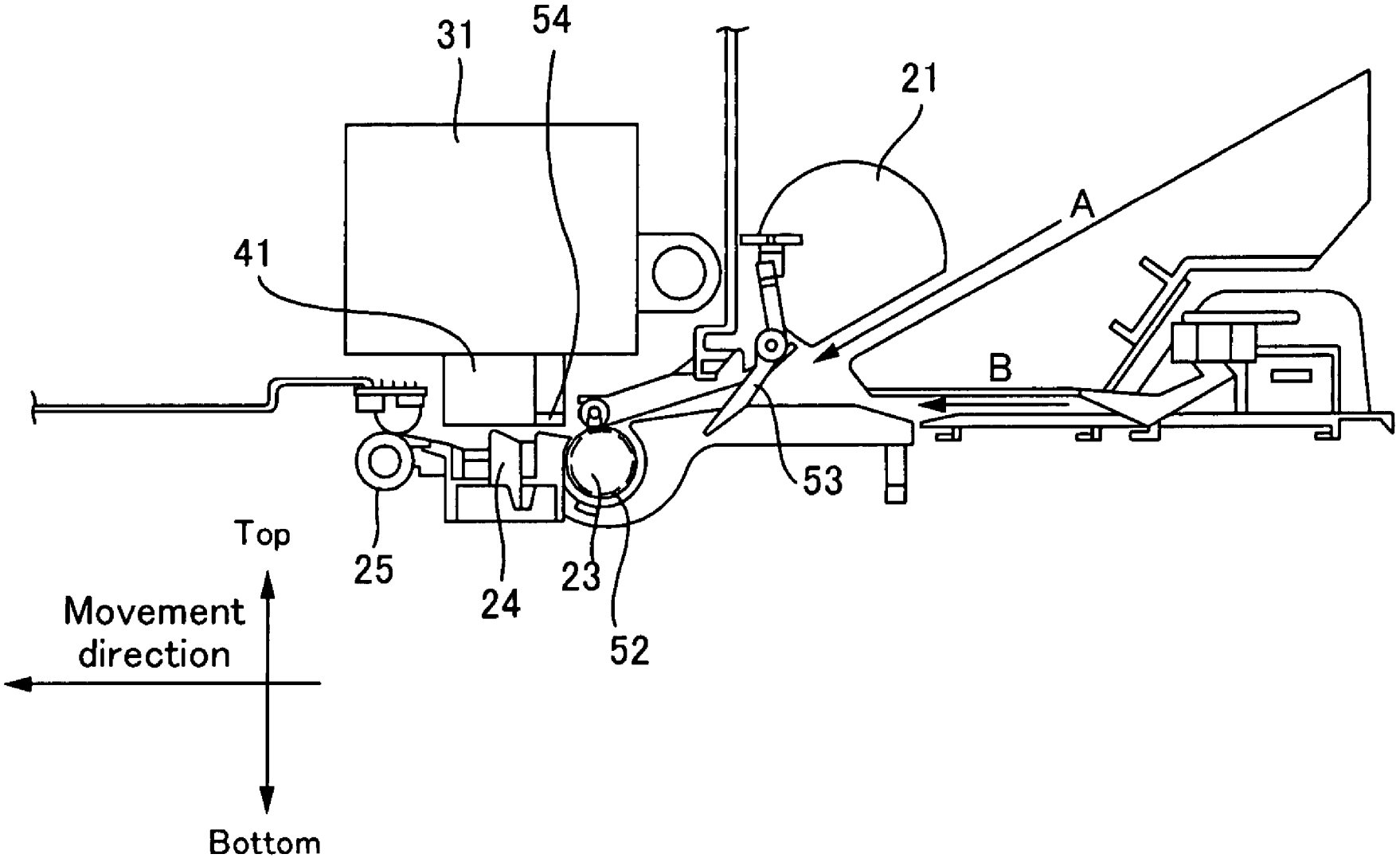
FIG. 6 is a transverse cross-sectional view of the overall configuration of the printer.

FIG. 4 is a block diagram of the overall configuration of a printer of the first embodiment. FIG. 5 is a schematic view of the overall configuration of the printer of the first embodiment. FIG. 6 is a transverse cross-sectional view of the overall configuration of the printer of the first embodiment. The basic configuration of the printer of the first embodiment is described below.

The printer of the first embodiment has a carry unit 20, a carriage unit 30, a head unit 40, a detector group 50, and a controller 60. The printer 1, which receives print data from the computer 110, which is an external device, controls the various units (the carry unit 20, the carriage unit 30, and the head unit 40) using the controller 60. The controller 60 controls the units in accordance with the print data that has been received from the computer 110 to form an image on paper. The detector group 50 monitors the conditions within the printer 1, and outputs the results of this detection to the controller 60. The controller 60 receives the detection results from the detector group 50, and controls the units based on these detection results.

The carry unit 20 is for feeding a medium (for example, paper S) into a printable position and carrying the paper in a predetermined direction (hereinafter, referred to as the "carrying direction") by a predetermined carry amount during printing. In other words, the carry unit 20 functions as a carrying mechanism (a carrying means) for carrying paper. The carry unit 20 has a paper-supply roller 21, a carry motor 22 (also referred to as the "PF motor"), a carrying roller 23, a platen 24, and a paper-discharge roller 25. However, the carry unit 20 does not necessarily have to include all of these structural elements in order to function as a carrying mechanism. The paper-supply roller 21 is a roller for automatically supplying paper that has been inserted into a paper insert opening into the printer. The paper-supply roller 21 has a cross-sectional shape in the shape of a letter D, and the length of its circumference section is set longer than the carrying distance to the carrying roller 23, so that the paper can be carried up to the carrying roller 23 using this circumference section. The carry motor 22 is a motor for carrying paper in the carrying direction, and is constituted by a DC motor. The carrying roller 23 is a roller for carrying the paper S that has been supplied by the paper-supply roller 21 up to a printable region, and is driven by the carry motor 22. The platen 24 supports the paper S on which printing is being performed. The paper-discharge roller 25 is a roller for discharging the paper S on which printing has finished out of the printer. The paper-discharge roller 25 is rotated in synchronization with the carrying roller 23.

The carriage unit 30 is for making the head move (also referred to as "scan") in a predetermined direction (hereinafter, referred to as the "movement direction"). The carriage unit 30 has a carriage 31 and a carriage motor 32 (also referred to as the "CR motor"). The carriage 31 can be moved back and forth in the movement direction (thus, the head is moved in the movement direction). The carriage 31 detachably holds an ink cartridge that contains ink. The carriage motor 32 is a motor for moving the carriage 31 in the movement direction, and is constituted by a DC motor.

The head unit 40 is for ejecting ink onto paper. The head unit 40 has a head 41. The head 41 has a plurality of nozzles serving as ink ejection sections and ejects ink intermittently from these nozzles. The head 41 is provided on the carriage 31. Thus, when the carriage 31 moves in the movement direction, the head 41 also moves in the movement direction. Dot lines (raster lines) are formed on paper in the movement direction as a result of the head 41 intermittently ejecting ink while moving in the movement direction.

The detector group 50 includes a linear encoder 51, a rotary encoder 52, a paper detection sensor 53, and an optical sensor 54, for example. The linear encoder 51 is for detecting the position of the carriage 31 in the movement direction. The rotary encoder 52 is for detecting the amount of rotation of the carrying roller 23. The paper detection sensor 53 is for detecting the position of the front end of the paper to be printed. The paper detection sensor 53 is provided in a position where it can detect the position of the front end of the paper as the paper is being fed toward the carrying roller 23 by the paper-supply roller 21. It should be noted that the paper detection sensor 53 is a mechanical sensor that detects the front end of the paper through a mechanical mechanism. More specifically, the paper detection sensor 53 has a lever that can be rotated in the carrying direction, and this lever is disposed such that it protrudes into the path over which the paper is carried. In this way, the front end of the paper comes into contact with the lever and the lever is rotated, and thus the paper detection sensor 53 detects the position of the front end of the paper by detecting the movement of the lever. The optical sensor 54 is attached to the carriage 31. The optical sensor 54 detects whether or not the paper is present by a light-receiving section detecting reflected light of the light that has been emitted onto the paper from a light-emitting section. The optical sensor 54 detects the position of the end of the paper while being moved by the carriage 31. The optical sensor 54 optically detects the end of the paper, and thus has higher detection accuracy than the mechanical paper detection sensor 53.

The controller 60 is a control unit (controlling means) for carrying out control of the printer. The controller 60 has an interface section 61, a CPU 62, a memory 63, and a unit control circuit 64. The interface section 61 is for exchanging data between the computer 110, which is an external device, and the printer 1. The CPU 62 is a computation processing device for performing the overall control of the printer. The memory 63 is for ensuring a region for storing the programs for the CPU 62 and a working region, for instance, and includes storage means such as a RAM or an EEPROM. The CPU 62 controls the various units via the unit control circuit 64 in accordance with programs stored in the memory 63.

Regarding the Printing Operation

Figure 7:
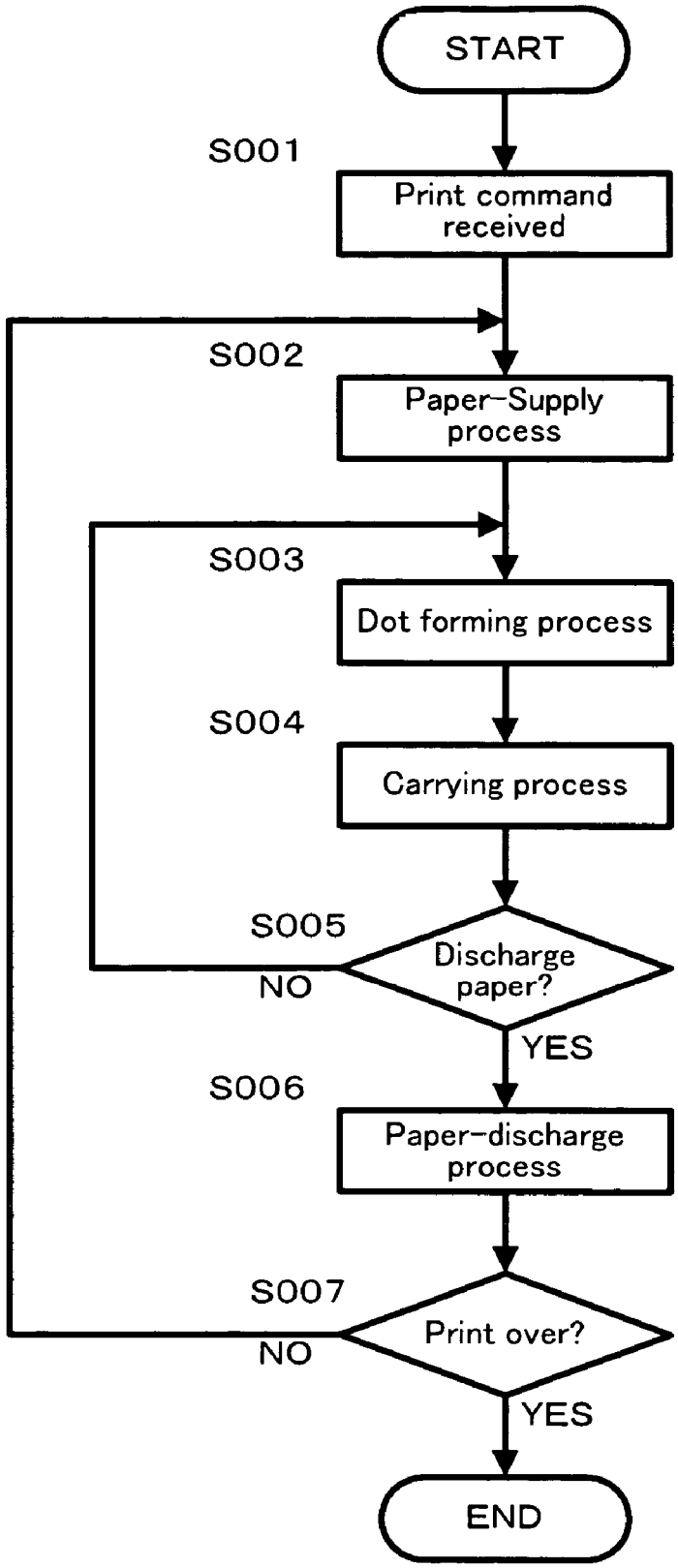
FIG. 7 is a flowchart of processing during printing.

FIG. 7 is a flowchart of the processing during printing. The processes described below are executed by the controller 60 controlling the various units in accordance with a program stored in the memory 63. This program includes codes for executing the various processes.

Receive Print Command (S001): First, the controller 60 receives a print command from the computer 110 via the interface section 61. This print command is included in the header of the print data transmitted from the computer 110. The controller 60 then analyzes the content of the various commands included in the received print data and uses the various units to perform the following paper-supply process, carrying process, and dot forming process, for example.

Paper-Supply Process (S002): The paper-supply process is a process for supplying paper to be printed on into the printer and positioning the paper at a print start position (also referred to as the "indexing position"). The controller 60 rotates the paper-supply roller 21 and feeds the paper to be printed on to the carrying roller 23. The controller 60 rotates the carrying roller 23 to position the paper fed by the paper-supply roller 21 at the print start position. When the paper has been positioned at the print start position, at least some of the nozzles of the head 41 are in opposition to the paper.

Dot Forming Process (S003): The dot forming process is a process for causing ink to be intermittently ejected from the head that moves along the movement direction so as to form dots on the paper. The controller 60 drives the carriage motor 32 to move the carriage 31 in the movement direction. Then, the controller 60 causes ink to be ejected from the head in accordance with print data while the carriage 31 is moving. Dots are formed on the paper when ink droplets ejected from the head land on the paper. Since ink is intermittently ejected from the moving head, a dot row made up of a plurality of dots arranged along the movement direction is formed on the paper.

Carrying Process (S004): The carrying process is a process for moving the paper relatively along the carrying direction with respect to the head. The controller 60 drives the carry motor to rotate the carrying roller, and thereby carries the paper in the carrying direction. Through this carrying process, the head 41 can form dots during a dot forming process at positions that are different from the positions of the dots formed in the preceding dot forming process.

Paper-Discharge Determination (S005): The controller 60 determines whether or not to discharge the paper being printed. The paper is not discharged if there still remains data to print to the paper being printed. The controller 60 alternately repeats the dot forming process and the carrying process until there is no longer data to be printed, thereby gradually printing an image made of dots on the paper.

Paper-Discharge Process (S006): When there is no longer data to print to the paper being printed, the controller 60 discharges that paper by rotating the paper-discharge roller. It should be noted that whether or not to discharge the paper can also be determined based on a paper discharge command included in the print data.

Print Over Determination (S007): Next, the controller 60 determines whether or not to continue printing. If the next sheet of paper is to be printed on, then printing is continued and the paper-supply process for the next sheet of paper is started. If no further sheet of paper is to be printed on, then the printing operation is ended.

(1) Printing Method of the Reference Examples

Regarding the Nozzle Row Arrangement of the Reference Example 1

Figure 8:
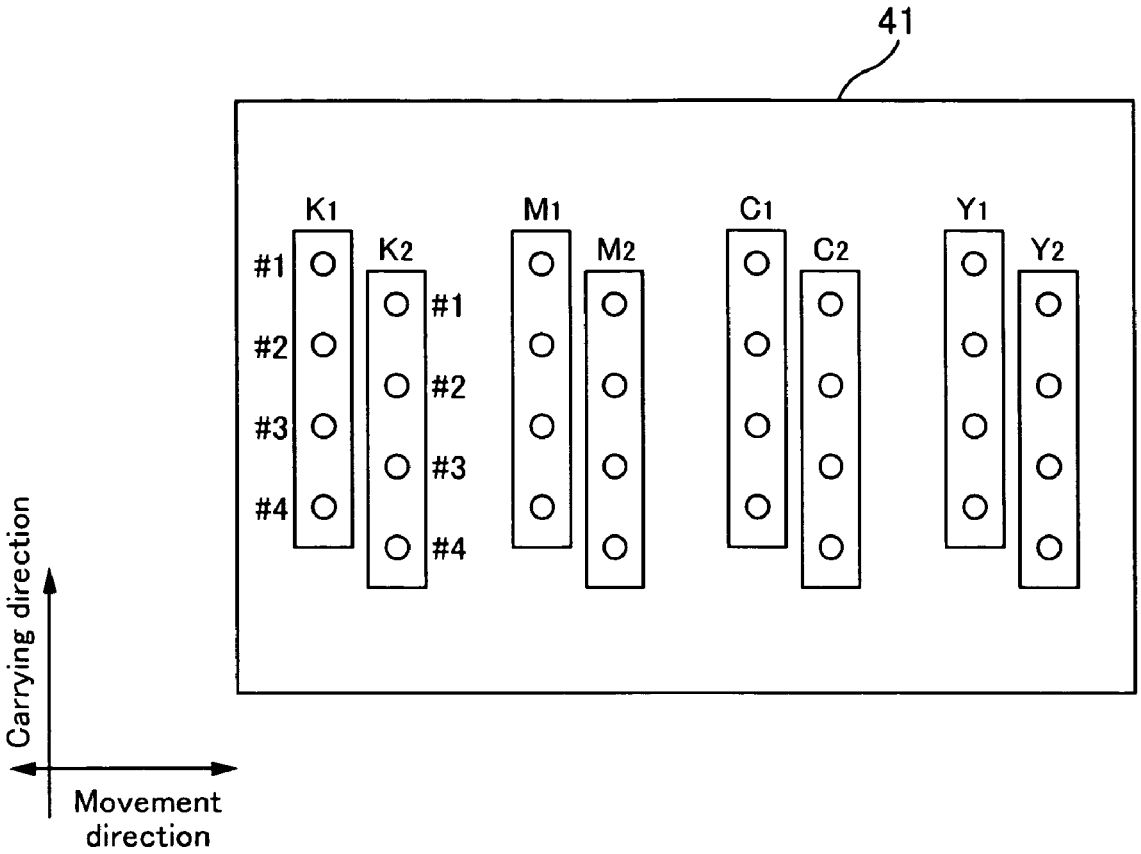
FIG. 8 is a perspective view of a prior nozzle row arrangement.

FIG. 8 is a perspective view showing the nozzle row arrangement in the lower surface of a head of a reference example.

FIG. 8 is a diagram showing the lower surface of the head 41 that opposes paper S as viewed from the back side. When the head 41 is viewed directly from the lower surface side thereof, the nozzle row arrangement is opposite to that shown in FIG. 8. In this perspective view, from the left side of the head 41, black ink nozzle rows $K_1$ and $K_2$, magenta ink nozzle rows $M_1$ and $M_2$, cyan ink nozzle rows $C_1$ and $C_2$, and yellow ink nozzle rows $Y_1$, and $Y_2$ are provided, i.e., two rows for each color.

Each nozzle row is provided with a plurality of nozzles (for example, 180 nozzles), which are ejection openings for ejecting respective color inks. For the sake of convenience of description, only four nozzles are shown for each nozzle in FIG. 8.

A plurality of nozzles of each nozzle row are lined up at constant spacings (nozzle pitch: k·D) along the carrying direction. Here "D" is the minimum dot pitch in the carrying direction (that is, the spacing at the maximum resolution of dots formed on the paper S). Also, k is an integer of 1 or more. For example, if the nozzle pitch is 180 dpi (1/180 inch) and the dot pitch in the carrying direction is 360 dpi (1/360 inch), then k=2.

The nozzles of each nozzle row are each assigned numbers (#1 to #180) that become smaller the more downstream the nozzle is. Each nozzle is provided with a piezo element (not shown) as a drive element for driving the nozzle and letting it eject ink droplets.

As shown in FIG. 8, the nozzles #1 to #4 of the black ink nozzle row $K_1$, and those of the black ink nozzle row $K_2$ are disposed mutually shifted in the carrying direction of the paper S. In other words, the nozzles #1 to #4 of the black ink nozzle row $K_2$ are shifted downward by a distance equivalent to half the nozzle pitch with respect to the nozzles #1 to #4 of the black ink nozzle row $K_1$. The magenta ink nozzle row $M_1$ is disposed next to the black ink nozzle row $K_2$. The nozzles #1 to #4 of the magenta ink nozzle row $M_1$ are shifted upward by a distance equivalent to half the nozzle pitch with respect to the nozzles #1 to #4 of the black ink nozzle row $K_2$. In this way, the nozzle rows are disposed in a zigzag form with the nozzle rows alternately shifted upward or downward in the carrying direction.

Regarding the Band Printing

Figure 9A:
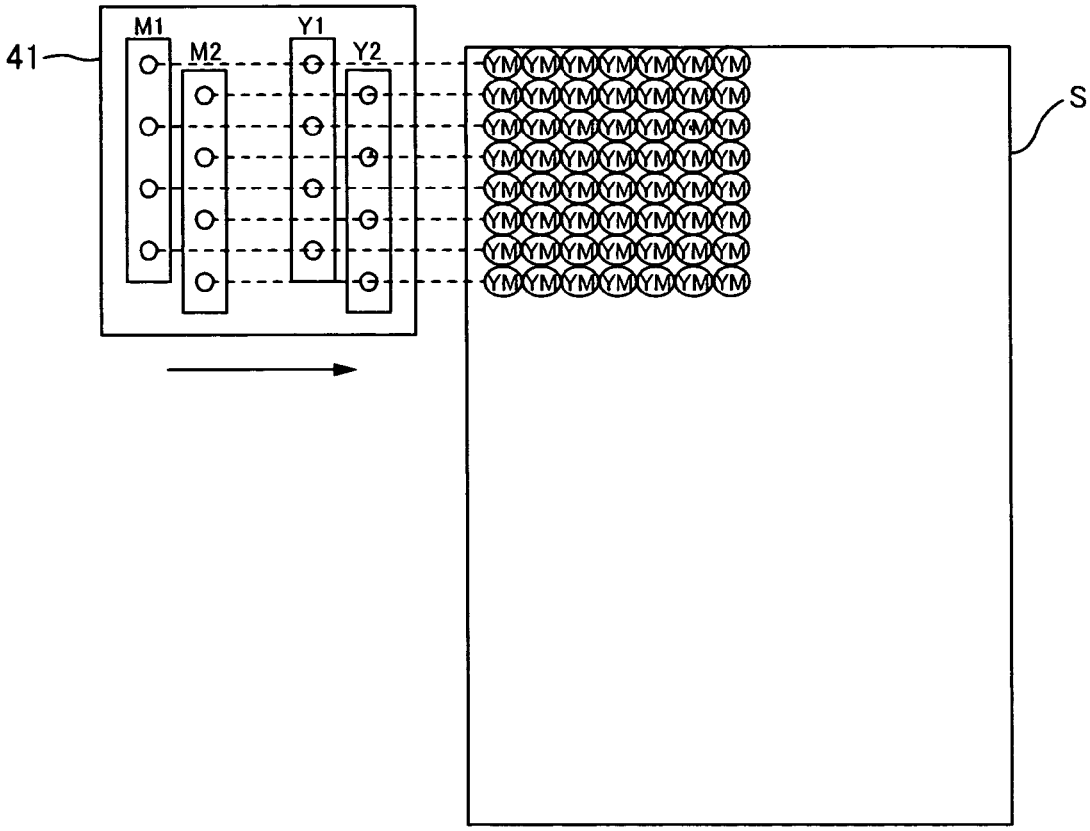
FIG. 9A is an explanatory diagram of band printing, showing the position of a head (or nozzles) and a state of dot formation during a single pass.
Figure 9B:
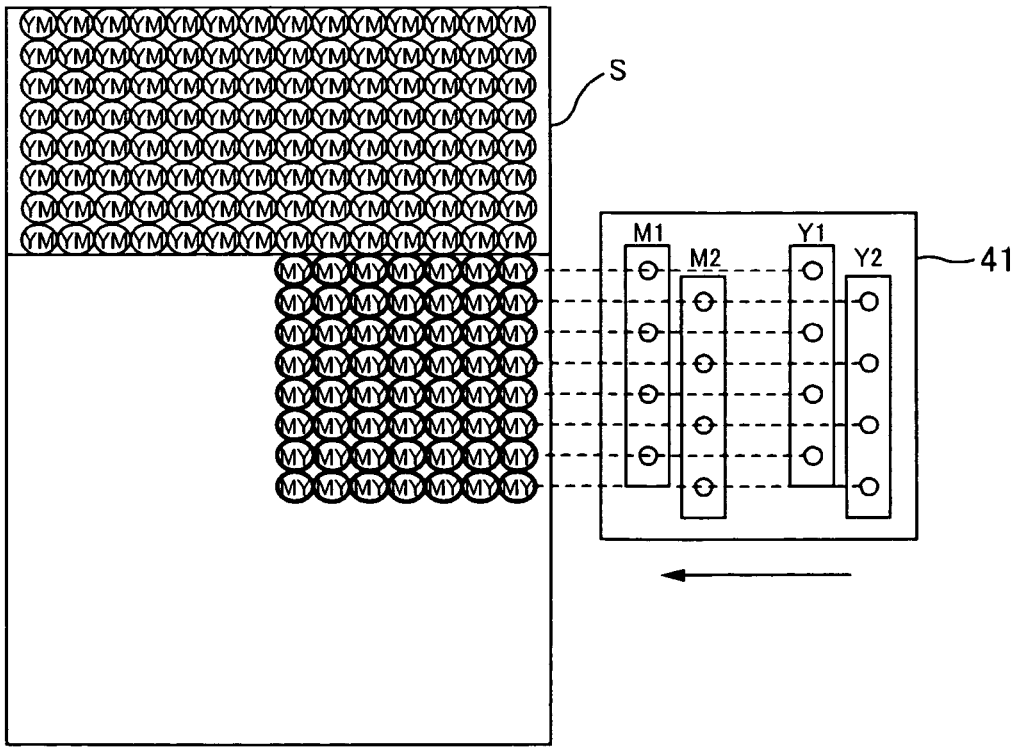
FIG. 9B is an explanatory diagram of band printing, showing the position of the head and a state of dot formation during the subsequent pass.

FIG. 9A and FIG. 9B are explanatory diagrams of band printing. FIG. 9A shows the position of the head (and nozzles) and a state of dot formation during a single pass. FIG. 9B shows the positions of the head and a state of dot formation during the subsequent pass.

For the purpose of description, only nozzle rows for two colors (magenta nozzle row M and yellow nozzle row Y) of a plurality of nozzle rows are shown, and also the number of nozzles of each nozzle row is reduced (four nozzles in this case). Further, for the purpose of description, the nozzles are shown as if forming only a few dots (circles in FIGS. 9A and 9B), but in practice, ink droplets are intermittently ejected from the nozzles that are moving in the movement direction, and thus many dots are formed side by side in the movement direction. These rows of dots may also be called raster lines.

"Band printing" performed in FIGS. 9A and 9B refers to a printing method in which consecutive raster lines are formed during a single pass. That is, in band printing, a band-shaped image fragment of the nozzle length is formed during a single pass. In the carrying operation that is performed between the passes, paper is carried by the nozzle length (in this case, 8D). By alternately repeating the pass and the carrying operation, the band-shaped image fragments are joined to one another in the carrying direction to form the print image. Note that "pass" is a process for forming dots by ejecting ink from moving nozzles (dot forming process).

In the band printing, the dot spacing D in the carrying direction is the same as the nozzle pitch, and in the first embodiment is 180 dpi. It should be noted that if the number of nozzles is 180, then the carry amount is 180D.

As shown in FIG. 9A, the head 41 moves from the left side to the right side of FIG. 9A during the first pass. In this case, dots of a secondary color are formed with magenta ink and yellow ink. Due to the nozzle row arrangement, the nozzles #1 to #4 of the yellow ink nozzle rows $Y_1$ and $Y_2$ eject ink first, and after that the nozzles #1 to #4 of the magenta ink nozzle rows $M_1$ and $M_2$ eject ink. A yellow ink droplet Y lands on paper first and then a magenta ink droplet M lands on the paper as overlapping the yellow ink droplet Y, thereby forming a dot YM. Eight raster lines are formed during the first pass. Dots indicated with a thin line (YM) represent dots formed by a light yellow ink droplet (Y) landing first. Although only initial several dots of a raster line to be formed are indicated in FIG. 9A, a raster line of the paper width is formed with dots at the end of the first pass.

As shown in FIG. 9B, the head 41 moves from the right side to the left side of FIG. 9B during the second pass. Due to the nozzle row arrangement, the nozzles #1 to #4 of the magenta ink nozzle rows $M_1$ and $M_2$ eject ink first, and after that the nozzles #1 to #4 of the yellow ink nozzle rows $Y_1$ and $Y_2$ eject ink. A magenta ink droplet M lands on paper first and then a yellow ink droplet Y lands on the paper as overlapping the magenta ink droplet M, thereby forming a dot MY. Eight raster lines are formed during the second pass. Dots indicated with a thick line (MY) represent dots formed by a dark magenta ink droplet (M) landing first.

As described above, when a dot is formed with two or more colors of ink, the order in which ink is ejected and lands on paper is reversed between the first pass and the second pass.

Regarding the Effects of Color Inversion that Occurs in the Band Printing

Figure 10A:
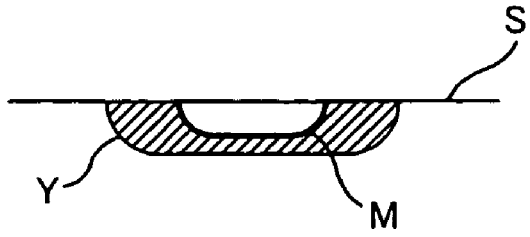
FIG. 10A is an explanatory diagram showing a state in which a dot of a secondary color is formed with two colors of ink droplets, and is also a cross-sectional view showing a state in which a dot of a secondary color is formed with two colors of ink droplets.
Figure 10B:
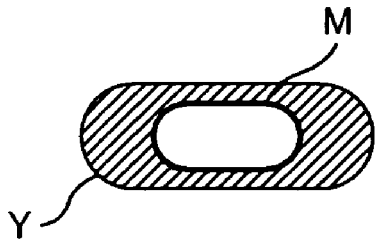
FIG. 10B is an explanatory diagram showing a state in which a dot of a secondary color is formed with two colors of ink droplets, and is also a plan view showing a state in which a dot of a secondary color is formed with two colors of ink droplets.

FIG. 10A is a cross-sectional view showing a state in which a dot of a secondary color is formed with two colors of ink droplets. FIG. 10B is a plan view showing a state in which a dot of a secondary color is formed with two colors of ink droplets.

As described above, when a dot is formed with two colors of ink, the landing order of inks may differ between a pass in the forward pass printing and a pass in the return pass printing. This brings following effects.

As shown in FIG. 10A, the yellow ink droplet Y that lands on paper S first spreads over a large area of the paper S to be soaked by the paper S. The magenta ink droplet M that lands on the paper S next is soaked by the paper S with overlapping at least part of the yellow ink droplet Y, and does not spread as widely as the yellow ink droplet Y (see FIG. 10B). Therefore, the color of the ink droplet that lands first is developed more conspicuously than the ink droplet that lands subsequently. Accordingly, the yellow ink droplet Y is developed more conspicuously than the magenta ink droplet M. In this way, the color appearance of dots tends to vary depending on the landing order of inks.

Particularly, with respect to the red dot MY (or YM) that is formed with the magenta ink droplet M and the yellow ink droplet Y, difference in the color density between magenta ink (dark color) and yellow ink (light color) is large, and therefore the color of the ink droplet that lands first is developed conspicuously. Consequently, color inversion is likely for the color red. In a similar manner, with respect to the green dot CY (or YC) that is formed with the cyan ink droplet C and the yellow ink droplet Y, difference in the color density between cyan ink (dark color) and yellow ink (light color) is large, and therefore the color of the ink droplet that lands first is developed conspicuously. Consequently, the color inversion is likely to happen for the color green.

As shown in FIG. 9B, when the band printing is performed in bidirectional printing mode, the landing order of ink droplets differs between a dot (YM) of a raster line formed during a pass in the forward pass printing and a dot (MY) of a raster line formed during a pass in the return pass printing, and consequently, the color appearance of these dots varies between a pass in the forward pass printing and a pass in the return pass printing. As a result, band-shaped unevenness in color occurs.

Regarding the Nozzle Row Arrangement of the Reference Example 2

Figure 11A:
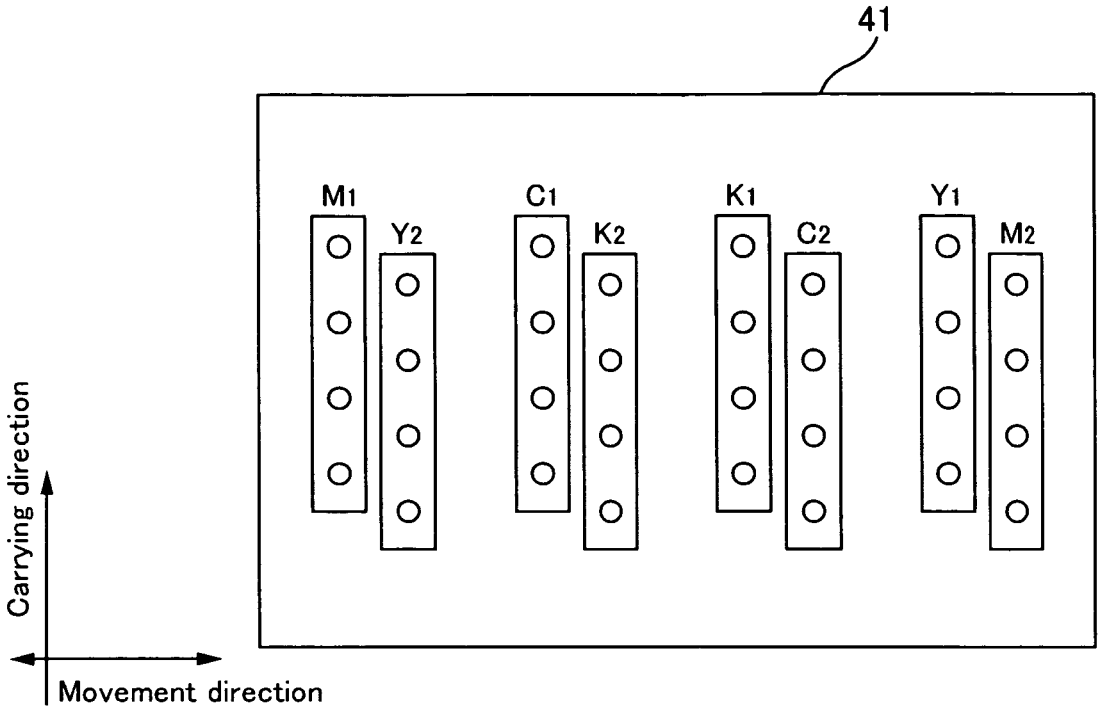
FIG. 11A is a perspective view of another prior nozzle row arrangement.
Figure 11B:
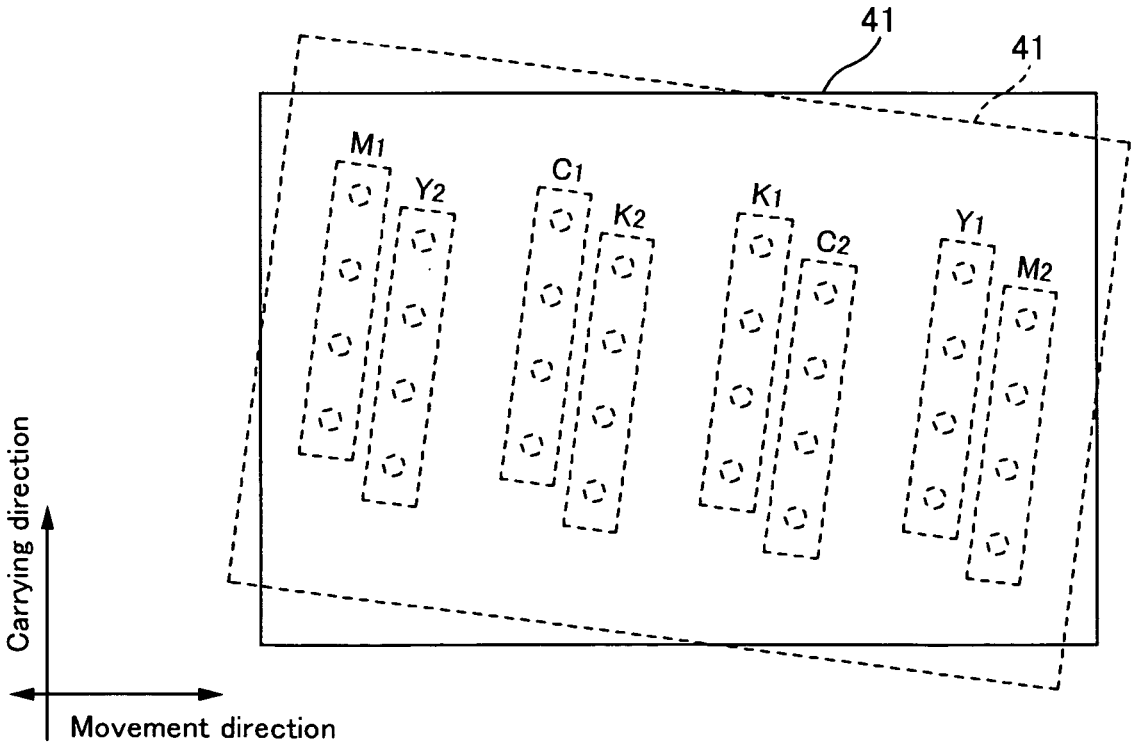
FIG. 11B is a perspective view showing with a dotted line a head that is tilted with a direction perpendicular to a movement direction and a carrying direction as an axis.

FIG. 11A is a perspective view of another prior nozzle row arrangement in the lower surface of the head. FIG. 11B is a perspective view showing with a dotted line the head that is tilted with the directions perpendicular to the movement direction and the carrying direction as axes.

As shown in FIG. 11A, the nozzle rows of respective colors are disposed in the opposite positions on the right and left sides. In FIG. 11A, nozzle rows are disposed in the following order from the left: magenta ink nozzle row $M_1$, yellow ink nozzle row $Y_2$, cyan ink nozzle row $C_1$, black ink nozzle row $K_2$, black ink nozzle row $K_1$, cyan ink nozzle row $C_2$, yellow ink nozzle row $Y_1$ and magenta ink nozzle row $M_2$.

Regarding the Effects of Tilting of the Head that Occurs in the Band Printing

Nozzle rows disposed in the central area of the head are less subject to the effects of tilting of the head. On the other hand, nozzle rows disposed in the side-end areas of the head are subject to the effects of tilting of the head.

In FIG. 11B, the head 41 shown with a dotted line is tilted with the directions perpendicular to the movement direction and the carrying direction (the direction perpendicular to the paper surface) as axes. In this case, the head 41 is tilted rightward with the direction perpendicular to the paper surface as an axis. However, the head 41 may be tilted leftward with the direction perpendicular to the paper surface as an axis.

When the head is tilted, ink droplets ejected from the cyan ink nozzle rows $C_1$ and $C_2$, which are disposed relatively in the central area of the head, land in positions that are not significantly displaced from their landing positions when the head is not tilted. That is, the cyan ink nozzle rows $C_1$ and $C_2$ are less subject the effects of tilting of the head, and therefore can keep good image quality. On the other hand, ink droplets ejected from the magenta ink nozzle rows $M_1$ and $M_2$, which are disposed in the side-end areas of the head, land in positions that are significantly displaced from their landing positions when the head is not tilted. Specifically, the magenta ink nozzle rows $M_1$ and $M_2$ are subject to the effects of tilting of the head. As a result, the graininess is deteriorated, which invites grainy image quality.

In this way, if the image quality of raster lines formed by nozzle rows disposed in the central area of the head and raster lines formed by nozzle rows disposed in the side-end areas of the head is inconsistent, the image quality of the entire print image is deteriorated.

In the band printing, if the effects of tilting of the head are present between the forward pass and the return pass, solidity of color and graininess tend to be deteriorated.

(1) Outline of the First Embodiment

The outline of the present invention is as follows: it becomes possible to print raster lines whose color appearance does not suffer from conspicuous band-shaped unevenness in color, by devising the nozzle row arrangement.

(1) Regarding the Nozzle Row Arrangement of the First Embodiment

Figure 12:
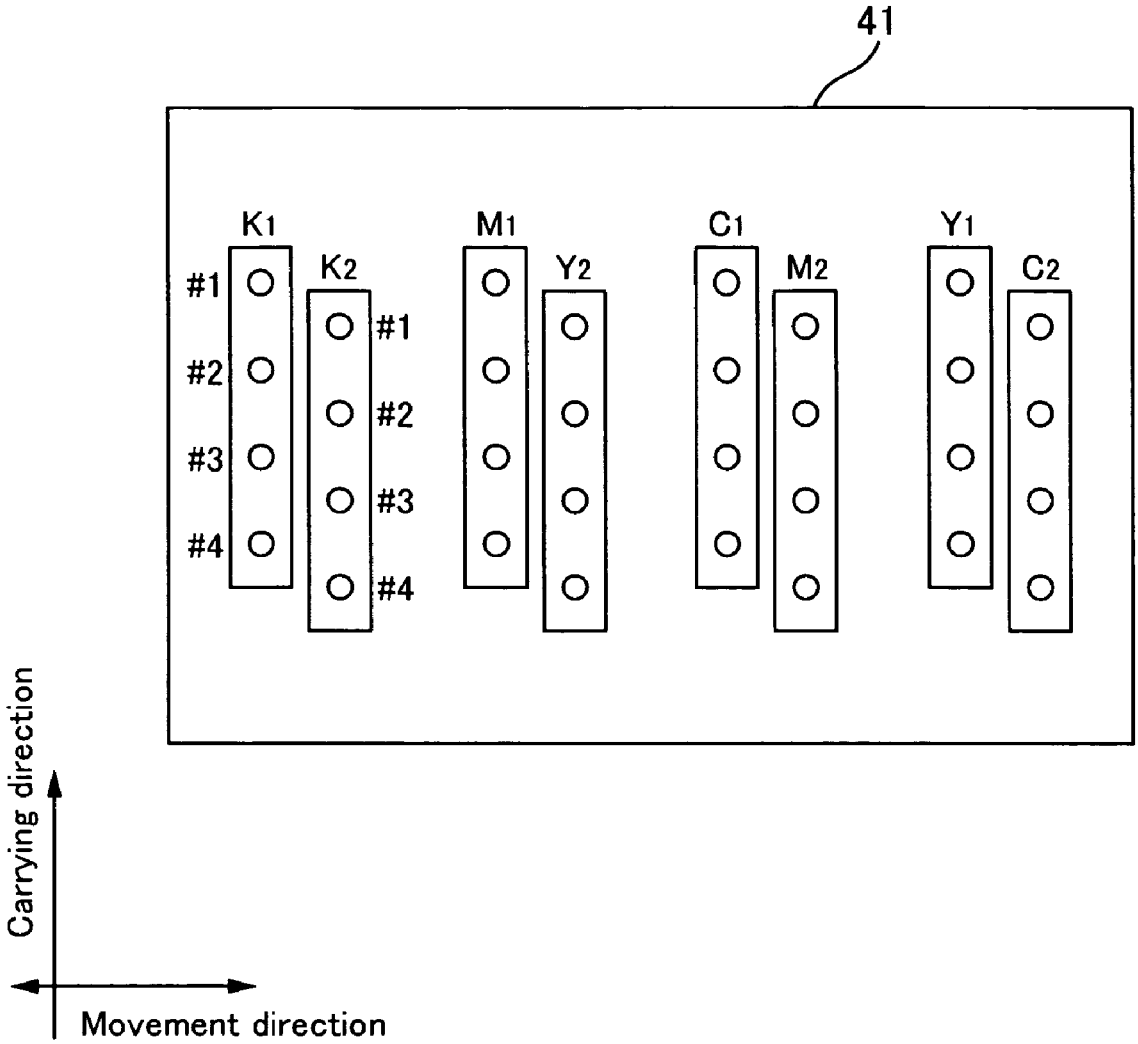
FIG. 12 is a perspective view of a nozzle row arrangement of a first embodiment.

FIG. 12 is a perspective view of the nozzle row arrangement in the lower surface of a head of the first embodiment.

FIG. 12 is a diagram showing the lower surface of the head 41 that opposes paper S as viewed from the back side. When the head 41 is viewed directly from the lower surface side thereof, the nozzle row arrangement is opposite to that shown in FIG. 12. In this perspective view, from the left side of the head 41, black ink nozzle rows $K_1$ and $K_2$, a magenta ink nozzle row $M_1$, a yellow ink nozzle row $Y_2$, a cyan ink nozzle row $C_1$, a magenta ink nozzle row $M_2$, a yellow ink nozzle row $Y_1$ and a cyan ink nozzle row $C_2$ are provided.

A plurality of nozzles of each nozzle row (180 nozzles, for example) are lined up at constant spacings (nozzle pitch: k·D) along the carrying direction. Here "D" is the minimum dot pitch in the carrying direction (that is, the spacing at the maximum resolution of dots formed on the paper S). Also, k is an integer of 1 or more. For example, if the nozzle pitch is 180 dpi (1/180 inch) and the dot pitch in the carrying direction is 360 dpi (1/360 inch), then k=2.

The nozzles of each nozzle row are each assigned numbers (#1 to #180) that become smaller the more downstream the nozzle is. Each nozzle is provided with a piezo element (not shown) as a drive element for driving the nozzle and letting it eject ink droplets.

As with the conventional nozzle row arrangement, the nozzles #1 to #4 of the black ink nozzle row $K_2$ are shifted downward by a distance equivalent to half the nozzle pitch with respect to the nozzles #1 to #4 of the black ink nozzle row $K_1$. In this way, the nozzle rows are disposed in a zigzag form with the nozzle rows alternately shifted upward/downward in the carrying direction.

Nozzle rows of the first embodiment are different from the nozzle rows of the two above-described reference examples (see FIGS. 9 and 11) in terms of the arrangement order of nozzle rows. In the first embodiment, the nozzle rows for color inks (magenta ink, yellow ink and cyan ink other than black ink) are disposed in the following order: the magenta ink nozzle row $M_1$, yellow ink nozzle row $Y_2$, cyan ink nozzle row $C_1$, magenta ink nozzle row $M_2$, yellow ink nozzle row $Y_1$, and cyan ink nozzle row $C_2$. With this nozzle row arrangement, unevenness in color can be mitigated.

Figure 13A:
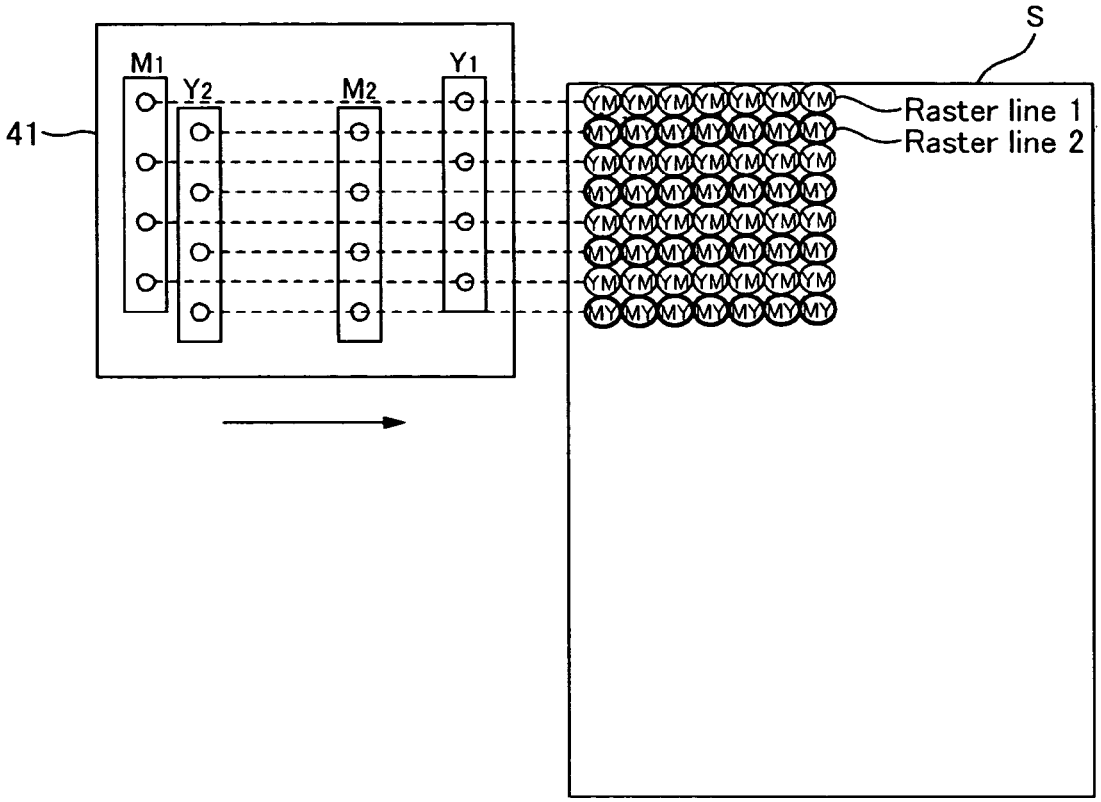
FIG. 13A is an explanatory diagram of band printing of the first embodiment, showing the position of the head (and nozzles) and a state of dot formation during a single pass.
Figure 13B:
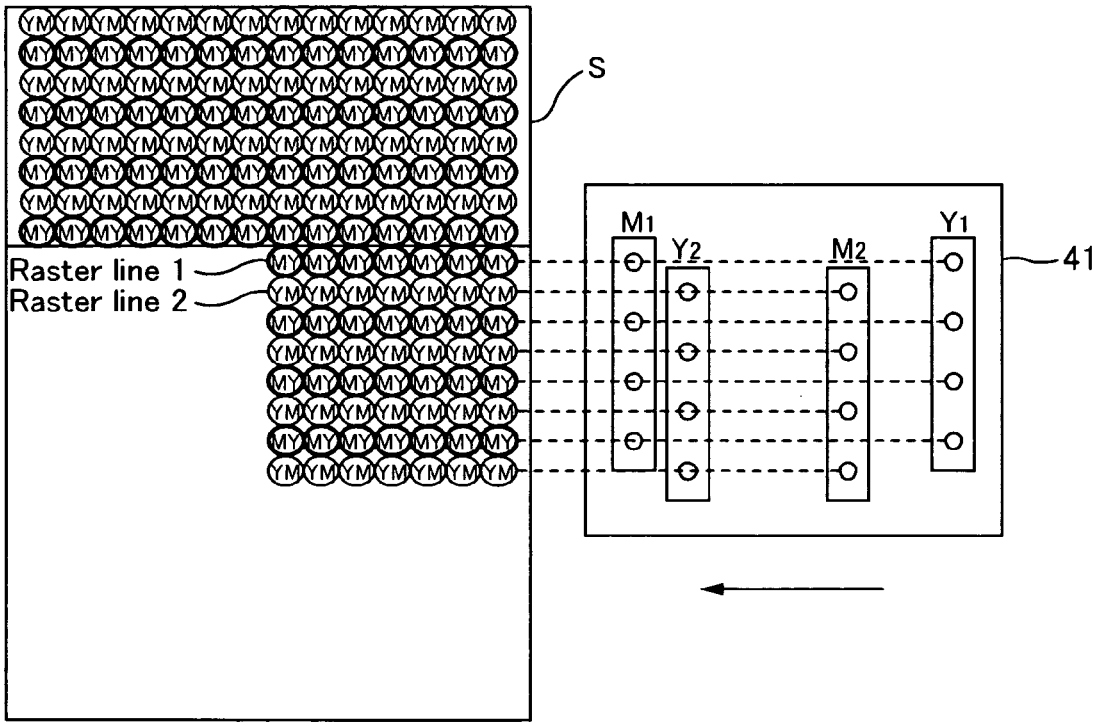
FIG. 13B is an explanatory diagram of band printing of the first embodiment, showing the position of the head and a state of dot formation during the subsequent pass.

Regarding Mitigation of Unevenness in Color due to Color Inversion of the Color Red Since the color red is the secondary color of magenta and yellow, the magenta ink nozzle rows and the yellow ink nozzle rows are focused on here. FIG. 13A and FIG. 13B are explanatory diagrams of the band printing of the first embodiment. FIG. 13A shows the position of the head (and nozzles) and a state of dot formation during a single pass, and FIG. 13B shows the position of the head and a state of dot formation during the subsequent pass.

As shown in FIG. 13A, the head 41 moves from the left side to the right side of FIG. 13A during the first pass. Due to the nozzle row arrangement, the ejection order of ink droplets differs in each raster line. In raster line 1, the yellow ink nozzle row $Y_1$ ejects ink first and then the magenta ink nozzle row $M_1$ ejects ink. A yellow ink droplet Y lands on paper and then a magenta ink droplet M lands on the paper as overlapping the yellow ink droplet Y, thereby forming a dot YM. In raster line 2, the magenta ink nozzle row $M_2$ ejects ink first and then the yellow ink nozzle row $Y_2$ ejects ink. A magenta ink droplet M lands on paper and then a yellow ink droplet M lands on the paper as overlapping the magenta ink droplet M, thereby forming a dot MY.

As shown in FIG. 13A, the ejection order of inks alternates. Dots formed by a light yellow ink droplet Y landing first are indicated by a thin line, and dots formed by a dark ink magenta droplet M landing first are indicated by a thick line. Raster lines made up of dots of thin line and raster lines made up of dots of thick line are formed alternately.

As shown in FIG. 13B, the head 41 moves from the right side to the left side of FIG. 13B during the second pass. Due to the nozzle row arrangement, in raster line 1, the magenta ink nozzle row $M_1$ ejects ink first and then the yellow ink nozzle row $Y_1$ ejects ink, thereby forming a dot MY. In raster line 2, the yellow ink nozzle row $Y_2$ ejects ink first and then the magenta ink row $M_2$ ejects ink, thereby forming a dot YM.

As shown in FIG. 13B, as in the first pass, raster lines made up of dots of the thin line and raster lines made up of dots of the thick line are formed alternately.

As described above, band-shaped unevenness in color is mitigated by forming raster lines formed with inks ejected in different landing orders every other line.

Figure 14A:
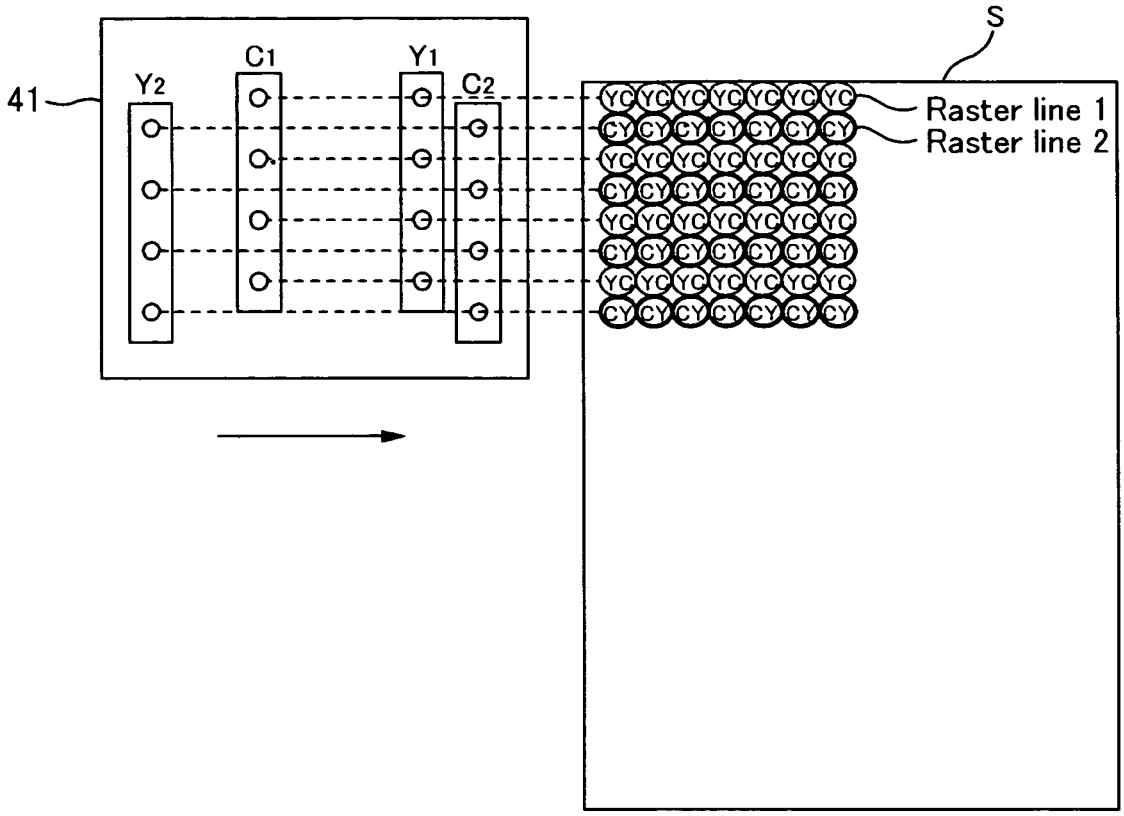
FIG. 14A is an explanatory diagram of band printing of the first embodiment, showing the position of the head (and nozzles) and a state of dot formation during a single pass.
Figure 14B:
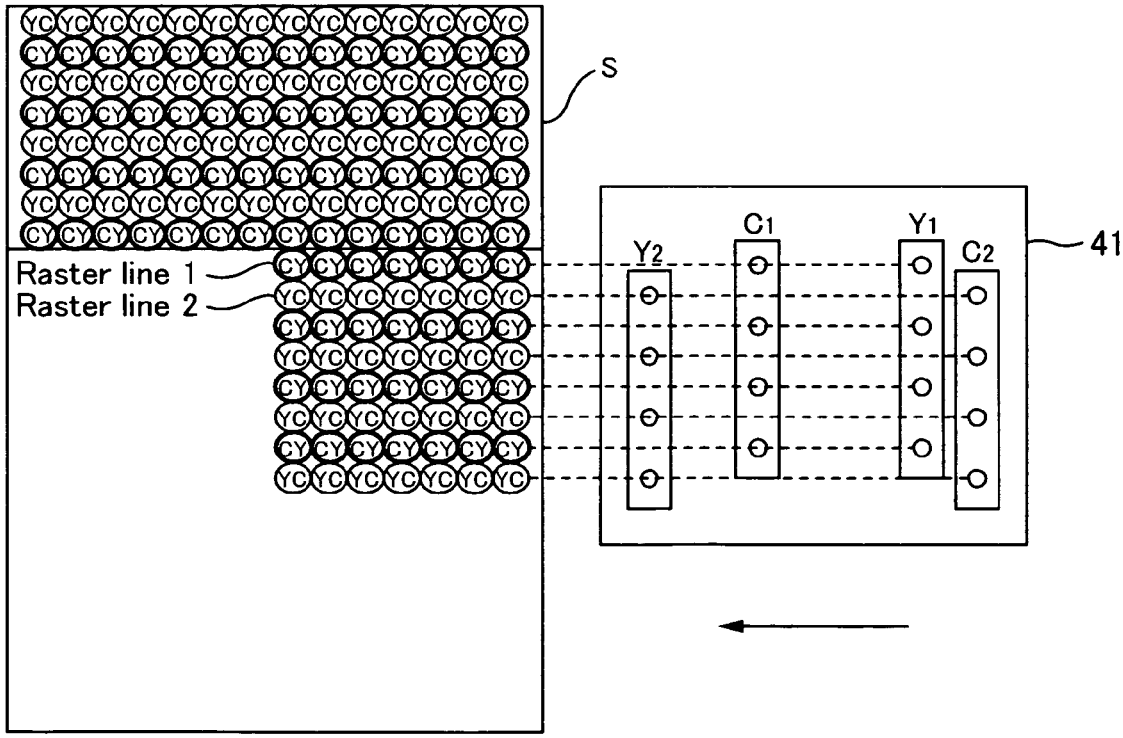
FIG. 14B is an explanatory diagram of band printing of the first embodiment, showing the position of the head and a state of dot formation during the subsequent pass.

Regarding Mitigation of Unevenness in Color Due to Color Inversion of the Color Green Since the color green is the secondary color of yellow and cyan, the yellow ink nozzle rows and the cyan ink nozzle rows are focused on here. FIG. 14A and FIG. 14B are explanatory diagrams of the band printing of the first embodiment. FIG. 14A shows the position of the head (and nozzles) and a state of dot formation during a single pass, and FIG. 14B shows the position of the head and a state of dot formation during the subsequent pass.

As shown in FIG. 14A, the head 41 moves from the left side to the right side of FIG. 14A during the first pass. Due to the nozzle row arrangement, the ejection order of ink droplets differs in each raster line. In raster line 1, the yellow ink nozzle row $Y_1$ ejects ink first and then the cyan ink nozzle row $C_1$ ejects ink. A yellow ink droplet Y lands and then a cyan ink droplet C lands as overlapping the yellow ink droplet Y, thereby forming a dot YC. In raster line 2, the cyan ink nozzle row $C_2$ ejects ink first and then the yellow ink nozzle row $Y_2$ ejects ink. A cyan ink droplet C lands and then a yellow ink droplet Y lands as overlapping the cyan ink droplet C, thereby forming a dot CY.

As shown in FIG. 14A, the ejection order of inks differs every other raster line. Dots formed by a light yellow ink droplet Y landing first are indicated by a thin line, and dots formed by a dark cyan ink droplet C landing first are indicated by a thick line. Raster lines made up of dots of thin line and raster lines made up of dots of thick line are formed alternately.

As shown in FIG. 14B, the head 41 moves from the right side to the left side of FIG. 14B during the second pass. Due to the nozzle row arrangement, in raster line 1, the cyan ink nozzle row $C_1$ ejects ink first and then the yellow ink nozzle row $Y_1$ ejects ink, thereby forming a dot CY. In raster line 2, the yellow ink nozzle row $Y_2$ ejects ink first and then the cyan ink nozzle row $C_2$ ejects ink, thereby forming a dot YC.

As shown in FIG. 14B, as in the first pass, raster lines made up of dots of thick line and raster lines made up of dots of thin line are formed alternately.

As described above, band-shaped unevenness in color distribution is mitigated by forming raster lines formed with inks ejected in different landing orders every other line.

In the case of a blue dot (CM), which is the secondary color formed with cyan ink and magenta ink, both of cyan and magenta are dark colors and they have little difference in color density. Therefore, the color appearance of dots is not significantly affected by the landing order of ink droplets. Consequently, color inversion is allowable for the blue dot.

Unevenness in color due to the landing order of inks in forming dots can be suppressed by realizing the nozzle row arrangement of the first embodiment in the head. By suppressing unevenness in color, high quality printing becomes possible. Also in band printing by which high speed printing is possible, image quality of printed images is improved since band-shaped unevenness in color is suppressed.

In addition, effect of tilting of the head can be reduced by realizing the nozzle row arrangement of the first embodiment in the head. In a case where the distance between nozzle rows is long for a certain color and short for another color, as in the reference example 2, some nozzle rows are affected by tilting of the head and other nozzle rows are not. If the distance between the nozzle rows for the respective colors is substantially uniform, as the first embodiment, nozzle rows of every color is affected by tilting of the head to the same degree, and therefore it becomes possible to mitigate deterioration of image quality of printed images.

Summary of the First Embodiment (1) A printing apparatus of the first embodiment includes the carry unit for carrying paper in the carrying direction and the print head. The print head includes a plurality of nozzle rows and moves in the intersecting direction (movement direction) that intersects the carrying direction.

The print head includes the magenta ink nozzle row $M_1$ and the magenta ink nozzle row $M_2$ as magenta ink nozzle rows, and the yellow ink nozzle row $Y_1$ and the yellow ink nozzle row $Y_2$ as yellow ink nozzle rows.

As shown in FIG. 12, the nozzles of the magenta ink nozzle row $M_1$ and those of the yellow ink nozzle row $Y_1$ are disposed in the same positions in terms of the carrying direction. Also, the nozzles of the magenta ink nozzle row $M_2$ and those of the yellow ink nozzle row $Y_2$ are disposed in the same positions in terms of the carrying direction. The position in the carrying direction of the magenta ink nozzle row $M_1$ is shifted with respect to the position in the carrying direction of the magenta ink nozzle row $M_2$ by a distance equivalent to half the nozzle pitch. In a similar manner, the position in the carrying direction of the yellow ink nozzle row $Y_1$ is shifted with respect to the position in the carrying direction of the yellow ink nozzle row $Y_2$ by a distance equivalent to half the nozzle pitch.

In the print head of the first embodiment, as shown in FIG. 12, the nozzle rows are disposed in the following order from the left side: the magenta ink nozzle row $M_1$, yellow ink nozzle row $Y_2$, magenta ink nozzle row $M_2$ and yellow ink nozzle row $Y_1$.

In this way, it becomes possible to suppress unevenness in color by forming raster lines made up of dots formed with ink droplets ejected in different landing orders every other line. In addition, effects of tilting of the head can be reduced by making the distance between the nozzle rows of the respective colors substantially uniform.

(2) In the printing apparatus of the first embodiment, with respect to the cyan ink nozzle row C and the yellow ink nozzle row Y, one of the rows is the yellow ink nozzle row Y and the other of the rows is the cyan ink nozzle row C. Further, the cyan ink nozzle row C may be the magenta ink nozzle row M.

In this way, when a dot whose color inversion degree is particularly large (secondary dots, i.e., green dot formed with yellow ink and cyan ink and red dot formed with yellow ink and magenta ink) is formed, raster lines made up of dots formed with ink droplets ejected in different landing orders can be formed every other line. As a result, it becomes possible to suppress unevenness in color.

(3) In the printing apparatus of the first embodiment, a dot is formed on paper by superimposing a cyan ink droplet and a yellow ink droplet. Instead of cyan ink, magenta ink may be used.

The problem of color inversion occurs when ink droplets are superimposed as described above. However, raster lines formed with ink droplets ejected in different landing orders can be formed every other line, and unevenness in color can be suppressed.

(4) In the printing apparatus of the first embodiment, bidirectional printing is performed by moving the print head bi-directionally in the intersecting direction that intersects the carrying direction. Accordingly, print speed can be increased.

The problem of color inversion occurs when bidirectional printing is performed as described above. However, raster lines formed with ink droplets ejected in different landing orders can be formed every other line, and unevenness in color can be suppressed.

(5) The controller 60 of the printing apparatus of the first embodiment forms a plurality of dot rows lined up on paper by alternately repeating the dot forming process and the carrying process. The controller 60 forms on paper dot rows that are continuously lined up in the carrying direction by a single dot forming process by the band printing. As a result, print speed can be increased.

However, even in such printing, it becomes possible to suppress unevenness in color by forming raster lines formed with ink droplets ejected in different landing orders every other line.

(6) The print head of the printing apparatus of the first embodiment includes the cyan ink nozzle row $C_1$ and the cyan ink nozzle row $C_2$ as cyan ink nozzle rows. As shown in FIG. 12, a plurality of nozzles of the magenta ink nozzle row $M_1$ and those of the cyan ink nozzle row $C_1$ are disposed in the same positions in terms of the carrying direction. Also, a plurality of nozzles of the magenta ink nozzle row $M_2$ and those of the cyan ink nozzle row $C_2$ are disposed in the same positions in terms of the carrying direction. The nozzle rows are disposed in the intersecting direction that intersects the carrying direction in the following order: the magenta ink nozzle row $M_1$, yellow ink nozzle row $Y_2$, cyan ink nozzle row $C_1$, magenta ink nozzle row $M_2$, yellow ink nozzle row $Y_1$ and cyan ink nozzle row $C_2$.

Raster lines made up of red dots or green dots formed by ink droplets ejected in different landing orders can be formed in every other line, and unevenness in color can be suppressed. It should be noted that with the above-described nozzle row arrangement, raster lines made up of blue dots are formed consecutively and color inversion occurs to the color blue in the raster lines formed in every pass. However, since difference in the color density of cyan ink and magenta ink that form a blue dot is small, the color inversion of the color blue is allowable.

(7) In the printing apparatus of the first embodiment, a plurality of nozzles contain 180 nozzles lined up at predetermined intervals. In other words, the nozzle pitch is 180 dpi (1/180 inch). A plurality of nozzles of the magenta ink nozzle row $M_2$, cyan ink nozzle row $C_2$, and yellow ink nozzle row $Y_2$ are shifted in the carrying direction by a distance equivalent to half the predetermined interval with respect to a plurality of nozzles of the magenta ink nozzle row $M_1$, cyan ink nozzle row $C_1$, and yellow ink nozzle row $Y_1$, i.e., shifted by 1/360 inch.

In this way, raster lines made up of dots formed with ink droplets ejected in different landing orders can be formed at high speed every other line. As a result, unevenness in color can be suppressed and effects of tilting of the head can be reduced.

It is preferable that the printing apparatus includes all the above-described structural elements since it can achieve all effects of the present invention. However, it is not necessary that all the aforementioned structural elements are included. In other words, it is sufficient that the printing apparatus has a configuration in which raster lines made up of dots formed with ink droplets ejected in different landing orders can be formed every other line, so that unevenness in color is suppressed and effects of the head is reduced.

Other Embodiments

The foregoing first embodiment is for the purpose of elucidating the present invention, and is not to be interpreted as limiting the present invention. The present invention can of course be altered and improved without departing from the gist thereof, and includes functional equivalents.

In particular, embodiments mentioned below are also included in the present invention.

Regarding the Nozzle Row Arrangement

In the foregoing embodiment, the distance between the eight nozzle rows provided in the head is not uniform, as shown in FIG. 12. The distance is set a little wider between the black ink nozzle row $K_2$ and the magenta ink nozzle row $M_1$, the yellow ink nozzle row $Y_2$ and the cyan ink nozzle row $C_1$, and the magenta ink nozzle row $M_2$ and the yellow ink nozzle row $Y_1$.

However, the eight nozzle rows can be disposed at equal intervals. By such an arrangement, the distance between two nozzle rows for every color becomes equal. Such an arrangement also can reduce effects of tilting of the head to the cyan ink nozzle row C, magenta ink nozzle row M and yellow ink nozzle Y.

Regarding the Ink

While ink used in the foregoing embodiment is not specified in particular, pigment ink or dye ink may be used.

Next, common portions of second and third embodiments are described below. After that, the second embodiment and the third embodiment are described in detail.

Printing System

Regarding the Configuration of the Printing System

First of all, a printer 1001 as a printing apparatus of second and third embodiments is described together with the printing system. The printing system includes the printer 1001 and a computer 1110 that is a print control apparatus for controlling the operation of the printer 1001.

Figure 15:
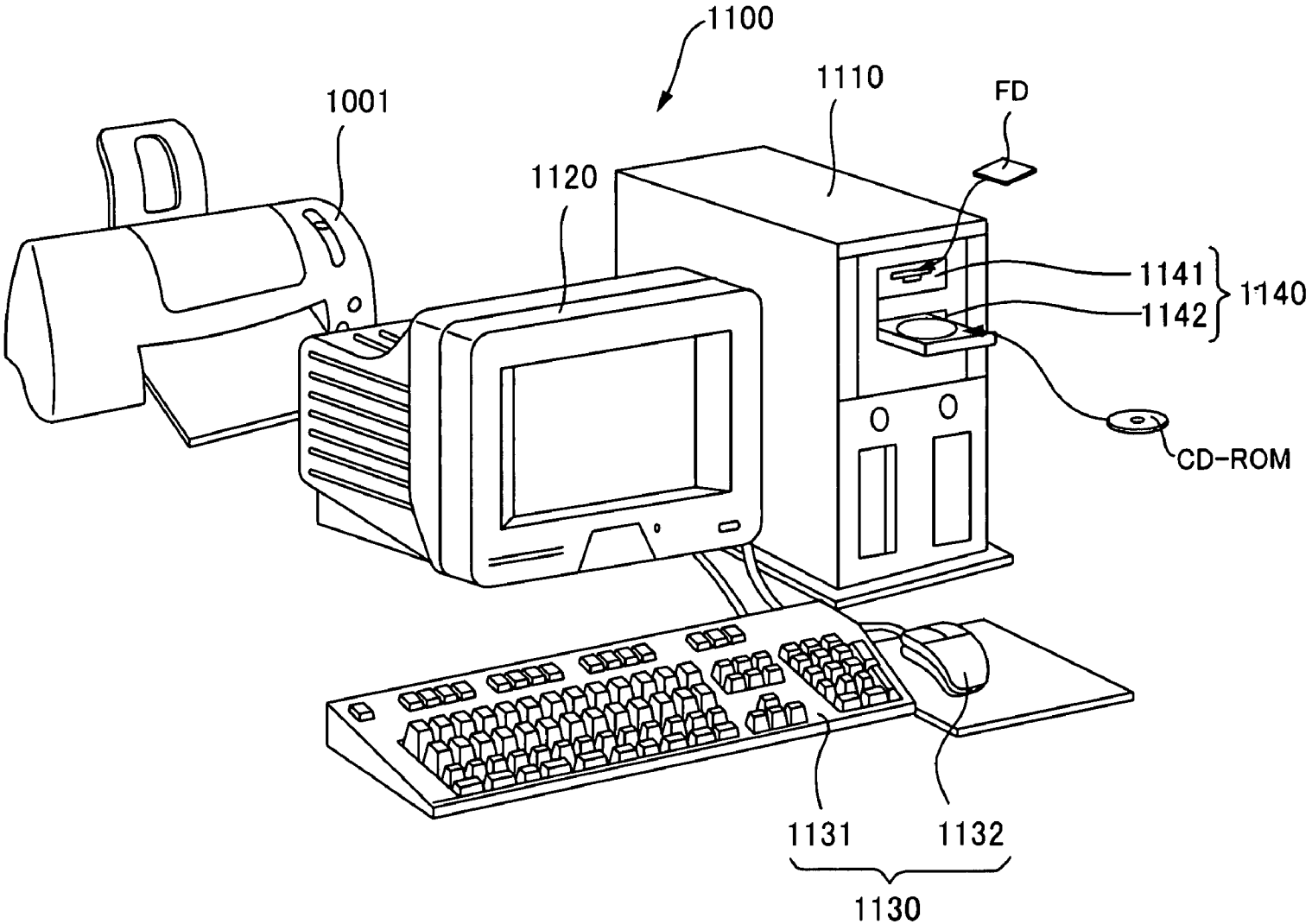
FIG. 15 is a diagram illustrating a configuration of a printing system 1100.

FIG. 15 is a diagram illustrating a configuration of the printing system 1100. The illustrated printing system 1100 includes the printer 1001 as a printing apparatus and the computer 1110 as a print control apparatus. More specifically, the printing system 1100 has the printer 1001, the computer 1110, a display device 1120, an input device 1130, and a recording and reproducing device 1140.

The printer 1001 prints images on a medium such as paper, cloth, and film. With respect to the medium, paper S, which is a representative medium (see FIG. 17A), is used as an example in the following description. The computer 1110 is communicably connected to the printer 1001. In order to print an image with the printer 1001, the computer 1110 outputs print data corresponding to that image to the printer 1001. The computer 1110 has computer programs such as an application program and a printer driver installed therein. The display device 1120 is, for example, a display. The display device 1120 is a device for displaying, for example, a user interface of the computer programs. The input device 1130 is, for example, a keyboard 1131 and a mouse 1132. The recording and reproducing device 1140 is, for example, a flexible disk drive device 1141 and a CD-ROM drive device 1142.

Computer

Regarding the Configuration of the Computer 1110

Figure 16:
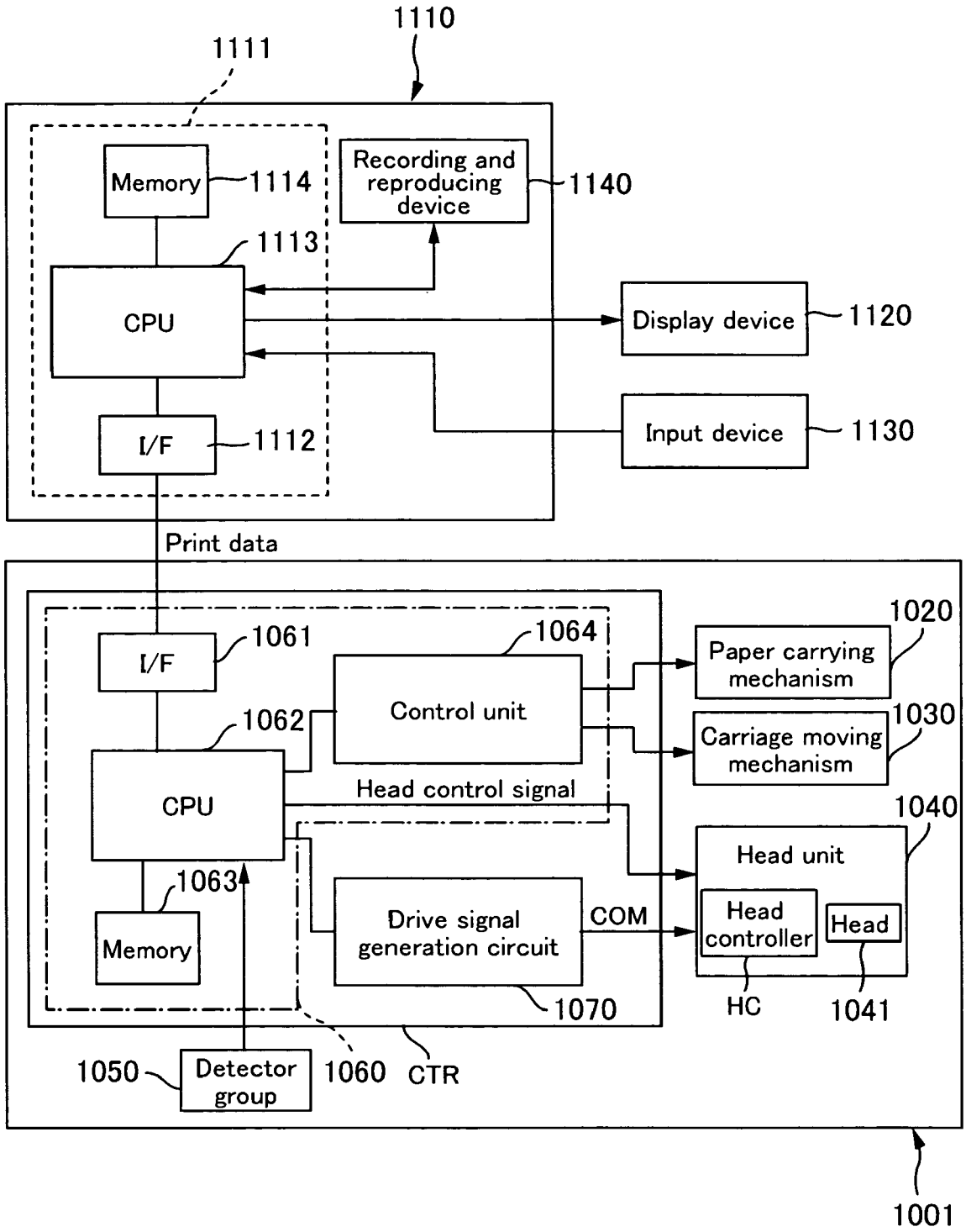
FIG. 16 is a block diagram illustrating configurations of a computer 1110 and a printer 1001.

FIG. 16 is a block diagram illustrating configurations of the computer 1110 and the printer 1001.

First, the configuration of the computer 1110 is described briefly. The computer 1110 has the above-mentioned recording and reproducing device 1140 and a host-side controller 1111. The recording and reproducing device 1140 is communicably connected to the host-side controller 1111 and attached to, for example, a housing of the computer 1110. The host-side controller 1111 performs various controls in the computer 1110 and is also communicably connected to the above-mentioned display device 1120 and input device 1130. The host-side controller 1111 has an interface section 1112, a CPU 1113, and a memory 1114. The interface section 1112 is interposed between the computer and the printer 1001 and exchanges data. The CPU 1113 is a computation processing device for performing the overall control of the computer 1110. The memory 1114 is for reserving a region for storing computer programs used by the CPU 1113 and a working region, for example, and is constituted by a RAM, an EEPROM, a ROM, or a magnetic disk device, for example. Examples of the computer programs that are stored on the memory 1114 include the application program and the printer driver as described above. The CPU 1113 performs various controls according to the computer programs stored on the memory 1114.

The printer driver allows the computer 1110 to realize a function of converting image data output from the application program into the print data. The printer 1001 carries out printing operation when it receives the print data from the computer 1110.

The print data is data having a format that can be interpreted by the printer 1001, and that includes various types of command data and pixel data. The command data is data for instructing the printer 1001 to carry out a specific operation. Examples of the command data include command data for instructing paper-supply, command data for indicating the carry amount, and command data for instructing paper-discharge. Moreover, the pixel data is data related to pixels of the image to be printed. Here, the pixels are squares in a virtual grid on the paper, and indicate a region in which a dot is to be formed. The pixel data in the print data is converted into data related to dots to be formed on the paper (data for dot size, for example).

The Printer

Regarding the Configuration of the Printer 1001

Figure 17A:
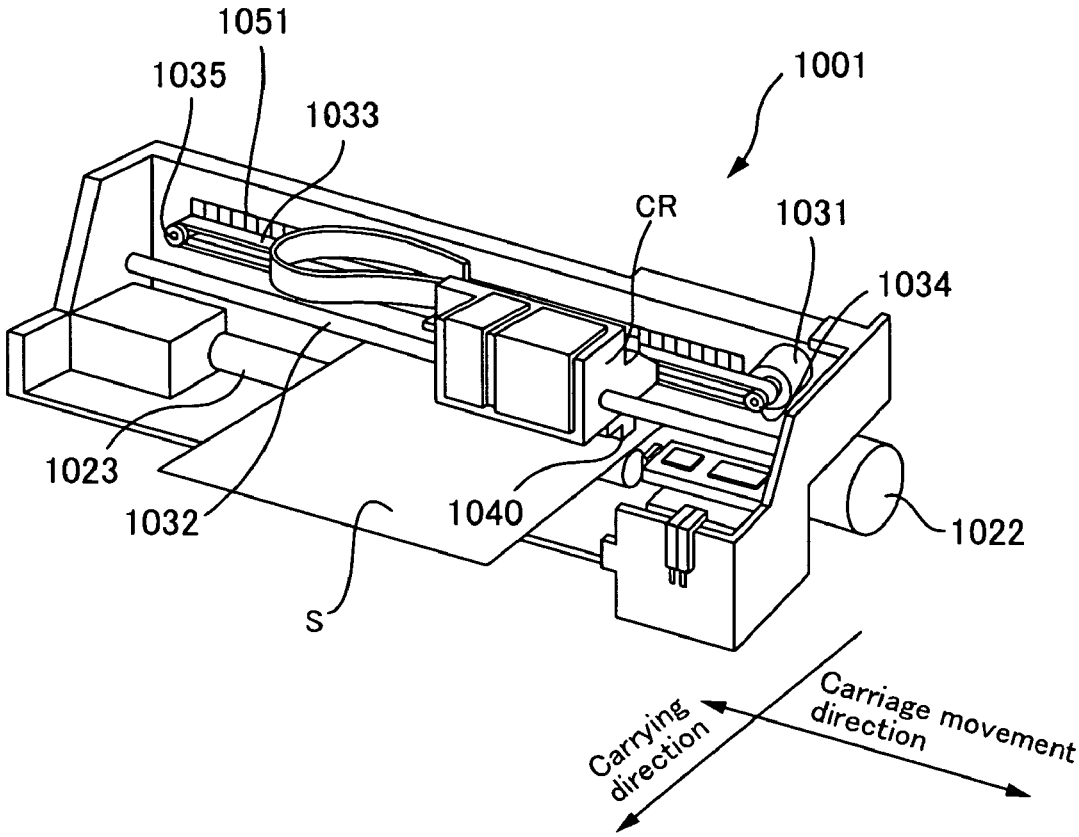
FIG. 17A is a diagram showing a configuration of the printer 1001.
Figure 17B:
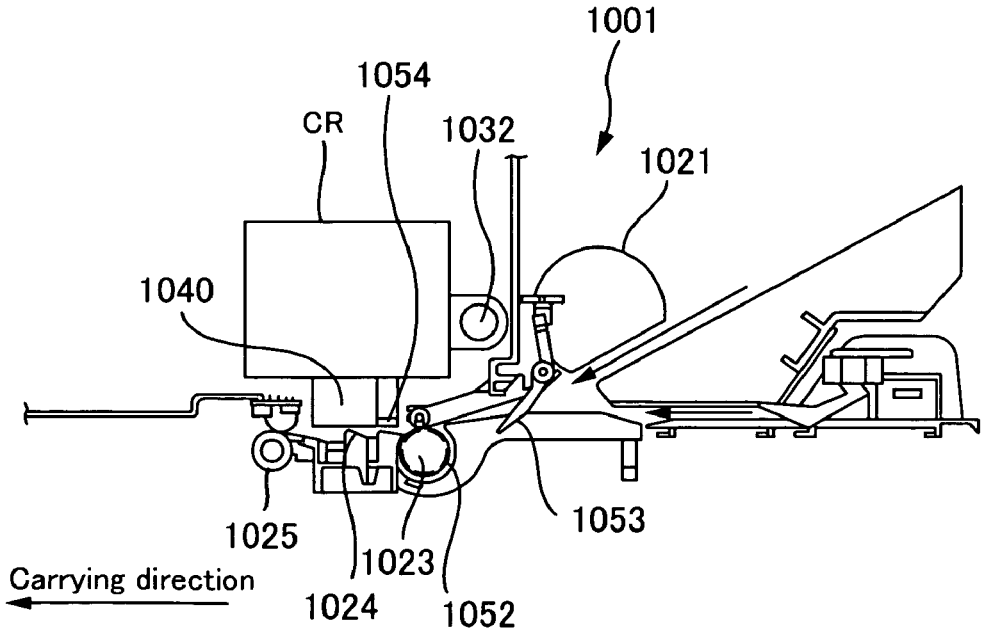
FIG. 17B is a side view illustrating a configuration of the printer 1001.

The configuration of the printer 1001 as a liquid ejecting apparatus is described next. FIG. 17A is a diagram showing the configuration of the printer 1001 of second and third embodiments. FIG. 17B is a side view illustrating the configuration of the printer 1001 of the second and third embodiments. In the following description, reference also is made to FIG. 16.

As shown in FIG. 16, the printer 1001 has a paper carrying mechanism 1020, a carriage moving mechanism 1030, a head unit 1040, a detector group 1050, a printer-side controller 1060, and a drive signal generation circuit 1070. In the second and third embodiments, the printer-side controller 1060 and the drive signal generation circuit 1070 are provided on a common controller board CTR.

In the printer 1001, the printer-side controller 1060 controls the control targets, that is, the paper carrying mechanism 1020, the carriage moving mechanism 1030, the head unit 1040, and the drive signal generation circuit 1070. Thus, based on the print data received from the computer 1110, the printer-side controller 1060 controls so that the image is printed on the paper S. Moreover, detectors in the detector group 1050 monitor the conditions in the printer 1001. The detectors output detection results to the printer-side controller 1060. The printer-side controller 1060 that has received the detection results from the detectors controls the control targets based on the detection results.

Regarding the Paper Carrying Mechanism 1020

The paper carrying mechanism 1020 sends the paper S to a printable position, as well as carries the paper S by a predetermined carry amount in the carrying direction. The carrying direction is a direction that intersects the carriage movement direction described next. Specifically, the paper carrying mechanism 1020 has a function as a moving mechanism for relatively moving the positions of the print head and paper S as a medium in a predetermined direction. As shown in FIG. 17A and FIG. 17B, the paper carrying mechanism 1020 has a paper supply roller 1021, a carry motor 1022, a carrying roller 1023, a platen 1024, and a discharge roller 1025. The paper-supply roller 1021 is a roller for automatically supplying the paper S that has been inserted into a paper insert opening into the printer 1001, and in this example has a cross-sectional shape in the shape of the letter D. The carry motor 1022 is a motor for carrying the paper S in the carrying direction. The carrying roller 1023 is a roller for carrying the paper S that has been fed by the paper-supply roller 1021 to a printable region. The operation of the carrying roller 1023 also is controlled by the carry motor 1022. The platen 1024 is a member that supports the paper S on which printing is being performed from the rear surface of the paper S. The paper-discharge roller 1025 is a roller for carrying the paper S for which printing has finished.

Regarding the Carriage Moving Mechanism 1030

The carriage moving mechanism 1030 is for moving a carriage CR to which the head unit 1040 is attached in the carriage movement direction. The carriage movement direction includes a movement direction from one end side to the other end side and a movement direction from that other end side to the one end side. The carriage moving mechanism 1030 functions as a head moving mechanism that moves the print head in a direction that intersects the nozzle row direction. The carriage moving mechanism 1030 includes a carriage motor 1031, a guide shaft 1032, a timing belt 1033, a driving pulley 1034, and a driven pulley 1035. The carriage motor 1031 corresponds to a driving source for moving the carriage CR. The driving pulley 1034 is attached to a rotation shaft of the carriage motor 1031. The driving pulley 1034 is disposed on one end side of the carriage movement direction. The driven pulley 1035 is disposed on the other end side of the carriage movement direction, which is opposite to the driving pulley 1034. The timing belt 1033 is connected to the carriage CR and extended between the driving pulley 1034 and the driven pulley 1035. The guide shaft 1032 supports the carriage CR in a manner in which the carriage CR can move. The guide shaft 1032 is attached along the carriage movement direction. Therefore, when the carriage motor 1031 operates, the carriage CR moves in the carriage movement direction along the guide shaft 1032.

Regarding the Detector Group 1050

The detector group 1050 is for monitoring the conditions in the printer 1001. As shown in FIG. 17A and FIG. 17B, the detector group 1050 includes a linear encoder 1051, a rotary encoder 1052, a paper detector 1053, and a paper width detector 1054. The linear encoder 1051 is for detecting the position of the carriage CR in the carriage movement direction. The rotary encoder 1052 is for detecting the amount of rotation of the carrying roller 1023. The paper detector 1053 is for detecting the position of the front end of the paper S to be printed. The paper width detector 1054 is for detecting the width of the paper S to be printed.

Regarding the Printer-Side Controller 1060

The printer-side controller 1060 performs control of the printer 1001. For example, the printer-side controller 1060 controls the carry amount of the paper carrying mechanism 1020 by controlling the amount of rotation of the carry motor 1022. The printer-side controller 1060 also controls the position of the carriage CR by controlling the amount of rotation of the carriage motor 1031.

The printer-side controller 1060 also controls the drive signal generation circuit 1070 to generate a drive pulse PS. The shape of the drive pulse is determined according to the amount of ink to be ejected. Thus, when a drive pulse is applied to the piezo element PZT described later, an amount of ink that corresponds to the shape of that drive pulse is ejected.

The printer-side controller 1060 outputs head control signals to the head controller HC. In correspondence with the head control signals, the head controller HC applies the drive pulse PS that is included in the drive signal that has been output from the drive signal generation circuit 1070 to the piezo element PZT.

As shown in FIG. 16, the printer-side controller 1060 has an interface section 1061, a CPU 1062, a memory 1063, and a control unit 1064. The interface section 1061 exchanges data with the computer 1110, which is an external apparatus. The CPU 1062 is a computation processing device for performing the overall control of the printer 1001. The memory 1063 is for reserving a region for storing programs for the CPU 1062 and a working region, for example, and is constituted by a storage element such as a RAM, an EEPROM, or a ROM.

The CPU 1062 controls the various control targets in accordance with computer programs stored on the program storage region of the memory 1063. For example, the CPU 1062 controls the paper carrying mechanism 1020 and the carriage moving mechanism 1030 via the control unit 1064. Moreover, the CPU 1062 outputs head control signals for controlling the operation of the print head 1041 to the head controller HC and outputs a control signal for generating a drive signal COM to the drive signal generation circuit 1070.

Regarding the Head Unit 1040

The head unit 1040 is for ejecting ink toward the paper S. This head unit 1040 includes a print head 1041 and a head controller HC. The print head 1041 and the head controller HC are described here, and the configuration of the nozzle row of the print head 1041 is described later.

Regarding the Print Head 1041

Figure 18:
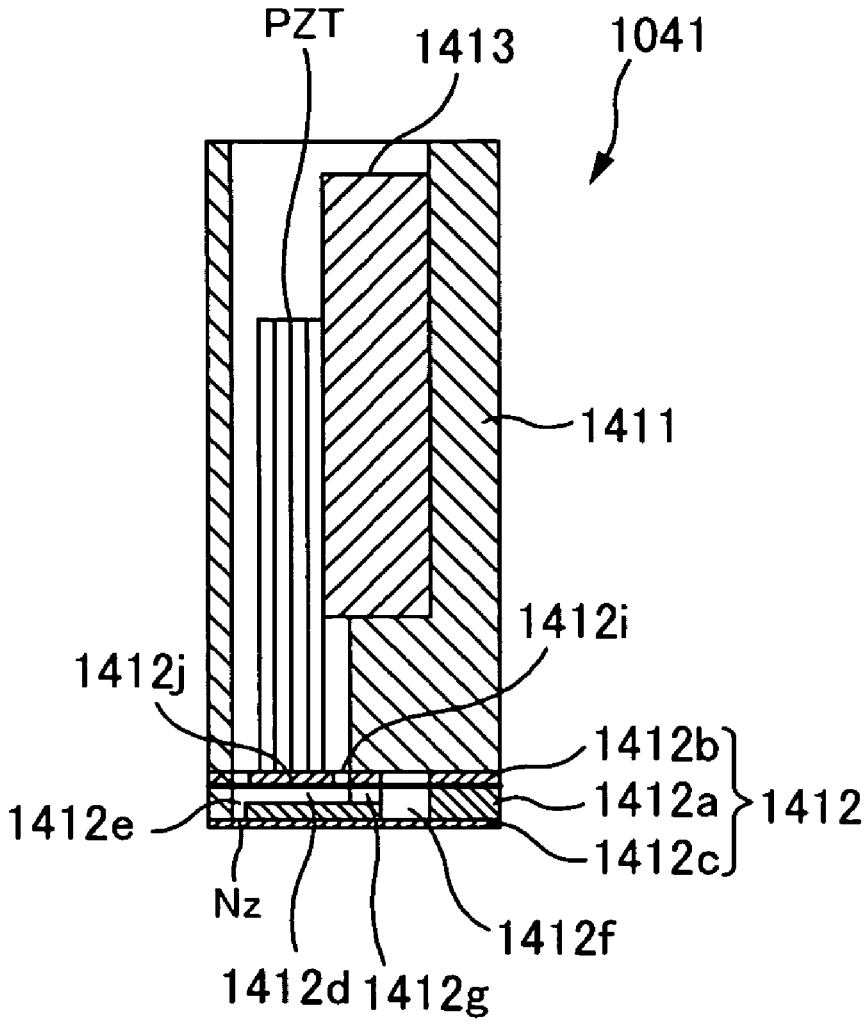
FIG. 18 is a cross-sectional view for explaining a structure of a print head 1041.

FIG. 18 is a cross-sectional view for explaining a structure of a print head 1041.

The print head 1041 includes a case 1411, a flow path unit 1412, and a piezo element PZT. Here, for the purpose of description, portions necessary for a nozzle Nz to eject ink is described.

The flow path unit 1412 is provided with a flow path-forming plate 1412*a*, an elastic plate 1412*b* joined to a surface on one side of the flow path-forming plate 1412*a*, and a nozzle plate 1412*c* joined to a surface on the other side of the flow path-forming plate 1412*a*. A groove section to serve as a pressure chamber 1412*d*, a penetrating opening to serve as a nozzle communication opening 1412*e*, a penetrating opening to serve as a common ink chamber 1412*f*, and a groove section to serve as an ink supply path 1412*g* are formed on this flow path-forming plate 1412*a*.

A bonding base plate 1413 is fixed to the case 1411. This bonding base plate 1413 is a rectangular plate, with the piezo element PZT bonded on one of its surfaces. At the tip of the piezo element PZT, an island section 1412*j* is joined, around which an elastic region constituted by an elastic film 1412*i* is formed.

The piezo element PZT is deformed by applying difference in potential between opposing electrodes. In other words, the piezo element PZT extends and contracts in the longitudinal direction thereof according to the potential of a drive signal applied. When the piezo element PZT extends and contracts, the island section 1412*j* is pushed toward the pressure chamber 1412*d* side, or pulled toward the opposite direction. At this time, the elastic film 1412*i* around the island section deforms, and therefore ink can be ejected from the nozzle Nz in an efficient manner.

Regarding the Drive Signal Generation Circuit 1070

The drive signal generation circuit 1070 generates drive signals that include drive pulses PS. The drive signals are used in common for all of the piezo elements PZT corresponding to a single nozzle row. The drive signal generation circuit 1070 includes a waveform generation circuit and a current amplification circuit, which are not shown.

The waveform generation circuit generates a predetermined drive signal based on waveform data output from the CPU 1062. The current amplification circuit performs power amplification of the drive signal output so as to drive the piezo element PZT.

Regarding the Head Controller HC

A head controller HC performs control for ejecting ink based on the data transmitted from the printer-side controller 1060. For example, the head controller HC selects a drive pulse to be applied to the piezo element PZT among drive signals generated in the above-described drive signal generation circuit 1070 based on the transmitted data. Then, the piezo element PZT causes ink to be ejected according to the selected drive pulse.

Printing Operation of the Printer 1001

With the printer 1001 having the above configuration, the printer-side controller 1060 controls the control targets (the paper carrying mechanism 1020, the carriage moving mechanism 1030, the head unit 1040, and the drive signal generation circuit 1070) in accordance with a computer program that is stored on the memory 1063. The printing operation for paper S is carried out by controlling the control targets as follows.

Figure 19:
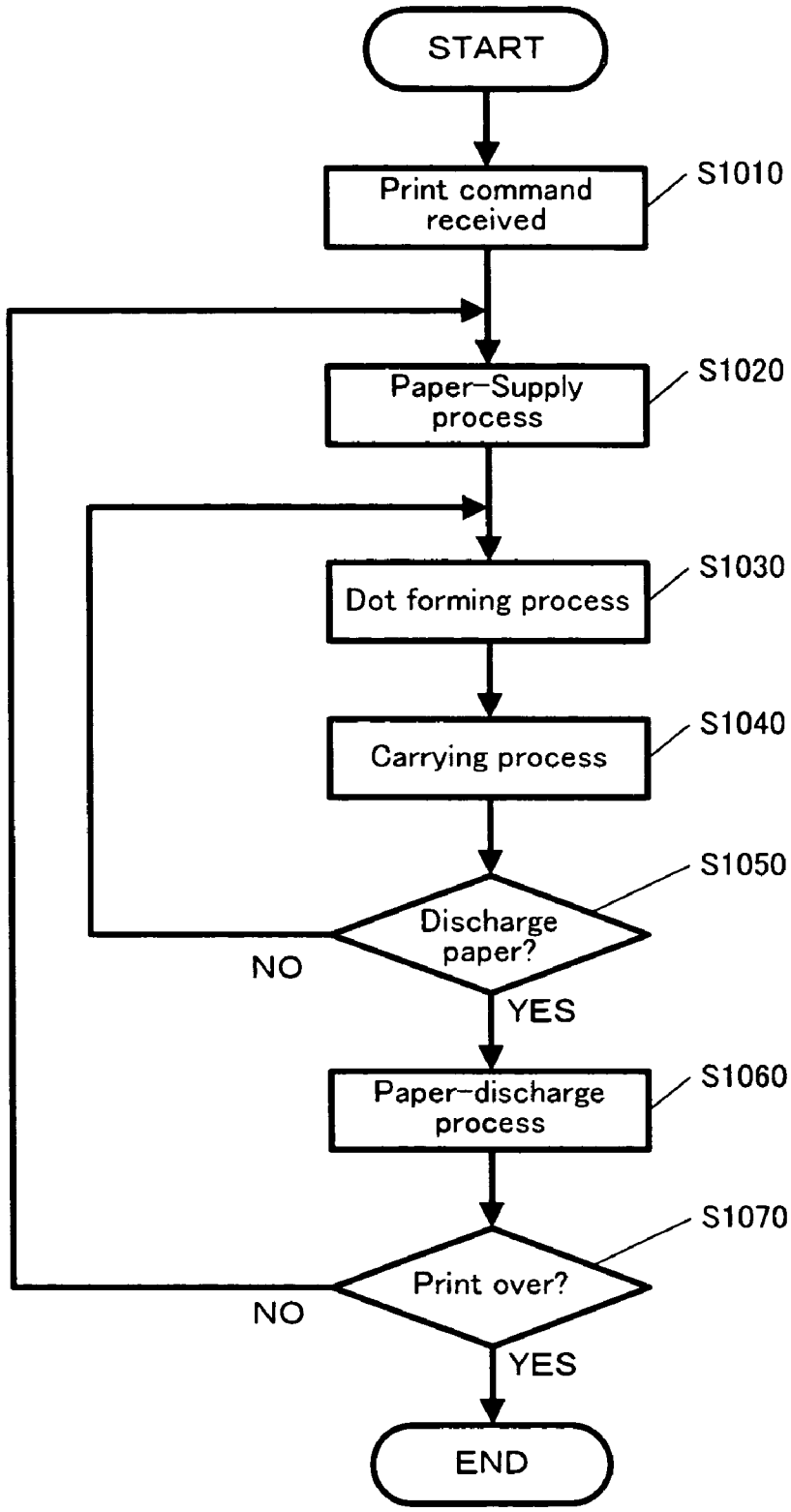
FIG. 19 is a flowchart explaining printing operation.

FIG. 19 is a flowchart describing the printing operation. This illustrative printing operation includes a print command reception process (S1010), a paper-supply process (S1020), a dot forming process (S1030), a carrying process (S1040), a paper-discharge determination (S1050), a paper-discharge process (S1060), and a print-over determination (S1070). These processes are briefly described below.

Print command reception process (S1010) is a process for receiving a print command from the computer 1110. In this process, the printer-side controller 1060 receives the print command via the interface 1061.

Paper-Supply process (S1020) is a process of moving the paper S to be printed to position it at a print start position (so-called "indexing position"). In this process, the printer-side controller 1060 drives the carry motor 1022, for example, to rotate the paper-supply roller 1021 and the carrying roller 1023.

Dot forming process (S1030) is a process for forming dots on the paper S. In this process, the printer-side controller 1060 drives the carriage motor 1031 and outputs the control signals to the drive signal generation circuit and the printing head 1041. Thus, ink is ejected from the nozzles Nz while the print head 1041 is moving, forming dots on the paper S.

Carrying process (S1040) is a process of moving the paper S in the carrying direction. In this operation, the printer-side controller 1060 drives the carry motor 1022 to rotate the carrying roller 1023. By this carrying process, dots can be formed during a dot forming process at positions that are different from those at which dots were formed in the preceding dot forming operation.

Paper-discharge determination (S1050) is a process of determining whether or not it is necessary to discharge the paper S that is being printed. This determination is made by the printer-side controller 1060 based on whether or not there is print data, for example.

Paper-discharge process (S1060) is a process for discharging the paper S and is performed if the result of the preceding paper-discharge determination is "discharge paper". In this case, the printer-side controller 1060 causes the discharge roller 1025 to rotate so that the paper S for which printing has finished is discharged to the outside.

Print over determination (S1070) is a determination of whether or not to continue printing. This determination also is made by the printer-side controller 1060.

Printer Driver

On the computer 1110, computer programs such as an application program and a printer driver operate under an operating system installed on the computer. The application program, for example, has a function of performing image editing or the like, and creates data (image data) related to an image. A user can give an instruction to print an image that has been edited by the application program via the user interface of the application program. Upon receiving the print instruction, the application program outputs image data to the printer driver.

The printer driver receives the image data from the application program, converts the image data into print data, and outputs the print data to the printer. Here, "print data" refers to data in a format that can be interpreted by the printer 1001 and that includes various command data and pixel data. Here, "command data" refers to data for instructing the printer to carry out a specific operation. Furthermore, "pixel data" refers to data related to pixels that constitute an image to be printed (print image), for example, data related to dots to be formed in positions on the paper corresponding to certain pixels (data for dot color and size, for example).

In order to convert the image data that is output from the application program to print data, the printer driver carries out processes such as resolution conversion process, color conversion process, halftone process, and rasterization process. Hereinafter, the various processes performed by the printer driver are described.

Figure 20:
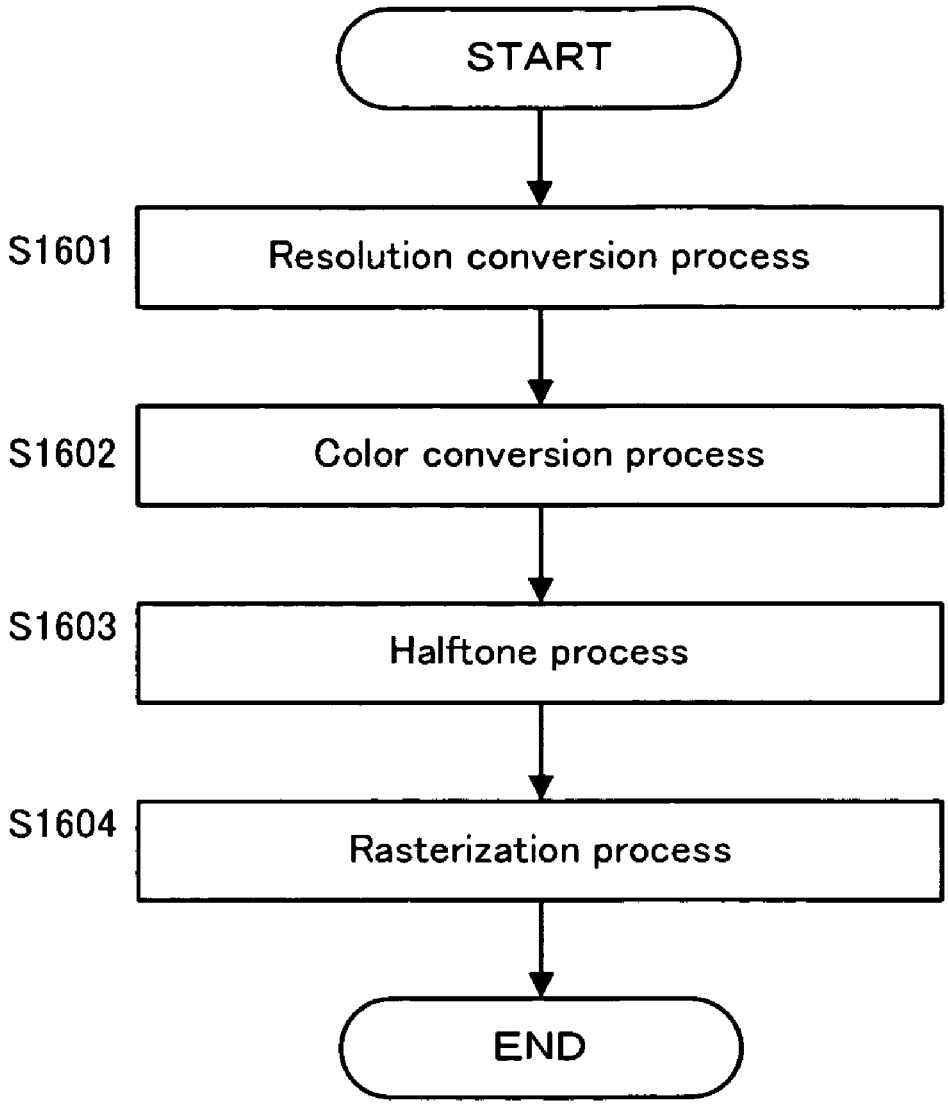
FIG. 20 is a flowchart of basic processes carried out by the printer driver.

FIG. 20 is a flowchart of basic processes carried out by the printer driver.

The resolution conversion process (S1601) is a process in which image data (text data, image data, etc.) output from the application program is converted to image data of a resolution for printing on paper. For example, when the resolution for printing an image on paper is specified as 720×720 dpi, then the image data received from the application program is converted to image data of a resolution of 720×720 dpi. It should be noted that, after the resolution conversion process, the image data is multi-gradation RGB data (for example, 256 gradations) that is expressed in RGB color space. Hereinafter, RGB data obtained by subjecting image data to the resolution conversion process is referred to as the "RGB image data."

Color conversion process (S1602) is a process in which RGB data is converted to CMYK data that is expressed in CMYK color space. It should be noted that CMYK data is data that corresponds to the ink colors of the printer. The color conversion process is carried out by the printer driver referencing a table (a color conversion look-up table LUT) in which gradation values of the RGB image data are associated with gradation values of CMYK image data. By this color conversion process, RGB data for the pixels is converted to CMYK data that corresponds to ink colors. It should be noted that, after the color conversion process, the data is CMYK data with 256 gradations expressed in CMYK color space. Hereinafter, CMYK data obtained by subjecting the RGB image data to the color conversion process is referred to as the "CMYK image data."

Halftone process (S1603) is a process in which data of a high number of gradations is converted to data of a number of gradations that can be formed by the printer. For example, by the halftone process, data expressing 256 gradations is converted to 1-bit data expressing two gradations or 2-bit data expressing four gradations. In the halftone process, pixel data is created such that the printer can form dots in a dispersed manner using methods such as dithering, gamma correction, and error diffusion. During the halftone process, the printer driver references a dither table when performing the dithering, references a gamma table when performing the gamma correction, and references an error memory for storing diffused error when performing the error diffusion. Halftone processed data has a resolution equivalent to the above-mentioned RGB data. Halftone processed image data is constituted by, for example, 1-bit or 2-bit pixel data for each pixel.

Rasterization process (S1604) is a process in which image data in a matrix form is rearranged in an order suitable for transfer to the printer. Rasterized data is output to the printer as pixel data contained in print data.

Printing Method of the Reference Example

Regarding the Nozzle Row Arrangement of the Reference Example

Figure 21:
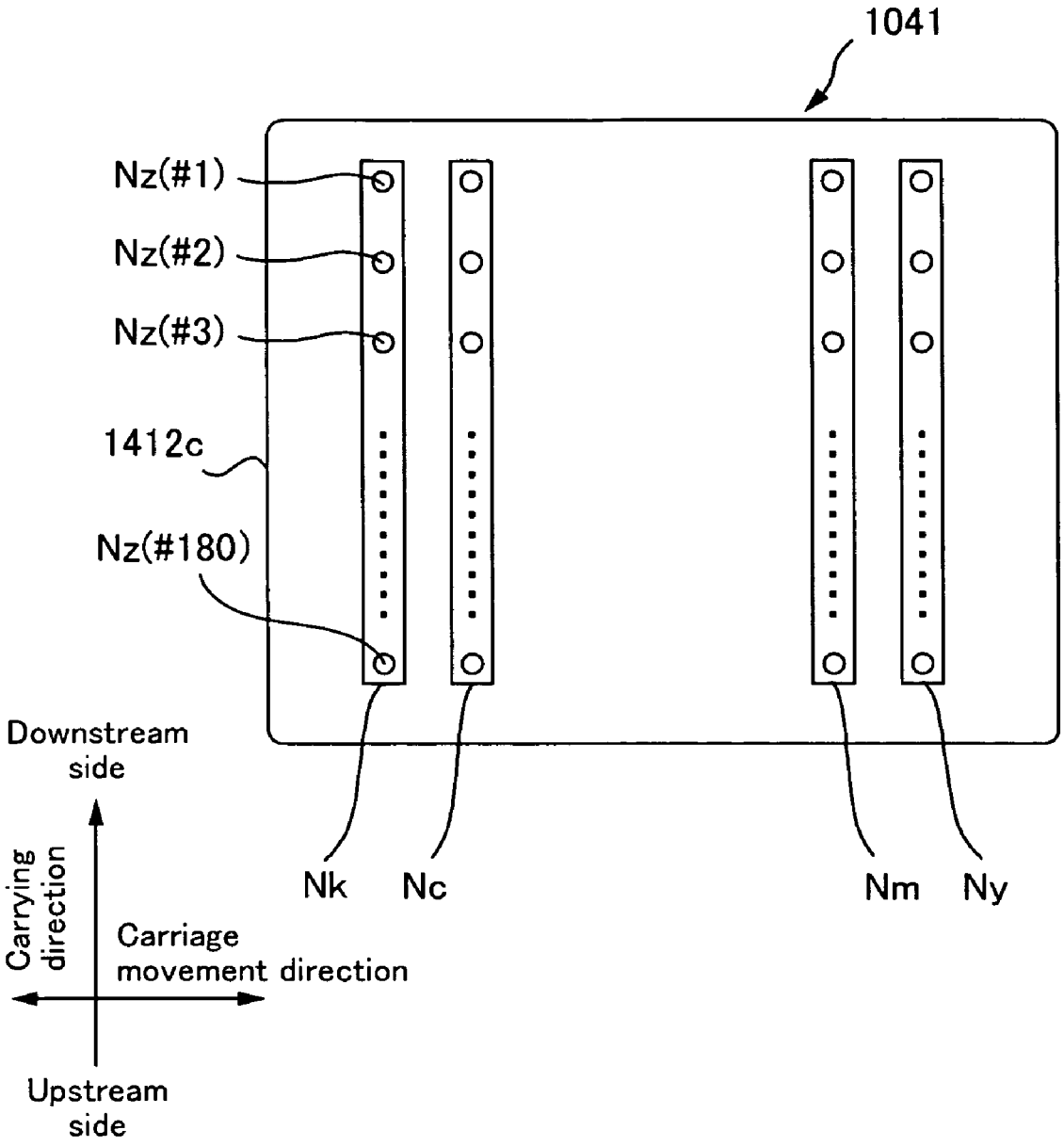
FIG. 21 is a diagram illustrating a nozzle row arrangement of the reference example.

FIG. 21 is a diagram illustrating the nozzle row arrangement of the reference example. The nozzle row arrangement of the reference example in FIG. 21 shows the nozzle plate 1412*c* that opposes the paper S as viewed from the backside. In this nozzle plate 1412*c*, a plurality of nozzle rows each made up of a plurality of nozzles Nz are provided according to ink types. Since the printer 1001 can eject four types of ink, four nozzle rows are provided. In an example shown in FIG. 21, from the left side of FIG. 21, a black ink nozzle row Nk, a cyan ink nozzle row Nc, a magenta ink nozzle row Nm, and a yellow ink nozzle row Ny are provided. The nozzle rows are formed along the carrying direction, lined up in the movement direction.

Yellow ink has a higher lightness than cyan ink and magenta ink. Cyan ink and magenta ink both have a lower lightness than yellow ink. Specifically, in terms of lightness relation among these three colors, difference in lightness between cyan ink and magenta ink is small, while difference in lightness of yellow ink with respect to cyan ink and magenta ink is large.

Regarding the Band Printing

Figure 22A:
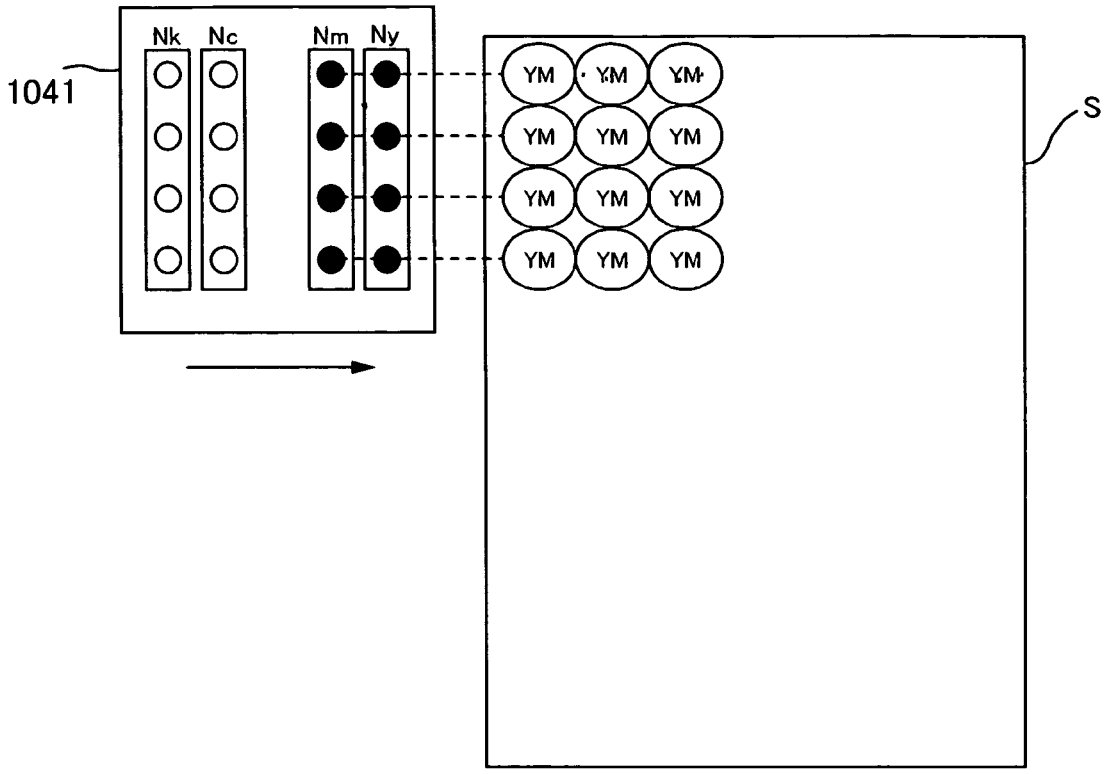
FIG. 22A and FIG. 22B are explanatory diagrams of band printing.
Figure 22B:
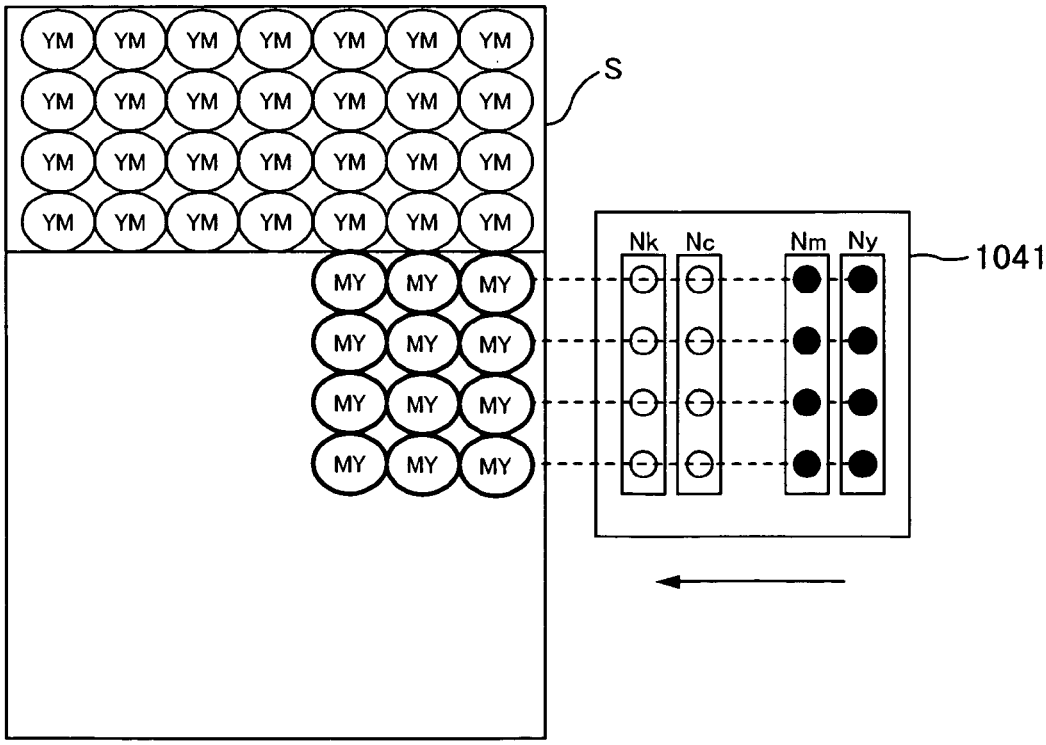

FIG. 22A and FIG. 22B are explanatory diagrams of band printing. FIG. 22A shows the position of the print head 1041 (and nozzles) and a state of dot formation during a pass in the forward pass printing. FIG. 22B shows the position of the print head 1041 and a state of dot formation during a pass in the return pass printing.

For the purpose of description, the number of nozzles of each nozzle row is reduced (four nozzles in this case), and the nozzles are shown as if forming only a few dots (circles in FIGS. 22A and 22B). In practice, ink droplets are intermittently ejected from the nozzles, which are moving in the movement direction, and thus many dots are formed side by side in the movement direction. These rows of dots may also be called raster lines.

"Band printing" performed in FIGS. 22A and 22B refers to a printing method in which consecutive raster lines are formed during a single pass. That is, in the band printing, a band-shaped image fragment of the nozzle length is formed during a single pass. In the carrying operation that is performed between the passes, paper is carried by the nozzle length (4D in this case). By alternately repeating the pass and the carrying operation, the band-shaped image fragments are joined to one another in the carrying direction to form the print image. Note that a "pass" is the process for forming dots by ejecting ink from moving nozzles (a dot forming process).

In the band printing, the dot spacing D in the carrying direction is the same as the nozzle pitch N, namely, 180 dpi. If the number of nozzles is 180, then the carry amount is 180D.

As shown in FIG. 22A, the print head 1041 moves from the left side to the right side of FIG. 22A during a pass in the forward pass printing. In this case, dots of a secondary color are formed with magenta ink and yellow ink. Due to the nozzle row arrangement, the nozzles #1 to #4 of the yellow ink nozzle row Ny eject ink first, and after that the nozzles #1 to #4 of the magenta ink nozzle row Nm eject ink. A yellow ink droplet Y lands on paper first and then a magenta ink droplet M lands on paper overlapping the yellow ink droplet Y, thereby forming a dot YM. Four raster lines are formed during a pass in the forward pass printing. Dots indicated with a thin line (YM) represent dots formed by yellow ink droplets (Y) landing first. Although only initial several dots of the raster line to be formed are indicated in FIG. 22A, a raster line of the paper width is formed with dots at the end of the pass in the forward pass printing.

As shown in FIG. 22B, the print head 1041 moves from the right side to the left side of FIG. 22B during a pass in the return pass printing. Due to the nozzle row arrangement, the nozzles #1 to #4 of the magenta ink nozzle row Nm eject ink first, and after that the nozzles #1 to #4 of the yellow ink nozzle row Ny eject ink. A magenta ink droplet M lands on paper S first and then a yellow ink droplet Y lands on the paper S overlapping the magenta ink droplet M, thereby forming a dot MY. Four raster lines are formed during a pass in the return pass printing. Dots indicated with a thick line (MY) represent dots formed by magenta ink droplets (M) landing first.

As described above, when a dot is formed with two or more colors of ink, the order in which inks are ejected and land is reversed between the pass in the forward pass printing and the pass in the return pass printing.

Regarding the Effects of the Landing Order in the Band Printing

Figure 23A:
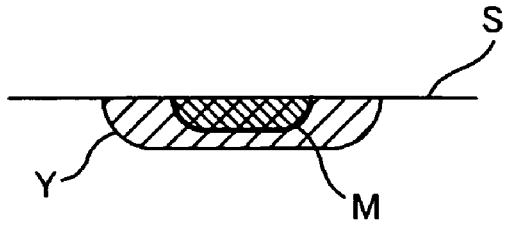
FIG. 23A is a cross-sectional view showing a state in which yellow ink has landed first when a dot is formed with yellow ink and magenta ink.
Figure 23B:
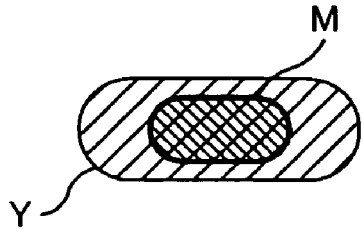
FIG. 23B is a plan view showing a state in which yellow ink has landed first when a dot is formed with yellow ink and magenta ink.
Figure 24A:
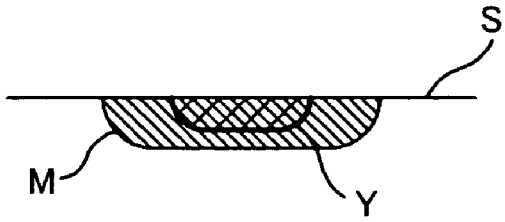
FIG. 24A is a cross-sectional view showing a state in which magenta ink has landed first when a dot is formed with yellow ink and magenta ink.
Figure 24B:
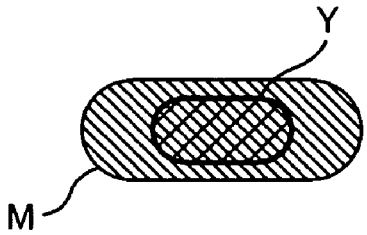
FIG. 24B is a plan view showing a state in which magenta ink has landed first when a dot is formed with yellow ink and magenta ink.

FIG. 23A is a cross-sectional view showing a state in which yellow ink lands first when a dot is formed with yellow ink and magenta ink. FIG. 23B is a plan view showing a state in which yellow ink lands first when a dot is formed with yellow ink and magenta ink. FIG. 24A is a cross-sectional view showing a state in which magenta ink lands first when a dot is formed with yellow ink and magenta ink. FIG. 24B is a plan view showing a state in which magenta ink lands first when a dot is formed with yellow ink and magenta ink.

In this case, since magenta is darker than yellow, in FIGS. 23A, 23B, 24A and 24B, magenta ink is indicated by fine hatching, while yellow ink is indicated by rough hatching.

When an ink droplet lands on the paper S, the ink droplet that lands on the paper S first is soaked over a large area, and an ink droplet that subsequently lands is soaked with overlapping at least apart of the ink droplet that has landed first. In addition, there is a tendency that the ink that lands subsequently does not spread so much as the ink that has landed first. For example, in FIGS. 23A and 23B, a yellow ink droplet has landed first and then a magenta ink droplet has landed. Therefore, the yellow dot is formed spread. On the other hand, in FIGS. 24A and 24B, a magenta ink droplet has landed first and then a yellow ink droplet has landed. Therefore, the magenta dot is formed spread.

In FIGS. 23A, 23B, 24A and 24B, the central region where yellow ink and magenta ink are superimposed is indicated by overlapping the hatchings for both ink colors. When the central regions of FIGS. 23A, 23B, 24A and 24B are compared, they have a similar appearance of the hatching. Therefore, the central regions are visually recognized as having substantially the same color.

With respect to the ink that lands first, FIG. 23B and FIG. 24B shows different hatchings for the peripheral region where inks are not superimposed. In FIG. 23B, yellow ink occupies the peripheral area of the central region in a surrounding manner, and in FIG. 24B, magenta ink occupies the peripheral region of the central area in a surrounding manner. Accordingly, when viewed macroscopically, the dot of FIG. 23B is visually recognized as yellow-tinged red and the dot of FIG. 24B is visually recognized as magenta-tinged red. Specifically, the color appearance of dots varies depending on the landing order of inks.

Especially, visual sense of human beings notably recognizes difference in lightness. In FIG. 23B, the central region is surrounded by light yellow ink, and in FIG. 24B, the central region is surrounded by magenta ink, which is darker than yellow. As a result, when FIGS. 23B and 24B are viewed from a distance to recognize FIGS. 23B and 24B as small dots, the dot of FIG. 23B is recognized light and the dots of FIG. 24B is recognized dark due to effects of the surrounding color.

This is applicable to the relation between yellow ink and cyan ink. A dot formed by light yellow ink landing first appears light and a dot formed by cyan ink, which is darker than yellow, landing first appears dark.

Specifically, the lightness of colors of inks that land and the landing order of the same may have significant impact on the color appearance of formed dot. The lightness varies depending on the reflection amount of light when the light is projected. For example, when light is projected on a color and the color reflects large quantity of light, such a color is recognized as a light color. Of three primary colors for making a color visually recognized with reflected light, namely, yellow, magenta and cyan, yellow is visually recognized as the lightest color, and magenta and cyan are recognized dark with respect to yellow. Also, magenta and cyan are recognized to have substantially the same degree of lightness.

Based on the above-described precondition, for a red dot MY (or YM) that is formed with a magenta ink droplet M and a yellow ink droplet Y, since difference in lightness between magenta ink and yellow ink is large, the ink droplet that lands first appears in a conspicuous manner. Accordingly, variance in the color appearance depending on the landing order is likely for the color red. In a similar manner, for a green dot CY (or YC) that is formed with a cyan ink droplet C and a yellow ink droplet Y, since difference in lightness between cyan ink and yellow ink is large, the ink droplet that lands first appears in a conspicuous manner. Accordingly, variance in the color appearance due to the landing order is likely for the color green.

Effects of the color appearance described above are visually recognized notably in the bidirectional band printing as shown in FIG. 22B. In the printing of the reference example, during a pass in the forward pass printing, raster lines made up of dots formed by yellow ink landing first are consecutively formed in the direction in which the nozzle rows are lined up. In the reference example, four raster lines are consecutively formed in the direction in which the nozzle rows are lined up. Next, during a pass in the return pass printing, raster lines made up of dots formed by magenta ink landing first are consecutively formed in the direction in which the nozzle rows are lined up.

Based on the above description, a dot formed by yellow ink landing first appears light, and a dot formed by magenta ink landing first appears dark. Therefore, a plurality of consecutive raster lines formed during a pass in the forward pass printing are visually recognized as light red, and a plurality of consecutive raster lines formed during a pass in the return pass printing are visually recognized as dark red. In short, band-shaped unevenness in color occurs in the unit of the consecutive raster lines.

Accordingly, in the following embodiment, the occurrence of band-shaped unevenness in color is suppressed by shifting the landing position of yellow ink in the carrying direction of the paper S with respect to the landing position of magenta ink and cyan ink, as described below.

(2) Second Embodiment

Regarding the Print Head of the Second Embodiment

Figure 25:
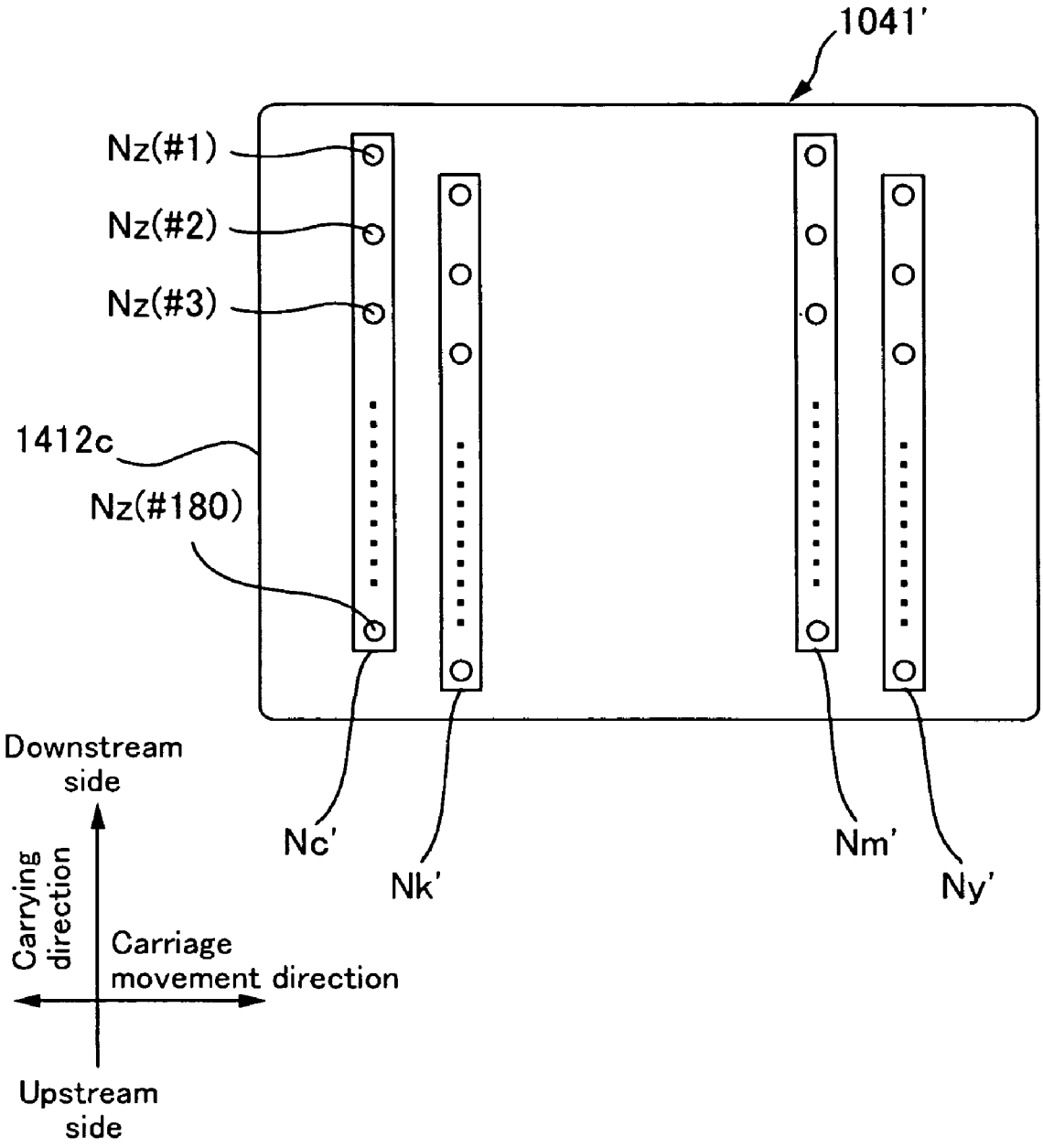
FIG. 25 is a diagram illustrating a nozzle row arrangement in a print head 1041' used in a second embodiment.

FIG. 25 is a diagram illustrating a nozzle row arrangement in a print head 1041' used in a second embodiment. FIG. 25 shows a nozzle plate 1412*c* that opposes paper S as viewed from the back side, as in FIG. 21. In this case as well, the printer 1001 can eject four types of ink, and is provided with four nozzle rows. In the example shown in FIG. 25, a cyan ink nozzle row Nc', a black ink nozzle row Nk', a magenta ink nozzle row Nm' and a yellow ink nozzle rows Ny' are provided.

A plurality of nozzles of each nozzle row (180 nozzles, for example) are lined up at constant spacings (nozzle pitch N: k·D) in the carrying direction of the paper S. Here "D" is the minimum dot pitch in the carrying direction (that is, the spacing at the maximum resolution of dots formed on the paper S). Also, k is an integer of 1 or more. For example, if the nozzle pitch N is 180 dpi (1/180 inch) and the dot pitch in the carrying direction is 360 dpi (1/360 inch), then k=2.

The nozzles of each nozzle row are each assigned numbers (#1 to #180) that become smaller the more downstream the nozzle is. Each nozzle is provided with a piezo element PZT as a drive element for driving the nozzle and letting it eject ink droplets.

In FIG. 25, the yellow ink nozzle row Ny' is shifted downward by a distance equivalent to half the nozzle pitch N with respect to the cyan ink nozzle row Nc' and the magenta ink nozzle row Nm'. The black ink nozzle row Nk' is also shifted downward by a distance equivalent to half the nozzle pitch N with respect to the cyan ink nozzle row Nc' and the magenta ink nozzle row Nm'.

The nozzles of the magenta ink nozzle row Nm' and those of the cyan ink nozzle row Nc' are disposed in the same positions in terms of the carrying direction of the paper S. In other words, if the print head 1041' forms dots while being moved in the movement direction of the print head by a carriage, it is possible for nozzles of the both nozzle rows to form dots for the same pixel during a single pass. Also, the nozzles of the black ink nozzle row Nk' and those of the yellow ink nozzle row Ny' are disposed in the same positions in terms of the carrying direction of the paper.

In the second embodiment, standardization of parts is considered by taking into account manufacturing of nozzle rows for two colors as a single unit. For example, the cyan ink nozzle row Nc' and the black ink nozzle row Nk' are manufactured as a single unit, and the magenta ink nozzle row Nm' and the yellow ink nozzle row Ny' are manufactured as a single unit. For this purpose, the present embodiment adopts a configuration in which the black ink nozzle row Nk' is also shifted downward in the same manner as the yellow ink nozzle row Ny'.

Note that in the reference example, the nozzle rows are disposed in the following order from the left side: the black ink nozzle rows Nk, the cyan ink nozzle rows Nc, the magenta ink nozzle row Nm, and the yellow ink nozzle row Ny. In the second embodiment, nozzle rows are disposed in the following order: the cyan ink nozzle row Nc', black ink nozzle row Nk', magenta ink nozzle row Nm' and yellow ink nozzle row Ny'. This order is realized due to the conditions that nozzle rows for two colors are configured as a single unit, and that the yellow ink nozzle row Ny' is shifted with respect to the magenta ink nozzle Nm' and the cyan ink nozzle row Nc', as described above.

With such a configuration, when a pass is performed, yellow ink dots are formed shifted in the nozzle row direction with respect to magenta ink dots and cyan ink dots on the paper S.

Band Printing of the Second Embodiment

Figure 26A:
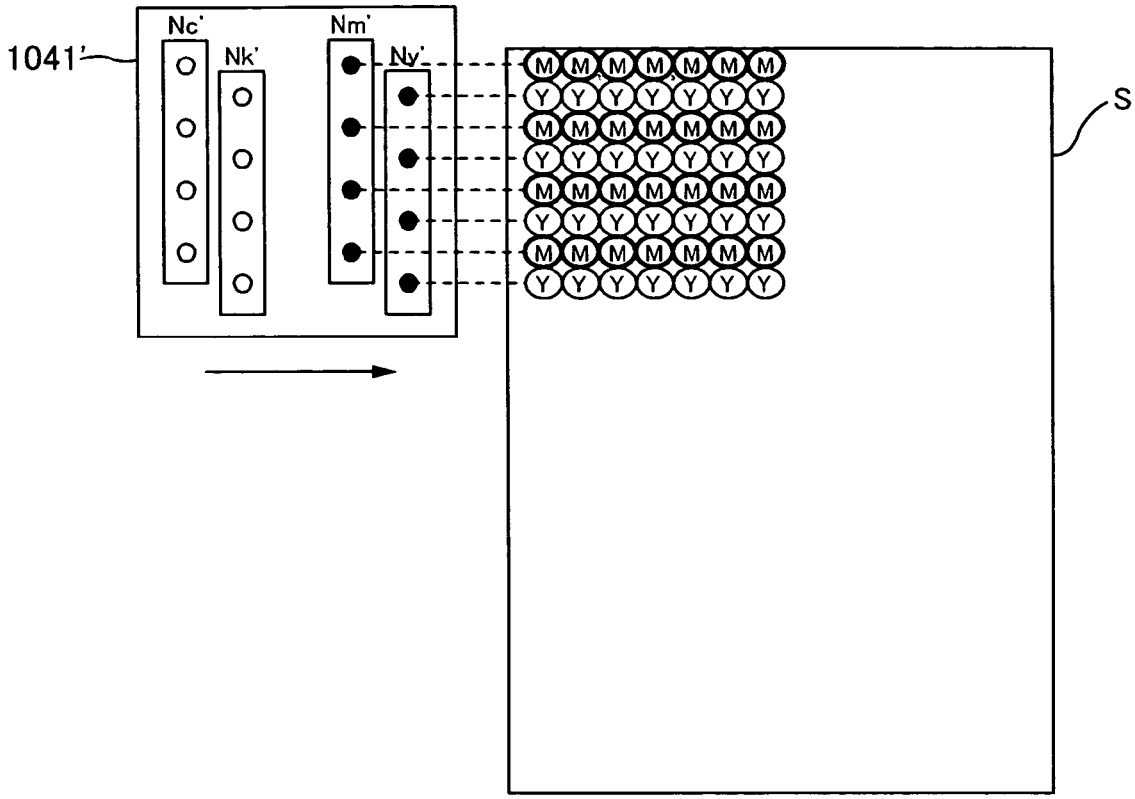
FIG. 26A and FIG. 26B are explanatory diagrams of band printing in which ink is ejected from nozzles of a magenta ink nozzle row and those of a yellow ink nozzle row.
Figure 26B:
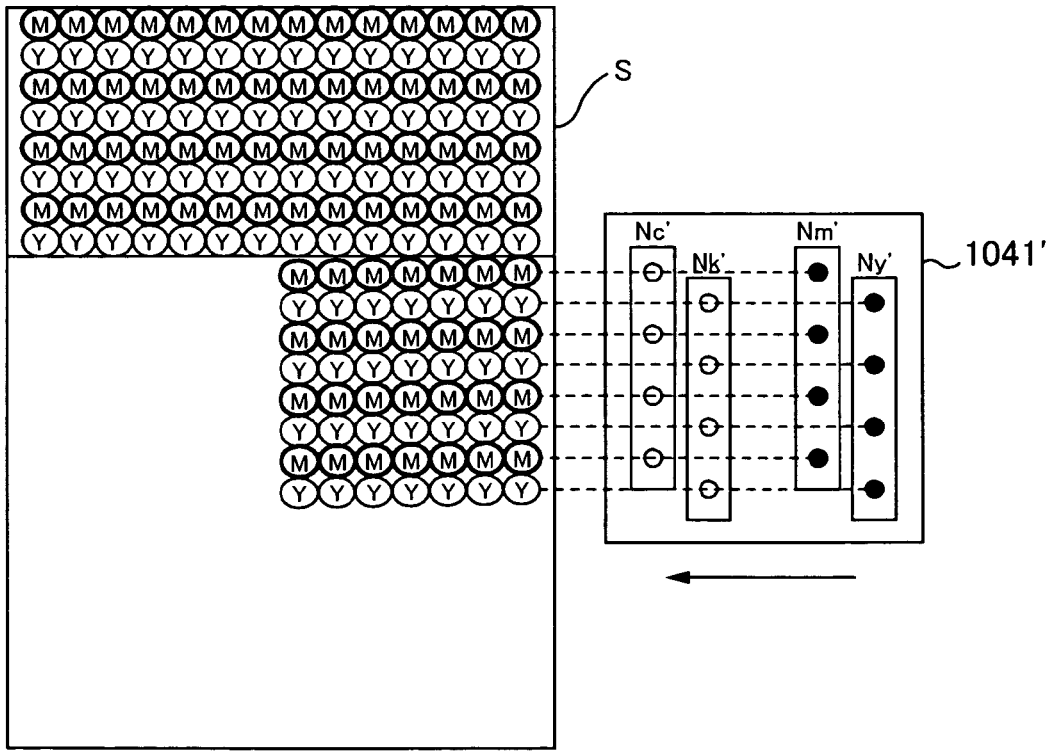

Regarding Mitigation of Band-shaped Unevenness in Color in Forming Red Color Since the color red is the secondary color of magenta and yellow, magenta ink nozzle rows and yellow ink nozzle rows are focused on here. FIG. 26A and FIG. 26B are explanatory diagrams of the band printing in which ink is ejected from nozzles of the magenta ink nozzle row and those of the yellow ink nozzle row. FIG. 26A shows the position of the print head 1041' (and nozzles) and a state of dot formation during a pass in the forward pass printing. FIG. 26B shows the position of the print head 1041' and a state of dot formation during a pass in the return pass printing.

For the purpose of description, the number of nozzles of each nozzle row is reduced (four nozzles in this case), and the nozzles are shown as if forming only a few dots (circles in FIGS. 26A and 26B). In both FIGS. 26A and 26B, nozzles that eject ink droplets are indicated with black circles. In the second embodiment, magenta dots M are indicated with a thick line, and yellow dots Y are indicated with a thin line.

In the band printing of the second and third embodiments, the dot spacing D in the carrying direction is spacing equivalent to half the nozzle pitch N, namely, 360 dpi. If the number of nozzles is 180, then the carry amount is 180D.

As shown in FIG. 26A, the print head 1041' moves from the left side to the right side of FIG. 26A during a pass in the forward pass printing. Due to the nozzle row arrangement, the nozzles #1 to #4 of the yellow ink nozzle row Ny' eject ink first, and after that the nozzles #1 to #4 of the magenta ink nozzle row Nm' eject ink. However, even if a yellow ink droplet Y lands on the paper S first and then a magenta ink droplet M lands on the paper S, both dots are formed on the paper S shifted from each other since the corresponding nozzle rows are shifted from each other. Specifically, here, magenta ink and yellow ink respectively form separate dots for their respective pixels.

Although these magenta ink dots and yellow ink dots are formed shifted from each other in the carrying direction, these dots are very small so that when viewed macroscopically, these dots are recognized as red, the secondary color of yellow and magenta.

As shown in FIG. 26B, the print head 1041' moves from the right side to the left side of FIG. 26B during a pass in the return pass printing. Due to the nozzle row arrangement, the nozzles #1 to #4 of the magenta ink nozzle row Nm' eject ink first, and after that the nozzles #1 to #4 of the yellow ink nozzle row Ny' eject ink. However, even if a magenta ink droplet M lands on the paper S first and then a yellow ink droplet Y lands on the paper S, both dots are formed on the paper S shifted from each other in the carrying direction since the corresponding nozzle rows are shifted from each other.

By adopting the above-described configuration, when the bidirectional band printing is performed, magenta ink dots and yellow ink dots are formed so as to be alternately lined up in the carrying direction both during a pass in the forward pass printing and a pass in the return pass printing. In this way, by shifting nozzles of the yellow ink nozzle row in the nozzle row direction, yellow ink dots are formed shifted in the carrying direction with respect to magenta ink dots. As a result, difference in the appearance of the lightness of dots caused by different landing orders does not occur. In addition, since raster lines formed with magenta ink and raster lines formed with yellow ink are formed alternately, it is possible to mitigate occurrence of the band-shaped unevenness in color caused by consecutive raster lines as shown in the reference example.

Appearance of the secondary color varies between when dots are formed mutually overlapped and when dots are formed shifted from each other. Therefore, a printer driver that is capable of forming dots so as to achieve correct color appearance is used.

Regarding Mitigation of Band-shaped Unevenness in Color in Forming Green Color

Figure 27A:
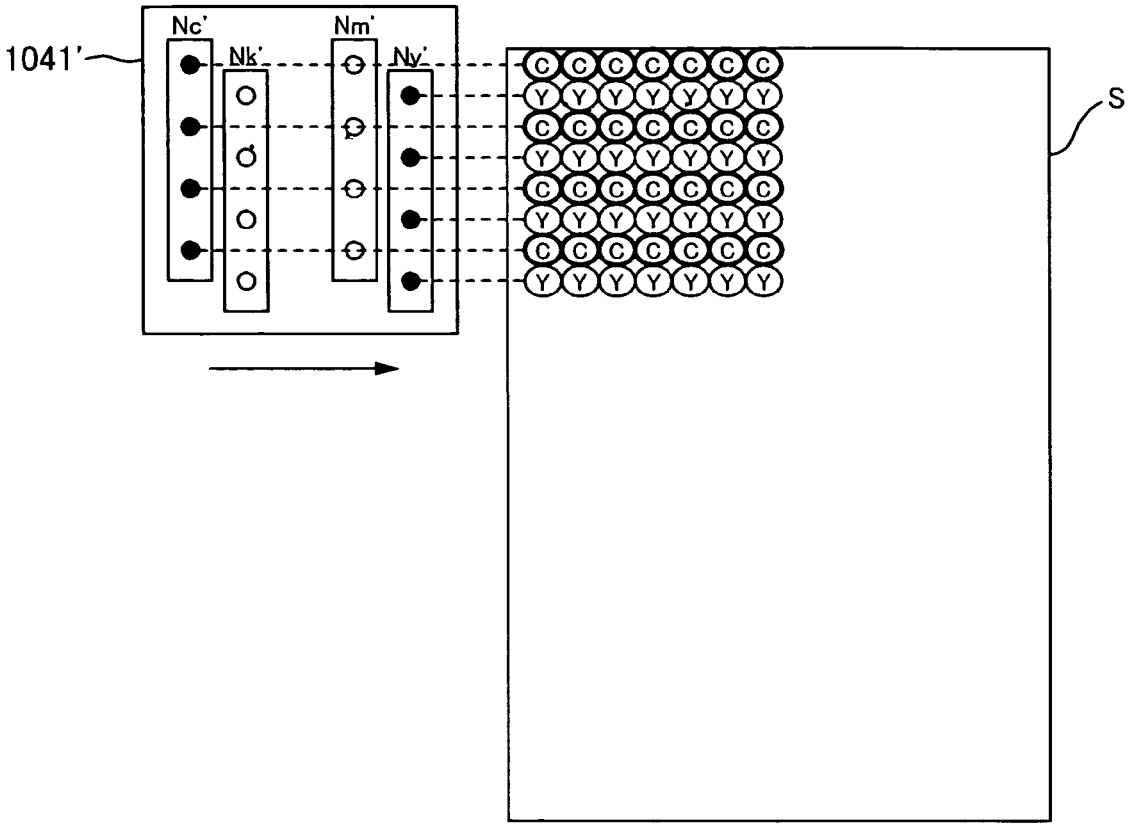
FIG. 27A and FIG. 27B are explanatory diagrams of band printing in which ink is ejected from nozzles of a cyan ink nozzle row and those of the yellow ink nozzle row.
Figure 27B:
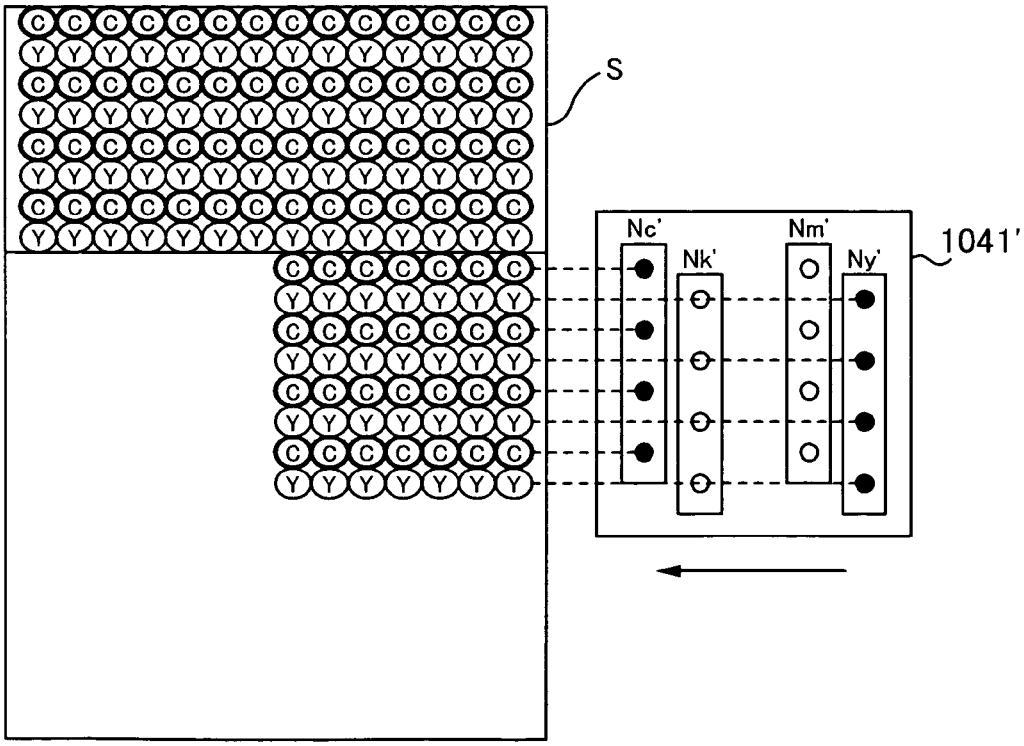

Since the color green is the secondary color of yellow and cyan, the yellow nozzle row Ny' and the cyan nozzle row Nc' are focused on here. FIG. 27A and FIG. 27B are explanatory diagrams of the band printing in which ink is ejected from nozzles of the cyan ink nozzle row and those of the yellow ink nozzle row. FIG. 27A shows the position of the print head 1041' (and nozzles) and a state of dot formation during a pass in the forward pass printing. FIG. 27B shows the position of the print head 1041' and a state of dot formation during a pass in the return pass printing. In this case as well, cyan dots C are indicated with a thick line, and yellow dots Y are indicated with a thin line.

As shown in FIG. 27A, the print head 1041' moves from the left side to the right side of FIG. 27A during a pass in the forward pass printing. Due to the nozzle row arrangement, the nozzles #1 to #4 of the yellow ink nozzle row Ny' eject ink first, and after that the nozzles #1 to #4 of the cyan ink nozzle row Nc' eject ink. However, even if a yellow ink droplet Y lands on the paper S first and then a cyan ink droplet C lands on the paper S, both dots are formed on the paper S shifted from each other in the carrying direction since the corresponding nozzle rows are shifted from each other.

Although these cyan ink dots and yellow ink dots are formed shifted from each other in the carrying direction, these dots are very small so that when viewed macroscopically, these dots are recognized as green, the secondary color of yellow and cyan.

As shown in FIG. 27B, the print head 1041' moves from the right side to the left side of FIG. 27B during a pass in the return pass printing. Due to the nozzle row arrangement, the nozzles #1 to #4 of the cyan ink nozzle row Nc' eject ink first, and after that the nozzles #1 to #4 of the yellow ink nozzle row Ny' eject ink. However, even if a cyan ink droplet C lands on the paper S first and then a yellow ink droplet Y lands on the paper S, both dots are formed on the paper S shifted from each other in the carrying direction since the corresponding nozzle rows are shifted from each other.

By adopting the above-described configuration, when the bidirectional band printing is performed, cyan ink dots and yellow ink dots are formed so as to be alternately lined up in the carrying direction both during a pass in the forward pass printing and a pass in the return pass printing. In this way, by shifting nozzles of the yellow ink nozzle row in the nozzle row direction, yellow ink dots are formed shifted in the carrying direction with respect to cyan ink dots. As a result, difference in appearance of the lightness of dots caused by different landing orders does not occur. In addition, since raster lines formed with cyan ink and raster lines formed with yellow ink are formed alternately, it is possible to mitigate occurrence of the band-shaped unevenness in color caused by consecutive raster lines as shown in the reference example.

In this case as well, appearance of the secondary color varies between when dots are formed mutually overlapped and when dots are formed shifted from each other. Therefore, a printer driver that is capable of forming dots so as to achieve correct color appearance is used.

Figure 28A:
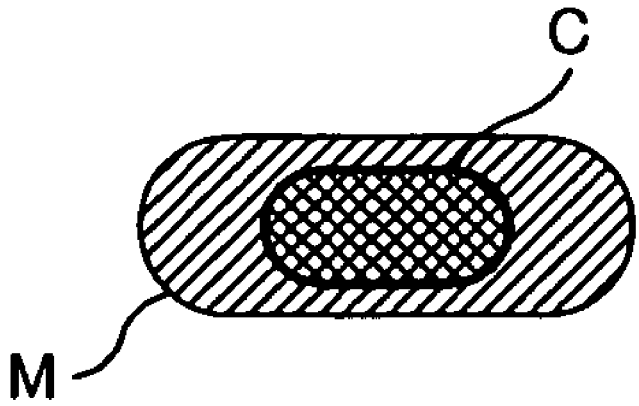
FIG. 28A is a plan view showing a state of dot formation in which magenta ink landed first and cyan ink landed subsequently.
Figure 28B:
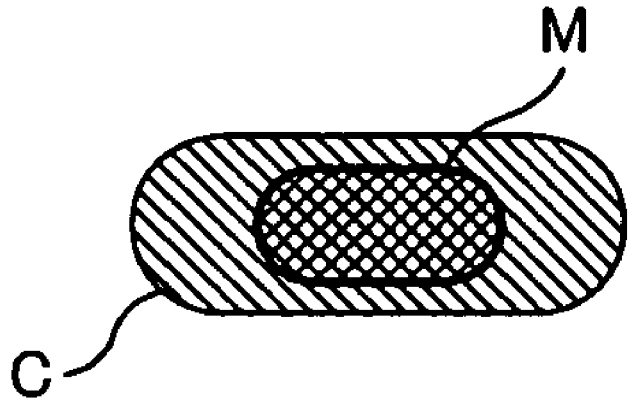
FIG. 28B is a plan view showing a state of dot formation in which cyan ink landed first and magenta ink landed subsequently.

FIG. 28A is a plan view showing a state of dot formation in which magenta ink landed first and cyan ink landed subsequently. FIG. 28B is a plan view showing a state of dot formation in which cyan ink landed first and magenta ink landed subsequently.

Compared with yellow ink described above, to the eyes of human beings, both of cyan ink and magenta ink are recognized as a dark color. In addition, cyan ink and magenta ink are visually recognized as having substantially the same degree of darkness. Therefore as illustrated in FIGS. 28A and 28B, cyan ink and magenta ink are both indicated with hatchings of a similar fineness.

In FIG. 28A, since magenta ink landed first, a magenta dot is formed spread out. On the other hand, in FIG. 28B, since cyan ink landed first, a cyan dot is formed spread out. When both dots are compared, substantially the same color is formed in the central regions where two types of inks are superimposed in both FIGS. 28A and 28B. Cyan ink and magenta ink that have the same degree of darkness occupy the peripheral region of the central region in a surrounding manner. As described so far, magenta and cyan have the same degree of darkness, and therefore it is difficult to visually recognize the difference in lightness between the dot indicated in FIG. 28A and the dot indicated in FIG. 28B.

Due to such a reason, with respect to a blue dot (CM), which is the secondary color formed with cyan ink and magenta ink, it can be said that the color appearance of the blue dot is less subject to the effects of the different landing orders of ink droplets. In this way, with respect to the blue dot, the degree of variance in the color appearance due to the different landing orders is within the permissible range. Therefore, nozzles of the cyan ink nozzle row and those of the magenta ink nozzle row are disposed in the same positions in terms of the carrying direction.

The print head 1041' to be used in the second embodiment uses two units having an equivalent configuration. In FIG. 25, a unit that has the cyan ink nozzle row and black ink nozzle row as one unit, and a unit that has the magenta ink nozzle row and yellow ink nozzle row as one unit are used to configure the print head 1041'. The two units having the equivalent configuration is used so that standardization of parts can be achieved consequently and cost can be reduced.

The print head 1041' includes two units. Each unit has two nozzle rows whose respective nozzles are shifted from each other in the carrying direction. In such a print head 1041', when three color inks (cyan, magenta and yellow) are respectively allocated to three nozzle rows, nozzles of two nozzle rows corresponding to certain two colors are disposed in the same positions in terms of the carrying direction. Also, nozzles of the nozzle rows corresponding to the certain colors are disposed shifted in the carrying direction with respect to nozzles of nozzle rows corresponding to the other two colors. In the second embodiment, under such restriction of construction that arises when two units are used, the print head is configured that can mitigate occurrence of unevenness in color during the bidirectional band printing.

With the above-described configuration of the print head 1041', a yellow ink dot and a black ink dot may be mutually superimposed on the same pixel. Here, black ink has a low degree of lightness (dark), and yellow ink has a high degree of lightness (light).

Theoretically, black ink is defined as the same color as that generated by superimposing all the colors of yellow ink, magenta ink and cyan ink. However, in reality, the appearance of pure black color cannot be achieved in many cases even if these colors are superimposed. In other words, there is a background that black ink is used when pure black color is desired to be represented, and is not used to generate a secondary color.

Also, in many cases only black color is used in printing of documents, and black ink is separately provided. In short, black ink dots often form pixels independently, and a case in which black ink dot is superimposed on yellow ink dot rarely occurs. Accordingly, unevenness in color caused by superimposing a yellow ink dot and a black ink dot rarely occurs. In other words, although black ink dots and yellow ink dots can be formed in the same raster line, they are rarely formed for the same pixel. Therefore, there is little possibility of occurrence of unevenness in color.

Regarding the Printer Driver

As described above, in the second embodiment, a printer driver is prepared and used that can develop correct colors even in a case in which yellow ink dots are formed shifted in the carrying direction so as to be recognized as a combination color when viewed macroscopically. That is, effects of shifting of yellow dots are taken into account for the printer driver.

Regarding the Nozzle Row Arrangement

In the second embodiment, from the viewpoint of standardization of parts, not only the yellow ink nozzle row, but also the black ink nozzle row is shifted in the carrying direction of paper by a distance equivalent to half the nozzle pitch N. However, the black ink nozzle row may be disposed in the same position as the cyan ink nozzle row and the magenta ink nozzle row in terms of the carrying direction of the paper S.

(3) Third Embodiment

Regarding Printing of Red Color in the Third Embodiment

It is possible to realize printing of yellow dots Y shifted with respect to magenta dots M as shown in FIG. 26B, without using the print head shown in FIG. 25. For example, even in the case where the print head in which nozzles of all the nozzle rows are disposed in the same positions in terms of the nozzle row direction is used, it is possible to print yellow dots Y shifted with respect to magenta dots M as shown in FIG. 26B by appropriately selecting nozzles that eject ink.

The print head 1041" used in a third embodiment is the same as the print head 1041 of FIG. 21, except that the nozzle pitch for each color is set to 360 dpi. For the sake of convenience of description, the number of nozzles of the nozzle row for each color is limited to eight, and the nozzles are shown as if forming only a few dots. The dot spacing D in the carrying direction of dots formed on the paper S is 360 dpi.

Figure 29A:
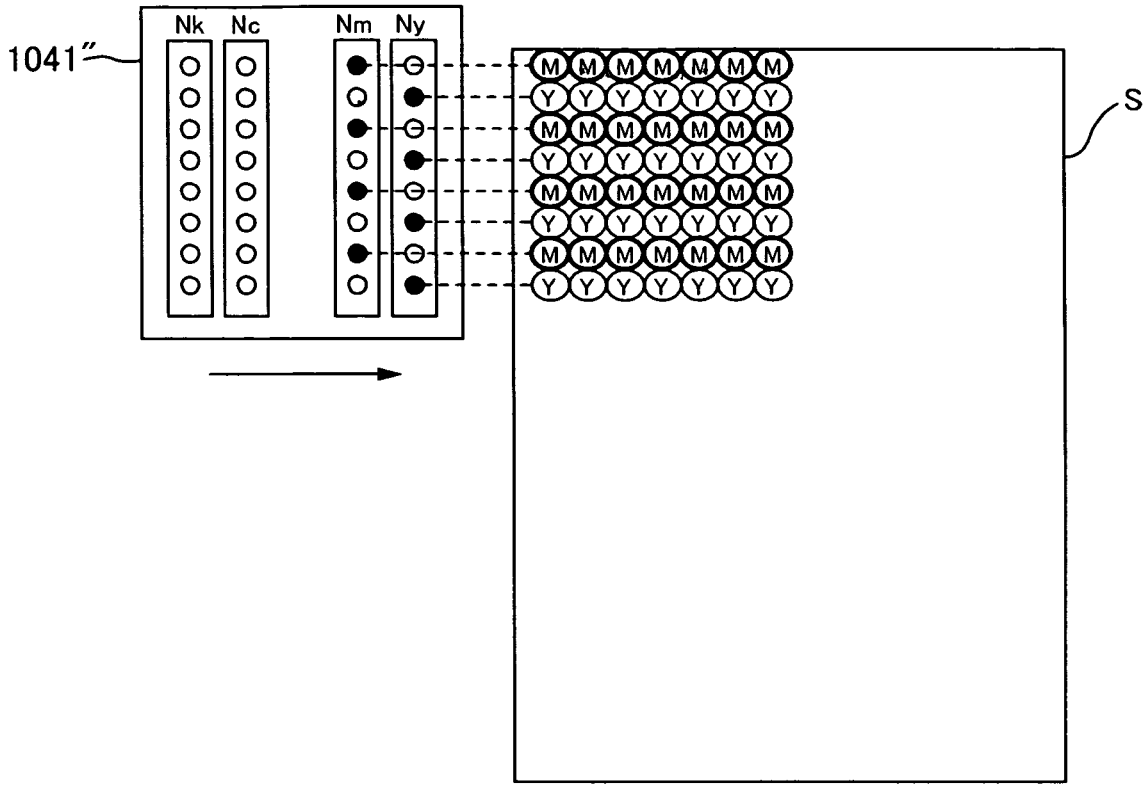
FIG. 29A and FIG. 29B are explanatory diagrams of band printing in which ink is ejected from nozzles of a magenta ink nozzle row and those of a yellow ink nozzle row of a third embodiment.
Figure 29B:
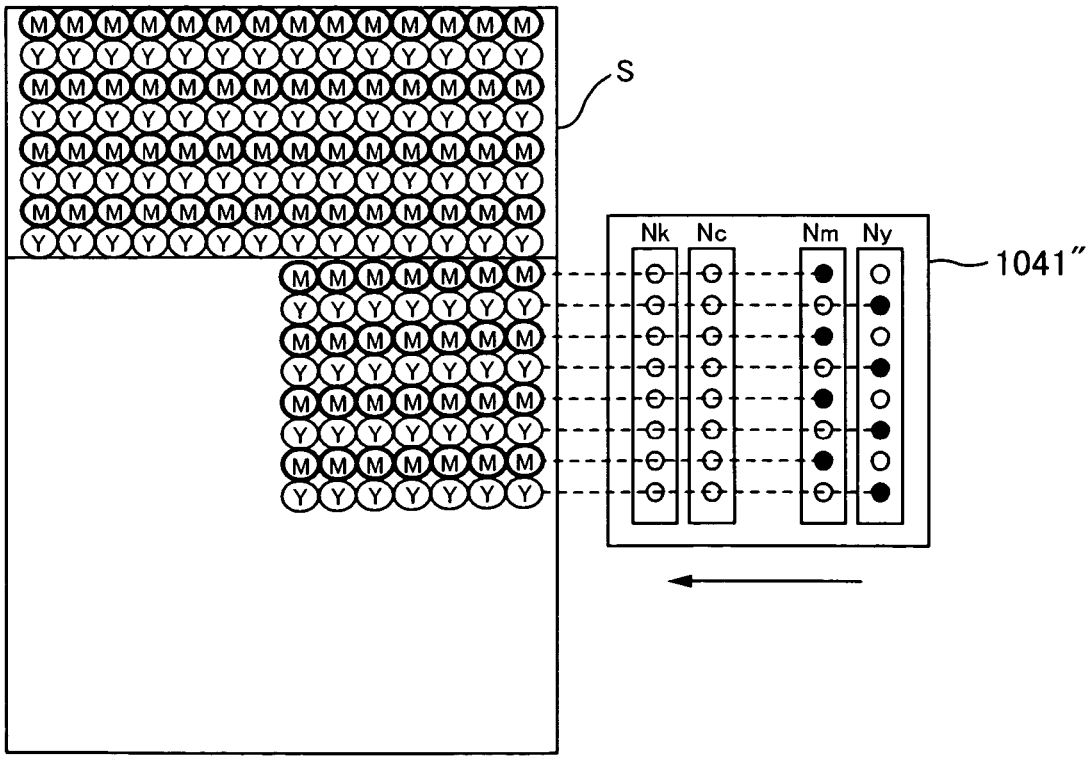

FIG. 29A and FIG. 29B are explanatory diagrams of band printing in which ink is ejected from nozzles of a magenta ink nozzle row and those of a yellow ink nozzle row of the third embodiment. FIG. 29A shows the position of the print head 1041" and a state of dot formation during a pass in the forward pass printing. FIG. 29B shows the position of the print head 1041" and a state of dot formation during a pass in the return pass printing. In FIGS. 29A and 29B, magenta dots M are indicated with a thick line, and yellow dots Y are indicated with a thin line.

As shown in FIG. 29A, the print head 1041" moves from the left side to the right side of FIG. 29A during a first pass. At this time, ink droplets are ejected from the nozzles indicated with black circles in FIG. 29A. Specifically, ink droplets are ejected from the nozzles #1, #3, #5, and #7 of the yellow ink nozzle row Ny (odd-numbered nozzles), and ink droplets are ejected from the nozzles #2, #4, #6 and #8 of the magenta ink nozzle row Nm (even-numbered nozzles). In this way, even if a yellow ink droplet Y lands on the paper S first and then a magenta ink droplet M lands on the paper S, both dots are formed on the paper S shifted from each other in the carrying direction since corresponding nozzles for ejecting ink are shifted from each other in the carrying direction.

Although these magenta ink dots and yellow ink dots are formed shifted from each other in the carrying direction, these dots are very small so that when viewed macroscopically, these dots are recognized as red, the secondary color of yellow and magenta.

Next, as shown in FIG. 29B, the print head 1041" moves from the right side to the left side of FIG. 29B during a return pass. At this time as well, ink droplets are ejected from the nozzles indicated with black circles in FIG. 29B. Specifically, ink droplets are ejected from the odd-numbered nozzles of the yellow ink nozzle row Ny, and ink droplets are ejected from the even-numbered nozzles of the magenta ink nozzle row Nm. In this way, magenta ink dots and yellow ink dots are formed on the paper S shifted from each other in the carrying direction.

When the bidirectional printing is performed, magenta ink dots and yellow ink dots are formed so as to be alternately lined up in the carrying direction both during a forward pass and a return pass. In this way, by setting nozzles for ejecting ink in a zigzag form, yellow ink dots are formed shifted in the carrying direction with respect to magenta ink dots. As a result, difference in lightness of dots caused by different landing orders does not occur. In addition, since raster lines formed with magenta ink and raster lines formed with yellow ink are formed alternately, it is possible to mitigate occurrence of the band-shaped unevenness in color caused by consecutive raster lines as shown in the reference example.

In this case as well, appearance of the secondary color varies between when dots are formed mutually overlapped and when dots are formed shifted from each other. Therefore, a printer driver that is capable of forming dots so as to achieve correct color appearance is used.

Regarding Printing of Green Color in the Third Embodiment

It is possible to print yellow dots shifted with respect to cyan dots as shown in FIG. 27B with a similar method to the above-described method for printing red color, without using the print head 1041' shown in FIG. 25.

Figure 30A:
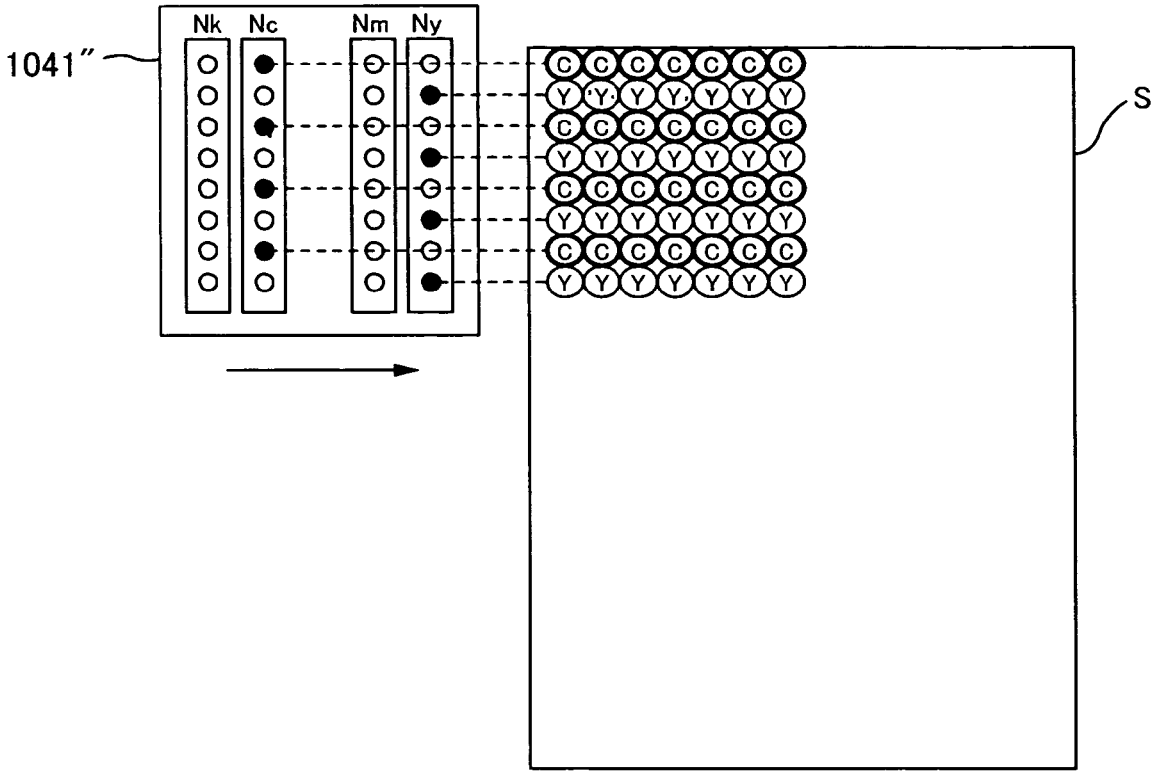
FIGS. 30A and 30B are explanatory diagrams of band printing in which ink is ejected from nozzles of the cyan ink nozzle row and those of the yellow ink nozzle row of the third embodiment.
Figure 30B:
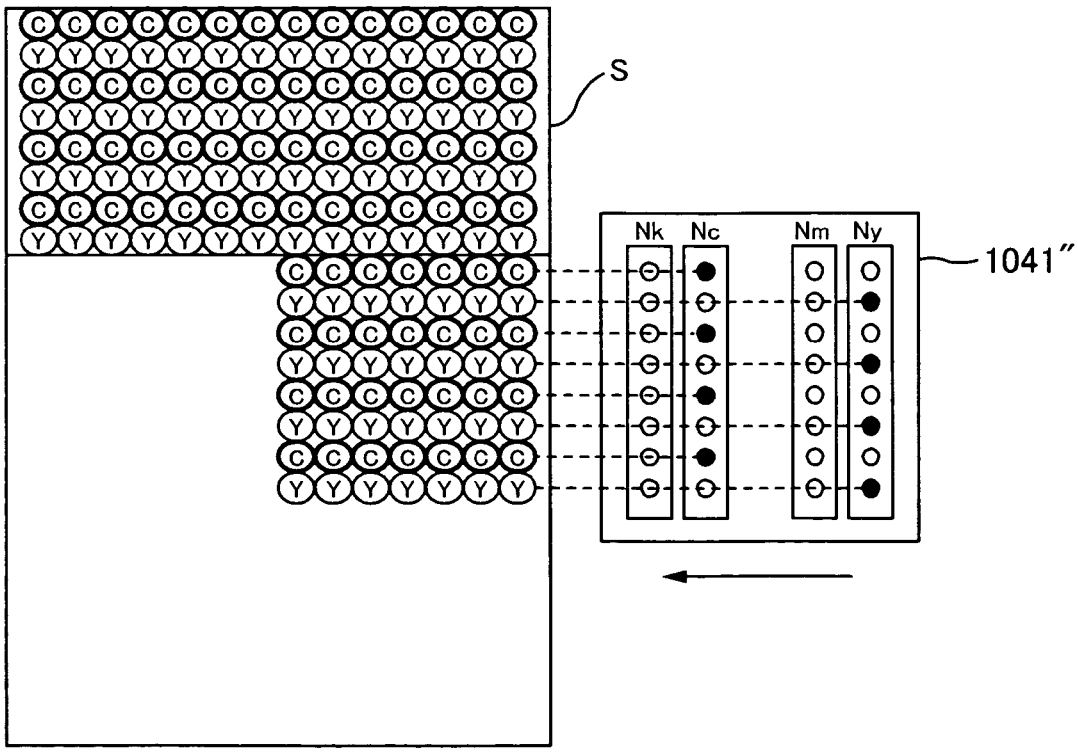

FIG. 30A and FIG. 30B are explanatory diagrams of band printing in which ink is ejected from the nozzles of the cyan ink nozzle row and those of the yellow ink nozzle row of the third embodiment. FIG. 30A shows the position of the print head 1041" and a state of dot formation during a forward pass. FIG. 30B shows the position of the print head 1041" and a state of dot formation during a return pass. In FIGS. 30A and 30B, cyan dots Care indicated with a thick line, and yellow dots Y are indicated with a thin line.

As shown in FIG. 30A, the print head 1041" moves from the left side to the right side of FIG. 30A during a forward pass. At this time, ink droplets are ejected from the nozzles indicated with black circles in FIG. 30A. Specifically, ink droplets are ejected from the odd-numbered nozzles of the yellow ink nozzle row Ny, and ink droplets are ejected from the even-numbered nozzles of the cyan ink nozzle row Nc. In this way, even if a yellow ink droplet Y lands on the paper S first and then a cyan ink droplet C lands on the paper S, both dots are formed on the paper S shifted from each other in the carrying direction since corresponding nozzles for ejecting ink are shifted from each other in the carrying direction.

Although these cyan ink dots and yellow ink dots are formed shifted from each other in the carrying direction, these dots are very small so that when viewed macroscopically, these dots are recognized as green, the secondary color of yellow and cyan.

Next, as shown in FIG. 30B, the print head 1041" moves from the right side to the left side of FIG. 30B during a return pass. At this time as well, ink droplets are ejected from the odd-numbered nozzles of the yellow ink nozzle row Ny, and ink droplets are ejected from the even-numbered nozzles of the cyan ink nozzle row Nc. In this way, cyan ink dots and yellow ink dots are formed on the paper S shifted from each other in the carrying direction.

When the bidirectional printing is performed, cyan ink dots and yellow ink dots are formed so as to be alternately lined up in the carrying direction both during a forward pass and a return pass. In this way, by setting nozzles for ejecting ink in a zigzag form, yellow ink dots are formed shifted in the carrying direction with respect to cyan ink dots. As a result, difference in lightness of dots caused by different landing orders does not occur. In addition, since raster lines formed with cyan ink and raster lines formed with yellow ink are formed alternately, it is possible to mitigate occurrence of the band-shaped unevenness in color caused by consecutive raster lines as shown in the reference example.

Appearance of the secondary color varies between when dots are formed mutually overlapped and when dots are formed shifted from each other. Therefore, a printer driver that is capable of forming dots so as to achieve correct color appearance is used.

As described above, in the case of the blue dot (CM), which is the secondary color formed with cyan and magenta, both of cyan and magenta are dark colors and have little difference in their color lightness. Therefore, the color appearance of dots is not significantly affected by the landing order of ink droplets. Accordingly, in the third embodiment, the odd-numbered nozzles are set as the nozzles for ejecting cyan and magenta inks, and the even-numbered nozzles are set as the nozzles for ejecting black and yellow inks. Specifically, the nozzles for ejecting cyan ink and those for ejecting magenta ink are disposed in the same positions in terms of the carrying direction, and the nozzles for ejecting yellow ink and those for ejecting black ink are disposed in the same positions in terms of the carrying direction.

Other Embodiments

The foregoing second and third embodiments are for the purpose of facilitating the understanding of the present invention and are not to be interpreted as limiting the present invention. The invention can of course be altered and improved without departing from the gist thereof and includes functional equivalents. In particular, embodiments mentioned below are also included in the present invention.

Regarding the Print Head

In the foregoing second and third embodiments, ink is ejected using a piezo element. However, the method for ejecting liquid is not limited to this. Other methods, such as a method for generating bubbles in the nozzles through heat, may also be employed.

Also, in the foregoing second and third embodiments, the print head is provided in the carriage. However, it is also possible to provide the print head in an ink cartridge that can be attached and detached to and from the carriage.

Summary of the Second and Third Embodiments (1) The printer 1001 as a printing apparatus of the foregoing embodiments is provided with the print head including the yellow ink nozzle row Ny' for ejecting yellow ink, the magenta ink nozzle row Nm' for ejecting magenta ink, and the cyan ink nozzle row Nc' for ejecting cyan ink, each of which has a plurality of nozzles lined up at predetermined nozzle spacings in a predetermined direction (carrying direction). The printer 1001 is provided with the moving mechanism (paper carrying mechanism) that relatively moves in the predetermined direction the positions of the print head and paper S as a medium. A plurality of nozzles of the yellow ink nozzle row Ny' are shifted with respect to the nozzles of the magenta ink nozzle row Nm' and those of the cyan ink nozzle row Nc' in the predetermined direction.

Since a printing apparatus that is capable of forming yellow ink dots shifted in the nozzle row direction with respect to magenta ink dots and cyan ink dots is provided, occurrence of the band-shaped unevenness in color caused by different landing orders in the bidirectional printing can be mitigated.

(2) For example, an amount by which a plurality of nozzles of the yellow ink nozzle row Ny' are shifted with respect to a plurality of nozzles of the magenta ink nozzle row Nm' and those of the cyan ink nozzle row Nc' is an amount equivalent to half the predetermined nozzle spacing.

In this way, yellow ink can be ejected as shifted by a distance equivalent to half the nozzle pitch N in the nozzle row direction with respect to magenta ink and cyan ink.

Therefore, yellow dots can be formed shifted by a distance equivalent to half the nozzle pitch N with respect to magenta dots and cyan dots.

However, an amount by which a plurality of nozzles of the yellow ink nozzle row Ny' are shifted with respect to a plurality of nozzles of the magenta ink nozzle row Nm' and those of the cyan ink nozzle row Nc' is not limited to half the nozzle spacing.

(3) A plurality of nozzles of the magenta ink nozzle row Nm' and those of the cyan ink nozzle row Nc' are disposed in the same positions in terms of the predetermined direction.

Magenta ink and cyan ink are both dark colors and difference in color lightness therebetween is small. Therefore, the color appearance of blue dot, which is the secondary color formed with cyan and magenta, is not significantly affected by the landing order. Accordingly, the positions in the carrying direction of the nozzles for both colors can be the same.

However, the positions in the carrying direction of the nozzles of the magenta ink nozzle row Nm' and those of the cyan ink nozzle row Nc' can be set arbitrary, as long as those nozzles are not disposed in the same positions as the nozzles of the yellow ink nozzle row Ny' in terms of the carrying direction.

(4) The print head 1041' further includes the black ink nozzle row Nk' for ejecting black ink. A plurality of nozzles of the black ink nozzle row Nk' and those of the yellow ink nozzle row Ny' are disposed in the same positions in terms of the predetermined direction.

Since black dots are rarely used to form a secondary color by overlapping or being overlapped by other colors. Therefore, a plurality of nozzles of the black ink nozzle row Nk' and those of the yellow ink nozzle row Ny' can be disposed in the same positions in terms of the carrying direction.

However, since black dots are rarely used to form a secondary color as described above, the position in the carrying direction of the nozzles for forming black dots can be set arbitrary.

(5) The cyan ink nozzle row Nc' and the black ink nozzle row Nk' are configured as a single unit, and the magenta ink nozzle row Nm' and the yellow ink nozzle row Ny' are configured as a single unit. The print head 1041' is configured such that a plurality of nozzles of the cyan ink nozzle row Nc' and those of the magenta ink nozzle row Nm' are disposed in the same positions in terms of the predetermined direction, and a plurality of nozzles of the black ink nozzle row Nk' and those of the yellow ink nozzle row Ny' are disposed in the same positions in terms of the predetermined direction.

In this way, as shown in FIG. 25, the cyan ink nozzle row and the black ink nozzle row are manufactured as a single unit, and the magenta ink nozzle row and the yellow ink nozzle row are manufactured as a single unit, thereby enabling standardization of parts.

(6) Also, the magenta ink nozzle row Nm' and the black ink nozzle row Nk' are configured as a single unit, and the cyan ink nozzle row Nc' and the yellow ink nozzle row Ny' are configured as a single unit. The print head 1041' is configured such that a plurality of nozzles of the cyan ink nozzle row Nc' and those of the magenta ink nozzle row Nm' are disposed in the same positions in terms of the predetermined direction, and a plurality of nozzles of the black ink nozzle row Nk' and those of the yellow ink nozzle row Ny' are disposed in the same positions in terms of the predetermined direction.

In this way, the magenta ink nozzle row and the black ink nozzle row are manufactured as a single unit, and the cyan ink nozzle row and the yellow ink nozzle row are manufactured as a single unit, thereby enabling standardization of parts.

(7) The paper carrying mechanism is a carrying mechanism that carries the paper S in the carrying direction. The printing apparatus 1 further includes a carriage moving mechanism as a head moving mechanism that moves the print head 1041' in a direction intersecting the nozzle row direction.

In this way, an image can be formed on the paper S by forming dots with moving the print head 1041' in a direction intersecting the carrying direction.

However, the paper S may be relatively moved, instead of moving the print head 1041'.

(8) The yellow ink nozzle row Ny', the magenta ink nozzle row Nm' and the cyan ink nozzle row Nc' have a common length. After the carriage moving mechanism has moved the print head 1041' in the intersecting direction, the paper carrying mechanism carries the paper S by this common length.

For example, when the number of nozzles is 180 and the nozzle pitch is N, this common length is 180N, and the carry amount is 180N. The above-described band printing can be performed by carrying the paper S by the common length in this way.

(9) The carriage moving mechanism 1030 moves the print head 1041' that ejects ink in a forward pass direction of the intersecting directions, and the paper carrying mechanism 1020 carries the paper S by the common length of the nozzle rows. Further, the carriage moving mechanism 1030 moves the print head 1041' in the return pass direction of the intersecting directions while letting the print head 1041' eject ink, thereby the bidirectional band printing is performed. In the second embodiment, a configuration is adopted in which nozzles of the yellow ink nozzle row are shifted in the carrying direction with respect to nozzles of nozzle rows for other colors. Accordingly, yellow dots are formed shifted with respect to cyan dots and magenta dots, and therefore, even when bidirectional band printing is performed, occurrence of unevenness in color caused by different landing orders can be mitigated.

(10) When the print head 1041' forms dots on the paper S, yellow ink dots are formed shifted in the predetermined direction (carrying direction) with respect to magenta ink dots and cyan ink dots.

In this way, since yellow dots are formed shifted with respect to cyan dots and magenta dots, occurrence of unevenness in color caused by different landing orders can be mitigated.

(11) With the printer 1001 that includes all the structural elements described above, substantially all the described effects can be achieved, and therefore the object of the present invention is achieved in the most effective manner.

(12) The second and third embodiments include the following printing methods as well. That is, this printing method includes: while forming dots on a medium S by ejecting ink droplets respectively from a yellow ink nozzle row Ny' for ejecting yellow ink, a magenta ink nozzle row Nm' for ejecting magenta ink, and a cyan ink nozzle row Nc' for ejecting cyan ink, relatively moving the position of the medium and the nozzle rows for the respective colors in a direction intersecting the nozzle rows for the respective colors, and relatively moving the positions of the medium S and the nozzle rows for the respective colors in a direction of the nozzle rows for the respective colors. Dots of the yellow ink are formed on the medium S shifted in the nozzle row direction with respect to dots of the magenta ink and dots of the cyan ink.

Since a printing apparatus that is capable of forming yellow ink dots shifted in the nozzle row direction with respect to magenta ink dots and cyan ink dots is provided, occurrence of band-shaped unevenness in color caused by different landing orders in the bidirectional printing can be mitigated.

What is claimed is:

1. A printing apparatus comprising:

a carry unit for carrying a medium in a carrying direction; and a print head that has a plurality of nozzle rows each made up of a plurality of nozzles for ejecting ink lined up in the carrying direction, and that moves in an intersecting direction intersecting the carrying direction, wherein the print head comprises a first nozzle row and a second nozzle row for a first color and brightness, and a first nozzle row and a second nozzle row for a second color and brightness, a plurality of nozzles of the first nozzle row for the first color and a plurality of nozzles of the first nozzle row for the second color are disposed in the same positions in terms of the carrying direction, a plurality of nozzles of the second nozzle row for the first color and a plurality of nozzles of the second nozzle row for the second color are disposed in the same positions in terms of the carrying direction, a plurality of the nozzles of the second nozzle rows for the first color and the second color are respectively disposed shifted in the carrying direction with respect to a plurality of the nozzles of the corresponding first nozzle rows for the first color and the second color, and the nozzle rows are disposed in the intersecting direction in the order of the first nozzle row for the first color, the second nozzle row for the second color, the second nozzle row for the first color, and the first nozzle row for the second color without any other nozzle row for the first color intervening between the first nozzle row for the first color and the second nozzle row for the first color and without any other nozzle row for the second color intervening between the first nozzle row for the second color and the second nozzle row for the second color, wherein the print head comprises a first nozzle row and a second nozzle row for a third color and brightness, wherein a plurality of the nozzles of the first nozzle row for the first color and a plurality of nozzles of the first nozzle row for the third color are disposed in the same positions in terms of the carrying direction, wherein a plurality of the nozzles of the second nozzle row for the first color and a plurality of nozzles of the second nozzle row for the third color are disposed in the same positions in terms of the carrying direction, wherein the nozzle rows are disposed in the intersecting direction in the order of the first nozzle row for the first color, the second nozzle row for the second color, the first nozzle row for the third color, the second nozzle row for the first color, the first nozzle row for the second color, and the second nozzle row for the third color, wherein a plurality of the nozzles are lined up at predetermined intervals, and wherein a plurality of the nozzles of the second nozzle rows for the respective colors are disposed shifted with respect to a plurality of the nozzles of the first nozzle rows for the respective colors in the carrying direction by a distance equivalent to half the predetermined interval.

2. A printing apparatus according to claim 1, wherein the nozzle row for one of the first color and the second color is a yellow ink nozzle row, and the nozzle row for the second color is a magenta ink nozzle row or a cyan ink nozzle row.

3. A printing apparatus according to claim 1, wherein a dot is formed on the medium by superimposing an ink droplet of the first color and an ink droplet of the second color.

4. A printing apparatus according to claim 1, wherein bidirectional printing is performed by moving the print head bi-directionally in the intersecting direction.

5. A printing apparatus according to claim 1, comprising a control section that causes to form a plurality of dot rows lined up on the medium, by causing to alternately repeat a dot forming process for forming a dot row on the medium by causing to eject ink droplets from a plurality of the nozzles of the print head that is moving, and a carrying process for carrying the medium, wherein the control section causes to form on the medium dot rows consecutively lined up in the carrying direction by performing the dot forming process once.

6. A print head comprising:

a plurality of nozzle rows each made up of a plurality of nozzles for ejecting ink lined up in a carrying direction of a medium, and that moves in an intersecting direction intersecting the carrying direction, wherein the print head comprises a first nozzle row and a second nozzle row for a first color and brightness, and a first nozzle row and a second nozzle row for a second color and brightness, a plurality of nozzles of the first nozzle row for the first color and a plurality of nozzles of the first nozzle row for the second color are disposed in the same positions in terms of the carrying direction, a plurality of nozzles of the second nozzle row for the first color and a plurality of nozzles of the second nozzle row for the second color are disposed in the same positions in terms of the carrying direction, a plurality of the nozzles of the second nozzle rows for the first color and the second color are respectively disposed shifted in the carrying direction with respect to a plurality of the nozzles of the corresponding first nozzle rows for the first color and the second color, and the nozzle rows are disposed in the intersecting direction in the order of the first nozzle row for the first color, the second nozzle row for the second color, the second nozzle row for the first color, and the first nozzle row for the second color without any other nozzle row for the first color intervening between the first nozzle row for the first color and the second nozzle row for the first color, and without any other nozzle row for the second color intervening between the first nozzle row for the second color and the second nozzle row for the second color, wherein the print head further comprises a first nozzle row and a second nozzle row for a third color and brightness, wherein a plurality of the nozzles of the first nozzle row for the first color and a plurality of nozzles of the first nozzle row for the third color are disposed in the same positions in terms of the carrying direction, wherein a plurality of the nozzles of the second nozzle row for the first color and a plurality of nozzles of the second nozzle row for the third color are disposed in the same positions in terms of the carrying direction, wherein the nozzle rows are disposed in the intersecting direction in the order of the first nozzle row for the first color, the second nozzle row for the second color, the first nozzle row for the third color, the second nozzle row for the first color, the first nozzle row for the second color, and the second nozzle row for the third color, wherein a plurality of the nozzles are lined up at predetermined intervals, and wherein a plurality of the nozzles of the second nozzle rows for the respective colors are disposed shifted with respect to a plurality of the nozzles of the first nozzle rows for the respective colors in the carrying direction by a distance equivalent to half the predetermined.

* * * * *